US012383803B2

(12) United States Patent
Parsons et al.

(10) Patent No.: US 12,383,803 B2
(45) **Date of Patent: *Aug. 12, 2025**

(54) GOLF CLUB HEADS AND METHODS TO MANUFACTURE GOLF CLUB HEADS

(71) Applicant: PARSONS XTREME GOLF, LLC, Scottsdale, AZ (US)

(72) Inventors: Robert R. Parsons, Scottsdale, AZ (US); Bradley D. Schweigert, Cave Creek, AZ (US); Michael R. Nicolette, Scottsdale, AZ (US)

(73) Assignee: PARSONS XTREME GOLD, LLC, Scottsdale, AZ (US)

( * ) Notice: Subject to any disclaimer, the term of this patent is extended or adjusted under 35 U.S.C. 154(b) by 39 days.

This patent is subject to a terminal disclaimer.

(21) Appl. No.: 18/408,965

(22) Filed: Jan. 10, 2024

(65) Prior Publication Data

US 2024/0139591 A1 May 2, 2024

Related U.S. Application Data

(63) Continuation-in-part of application No. 18/229,760, filed on Aug. 3, 2023, now Pat. No. 12,233,319, (Continued)

(51) Int. Cl.

| | |
|---|---|
| ***A63B 53/04*** | (2015.01) |
| ***A63B 60/02*** | (2015.01) |
| *A63B 53/06* | (2015.01) |

(52) U.S. Cl.

CPC ..... *A63B 53/0466* (2013.01); *A63B 53/04* (2013.01); *A63B 60/02* (2015.10); (Continued)

(58) Field of Classification Search

CPC ..... A63B 53/0412; A63B 53/0433; A63B 53/0466; A63B 2053/0491

See application file for complete search history.

(56) References Cited

U.S. PATENT DOCUMENTS

| | | |
|---|---|---|
| 1,133,129 A | 3/1915 | Govan |
| 1,269,745 A | 6/1918 | Robertson |

(Continued)

OTHER PUBLICATIONS

Examination Report dated Dec. 2, 2019 for UK Application No. GB1911896.7.

(Continued)

*Primary Examiner* — Alvin A Hunter

(57) ABSTRACT

Embodiments of golf club heads and methods to manufacture golf club heads are generally described herein. In one example, a golf club head includes a body portion, a crown portion having a composite material, a first groove on a bottom portion extending in a heel-to-toe direction, a second groove on the bottom portion extending in a heel-to-toe direction, a first set of ports on the bottom portion between the first groove and the second groove, a second set of ports on the bottom portion between the second groove and a rear portion, and a filler material in the body portion between the first groove and the rear portion. The filler material at least partially surrounds the first set of ports and the second set of ports. Other examples and embodiments may be described and claimed.

18 Claims, 33 Drawing Sheets

Related U.S. Application Data which is a continuation of application No. 17/205,887, filed on Mar. 18, 2021, now Pat. No. 11,752,402, which is a continuation of application No. 16/820,366, filed on Mar. 16, 2020, now Pat. No. 10,981,037, which is a continuation of application No. 16/418,691, filed on May 21, 2019, now Pat. No. 10,653,928, which is a continuation of application No. 15/803,157, filed on Nov. 3, 2017, now Pat. No. 10,335,645, which is a continuation of application No. 15/290,859, filed on Oct. 11, 2016, now Pat. No. 9,814,945, which is a continuation of application No. 15/040,892, filed on Feb. 10, 2016, now Pat. No. 9,550,096, said application No. 16/820,366 is a continuation-in-part of application No. 16/372,009, filed on Apr. 1, 2019, now Pat. No. 10,821,334, which is a continuation of application No. 15/875,416, filed on Jan. 19, 2018, now Pat. No. 10,293,220, which is a continuation of application No. 15/446,842, filed on Mar. 1, 2017, now Pat. No. 9,895,582, which is a continuation of application No. 15/377,120, filed on Dec. 13, 2016, now Pat. No. 9,802,087, which is a continuation of application No. 14/939,849, filed on Nov. 12, 2015, now Pat. No. 9,555,295, which is a continuation of application No. 14/615,606, filed on Feb. 6, 2015, now Pat. No. 9,199,140, said application No. 16/820,366 is a continuation-in-part of application No. 16/290,610, filed on Mar. 1, 2019, now Pat. No. 10,617,918, which is a continuation of application No. 15/875,496, filed on Jan. 19, 2018, now Pat. No. 10,252,123, which is a continuation of application No. 15/457,627, filed on Mar. 13, 2017, now Pat. No. 9,895,583, which is a continuation of application No. 15/189,806, filed on Jun. 22, 2016, now Pat. No. 9,636,554, which is a continuation of application No. 14/667,546, filed on Mar. 24, 2015, now Pat. No. 9,399,158, which is a continuation-in-part of application No. 14/615,606, filed on Feb. 6, 2015, now Pat. No. 9,199,140, said application No. 16/820,366 is a continuation-in-part of application No. 16/375,553, filed on Apr. 4, 2019, now Pat. No. 10,695,623, which is a continuation of application No. 15/967,117, filed on Apr. 30, 2018, now Pat. No. 10,293,221, which is a continuation of application No. 15/457,618, filed on Mar. 13, 2017, now Pat. No. 9,987,526, which is a continuation of application No. 15/163,393, filed on May 24, 2016, now Pat. No. 9,662,547, which is a continuation of application No. 14/667,541, filed on Mar. 24, 2015, now Pat. No. 9,352,197, which is a continuation-in-part of application No. 14/615,606, filed on Feb. 6, 2015, now Pat. No. 9,199,140, application No. 18/408,965, filed on Jan. 10, 2024 is a continuation-in-part of application No. 18/201,320, filed on May 24, 2023, now Pat. No. 12,121,782, which is a continuation of application No. 17/231,832, filed on Apr. 15, 2021, now Pat. No. 11,697,050, which is a continuation of application No. 16/713,942, filed on Dec. 13, 2019, now Pat. No. 11,000,742, which is a continuation of application No. 16/198,128, filed on Nov. 21, 2018, now Pat. No. 10,532,257, which is a continuation of application No. 15/583,756, filed on May 1, 2017, now Pat. No. 10,143,899, which is a continuation of application No. 15/271,574, filed on Sep. 21, 2016, now Pat. No. 9,669,270, application No. 18/408,965, filed on Jan. 10, 2024 is a continuation-in-part of application No. 17/731,402, filed on Apr. 28, 2022, now Pat. No. 12,036,451, which is a continuation of application No. 17/138,797, filed on Dec. 30, 2020, now Pat. No. 11,344,774, which is a continuation of application No. 16/542,548, filed on Aug. 16, 2019, now Pat. No. 10,898,766, which is a continuation of application No. 15/967,098, filed on Apr. 30, 2018, now Pat. No. 10,420,989, which is a continuation of application No. 15/687,273, filed on Aug. 25, 2017, now Pat. No. 9,981,160, said application No. 16/542,548 is a continuation-in-part of application No. 16/222,580, filed on Dec. 17, 2018, now Pat. No. 10,722,764, which is a continuation of application No. 15/831,148, filed on Dec. 4, 2017, now Pat. No. 10,195,501, which is a continuation of application No. 15/453,701, filed on Mar. 8, 2017, now Pat. No. 9,833,667, application No. 18/408,965, filed on Jan. 10, 2024 is a continuation of application No. 17/505,851, filed on Oct. 20, 2021, now Pat. No. 11,904,216, which is a continuation of application No. 15/970,665, filed on May 3, 2018, now Pat. No. 11,173,356, which is a continuation of application No. 15/667,343, filed on Aug. 2, 2017, now Pat. No. 10,213,659, said application No. 15/970,665 is a continuation-in-part of application No. 15/808,552, filed on Nov. 9, 2017, now Pat. No. 10,099,093, which is a continuation of application No. 15/492,711, filed on Apr. 20, 2017, now Pat. No. 9,821,201, said application No. 15/970,665 is a continuation-in-part of application No. 15/724,035, filed on Oct. 3, 2017, now Pat. No. 9,999,814, which is a continuation of application No. 15/440,968, filed on Feb. 23, 2017, now Pat. No. 9,795,842, said application No. 15/970,665 is a continuation-in-part of application No. 15/807,201, filed on Nov. 8, 2017, now Pat. No. 10,010,770, which is a continuation of application No. 15/463,306, filed on Mar. 20, 2017, now Pat. No. 9,821,200, which is a continuation of application No. 15/249,857, filed on Aug. 29, 2016, now Pat. No. 9,630,070, said application No. 15/970,665 is a continuation-in-part of application No. 15/725,900, filed on Oct. 5, 2017, now Pat. No. 10,052,532, which is a continuation of application No. 15/445,253, filed on Feb. 28, 2017, now Pat. No. 9,795,843, which is a continuation of application No. 15/227,281, filed on Aug. 3, 2016, now Pat. No. 9,782,643, said application No. 15/970,665 is a continuation-in-part of application No. 15/477,972, filed on Apr. 3, 2017, now Pat. No. 9,914,029, which is a continuation of application No. 15/406,408, filed on Jan. 13, 2017, now Pat. No. 9,861,867.

(60) Provisional application No. 62/115,024, filed on Feb. 11, 2015, provisional application No. 62/120,760, filed on Feb. 25, 2015, provisional application No. 62/138,918, filed on Mar. 26, 2015, provisional application No. 62/184,757, filed on Jun. 25, 2015, provisional application No. 62/194,135, filed on Jul. 17, 2015, provisional application No. 62/195,211, filed on Jul. 21, 2015, provisional application No. 62/042,155, filed on Aug. 26, 2014, provisional application No. 62/048,693, filed on Sep. 10, 2014, provisional application No. 62/101,543, filed on Jan. 9, 2015, provisional application No. 62/105,123, filed on Jan. 19, 2015, provisional application No. 62/109,510, filed on Jan. 29, 2015, provisional application No. 62/291,793, filed on Feb. 5, 2016, provisional application No. 62/380,727, filed on Aug. 29, 2016, provisional application No. 62/356,539, filed on Jun. 30, 2016, provisional application No. 62/360,802, filed on Jul. 11, 2016, provisional application No. 62/512,275, filed on May 30, 2017, provisional application No. 62/329,662, filed on Apr. 29, 2016, provisional application No. 62/444,671, filed on Jan. 10, 2017, provisional application No. 62/445,878, filed on Jan. 13, 2017, provisional application No. 62/337,184, filed on May 16, 2016, provisional application No. 62/361,988, filed on Jul. 13, 2016, provisional application No. 62/281,639, filed on Jan. 21, 2016, provisional application No. 62/296,506, filed on Feb. 17, 2016, provisional application No. 62/301,756, filed on Mar. 1, 2016, provisional application No. 62/362,491, filed on Jul. 14, 2016, provisional application No. 62/406,856, filed on Oct. 11, 2016, provisional application No. 62/412,389, filed on Oct. 25, 2016, provisional application No. 62/419,242, filed on Nov. 8, 2016.

(52) U.S. Cl.
CPC ..... *A63B 53/0408* (2020.08); *A63B 53/0412* (2020.08); *A63B 53/0433* (2020.08); *A63B 2053/0491* (2013.01); *A63B 53/06* (2013.01); *A63B 2209/00* (2013.01)

(56) References Cited

U.S. PATENT DOCUMENTS 1,306,029 A 6/1919 Robertson
D55,867 S 7/1920 Matters
1,534,800 A 4/1925 Malusz
1,538,312 A 5/1925 Neish
D138,437 S 8/1944 Link
D138,438 S 8/1944 Link
D138,442 S 8/1944 Link
3,652,094 A 3/1972 Glover
D240,748 S 7/1976 Bock et al.
4,085,934 A 4/1978 Churchward
D253,778 S 12/1979 Madison
4,795,159 A 1/1989 Nagamoto
D307,783 S 5/1990 Iinuma
5,106,094 A 4/1992 Desbiolles et al.
D326,885 S 6/1992 Paul
5,219,408 A 6/1993 Sun
D351,883 S 10/1994 Solheim et al.
5,485,997 A 1/1996 Schmidt et al.
5,499,819 A 3/1996 Nagamoto
5,518,243 A 5/1996 Redman
5,597,361 A 1/1997 Hope
D378,111 S 2/1997 Parente et al.
5,624,331 A 4/1997 Lo et al.
D384,120 S 9/1997 Cruz et al.
5,788,584 A 8/1998 Parente et al.
D400,625 S 11/1998 Kubica et al.
D400,627 S 11/1998 Kubica et al.
D405,489 S 2/1999 Kubica et al.
D405,492 S 2/1999 Kubica et al.
5,997,415 A 12/1999 Wood
D444,830 S 7/2001 Kubica et al.
6,273,832 B1 8/2001 Helmstetter et al.
6,290,609 B1 9/2001 Takeda
6,306,048 B1 10/2001 McCabe et al.
6,409,612 B1 6/2002 Evans et al.
D478,140 S 8/2003 Burrows
6,638,182 B2 10/2003 Kosmatka
6,773,360 B2 8/2004 Willett et al.
D508,969 S 8/2005 Hasebe
6,969,326 B2 11/2005 De Shiell et al.
D513,051 S 12/2005 Barez et al.
D514,179 S 1/2006 Chen et al.
D514,185 S 1/2006 Barez et al.
6,991,560 B2 1/2006 Tseng
D520,586 S 5/2006 Bingman
D522,077 S 5/2006 Schweigert et al.
D522,601 S 6/2006 Schweigert et al.
D523,498 S 6/2006 Chen et al.
D526,694 S 8/2006 Schweigert et al.
7,083,530 B2 8/2006 Wahl et al.
7,101,291 B2 * 9/2006 Yamamoto ..... A63B 53/04 473/324
7,121,956 B2 10/2006 Lo
D534,599 S 1/2007 Barez et al.
7,166,040 B2 1/2007 Hoffman et al.
D536,401 S 2/2007 Kawami
D536,403 S 2/2007 Kawami
7,186,190 B1 3/2007 Beach et al.
7,214,142 B2 * 5/2007 Meyer ..... G01N 29/045 473/332
7,223,180 B2 5/2007 Willett et al.
7,261,645 B2 8/2007 Oyama
7,261,646 B2 8/2007 Shiell et al.
7,273,423 B2 * 9/2007 Imamoto ..... A63B 53/0466 473/332
D563,498 S 3/2008 Jertson et al.
D564,054 S 3/2008 Jertson et al.
D564,055 S 3/2008 Jertson et al.
7,338,388 B2 3/2008 Schweigert et al.
7,347,794 B2 3/2008 Schweigert
D567,317 S 4/2008 Jertson et al.
D569,933 S 5/2008 Jertson et al.
D569,934 S 5/2008 Jertson et al.
D569,935 S 5/2008 Schweigert et al.
D569,936 S 5/2008 Schweigert et al.
D569,942 S 5/2008 Jertson et al.
D570,937 S 6/2008 Schweigert et al.
D570,938 S 6/2008 Jertson et al.
7,407,447 B2 8/2008 Beach et al.
7,410,425 B2 8/2008 Willett et al.
7,410,426 B2 8/2008 Willett et al.
7,419,441 B2 9/2008 Hoffman et al.
7,448,963 B2 11/2008 Beach et al.
7,448,964 B2 11/2008 Schweigert et al.
7,494,425 B2 2/2009 Shiell et al.
7,527,565 B1 5/2009 Ehlers et al.
7,530,903 B2 * 5/2009 Imamoto ..... A63B 60/02 473/335
7,530,904 B2 5/2009 Beach et al.
D594,520 S 6/2009 Schweigert et al.
D594,521 S 6/2009 Jertson et al.
D594,919 S 6/2009 Schweigert et al.
7,540,811 B2 6/2009 Beach et al.
D597,620 S 8/2009 Taylor et al.
7,568,985 B2 8/2009 Beach et al.
7,572,193 B2 * 8/2009 Yokota ..... A63B 60/02 473/328
7,578,753 B2 8/2009 Beach et al.
D600,297 S 9/2009 Jertson et al.
7,584,531 B2 9/2009 Schweigert et al.
7,588,502 B2 9/2009 Nishino
7,591,738 B2 9/2009 Beach et al.
D603,472 S 11/2009 Schweigert et al.
7,611,424 B2 11/2009 Nagai et al.
7,621,823 B2 11/2009 Beach et al.
D605,715 S 12/2009 Barez et al.
7,632,194 B2 12/2009 Beach et al.
7,658,686 B2 2/2010 Soracco
7,713,142 B2 5/2010 Hoffman et al.
7,717,804 B2 5/2010 Beach et al.
7,717,805 B2 5/2010 Beach et al.
D618,746 S 6/2010 Jertson et al.
D618,747 S 6/2010 Schweigert et al.
D618,753 S 6/2010 Jertson et al.
D618,754 S 6/2010 Schweigert et al.
7,744,484 B1 6/2010 Chao
7,798,203 B2 9/2010 Schweigert et al.
7,806,781 B2 * 10/2010 Imamoto ..... A63B 53/0466 473/332
7,846,041 B2 12/2010 Beach et al.

(56) References Cited

U.S. PATENT DOCUMENTS

D635,626 S 4/2011 Nicolette
7,927,229 B2 4/2011 Jertson et al.
D638,893 S 5/2011 Schweigert et al.
D638,896 S 5/2011 Schweigert et al.
7,963,861 B2 6/2011 Beach et al.
8,007,369 B2 8/2011 Soracco
8,012,038 B1 9/2011 Beach et al.
D647,585 S 10/2011 Jertson et al.
8,096,896 B2 1/2012 Schiell et al.
D661,751 S 6/2012 Nicolette et al.
D661,756 S 6/2012 Nicolette et al.
8,197,357 B1 6/2012 Rice et al.
8,202,175 B2 6/2012 Ban
8,257,196 B1 9/2012 Abbott et al.
8,257,197 B2 9/2012 Schweigert
8,262,506 B2 9/2012 Watson et al.
8,287,402 B2 10/2012 Shiell et al.
D673,630 S 1/2013 Schweigert
D673,632 S 1/2013 Schweigert et al.
8,371,957 B2 2/2013 Schweigert et al.
D680,179 S 4/2013 Solheim et al.
8,414,422 B2 4/2013 Peralta et al.
8,444,506 B2 5/2013 Watson et al.
8,485,919 B2 7/2013 Rice et al.
D691,230 S 10/2013 Chen et al.
8,562,457 B2 10/2013 Beach et al.
8,608,587 B2 12/2013 Henrikson et al.
8,628,431 B2 1/2014 Schweigert et al.
8,651,975 B2 2/2014 Soracco
8,663,026 B2 3/2014 Blowers et al.
8,777,778 B2 7/2014 Solheim et al.
8,784,232 B2 7/2014 Jertson et al.
8,790,196 B2 7/2014 Solheim et al.
8,808,108 B2 8/2014 Schweigert
D712,989 S 9/2014 Gillig
8,826,512 B2 9/2014 Schweigert
8,858,362 B1 10/2014 Leposky et al.
8,961,336 B1 2/2015 Parsons et al.
D724,164 S 3/2015 Schweigert et al.
8,979,671 B1 3/2015 Demille et al.
8,986,133 B2 * 3/2015 Bennett ..... A63B 60/00 473/344
D729,892 S 5/2015 Nicolette et al.
D733,234 S 6/2015 Nicolette
9,162,120 B2 * 10/2015 Jertson ..... A63B 53/04
9,199,140 B1 12/2015 Schweigert et al.
9,199,143 B1 12/2015 Parsons et al.
9,211,448 B2 * 12/2015 Bezilla ..... A63B 53/0466
D753,251 S 4/2016 Schweigert et al.
9,320,949 B2 * 4/2016 Golden ..... A63B 53/0466
D756,471 S 5/2016 Nicolette et al.
9,352,197 B2 5/2016 Parsons et al.
D760,334 S 6/2016 Schweigert et al.
9,399,158 B2 7/2016 Parsons et al.
9,427,634 B2 8/2016 Parsons et al.
9,452,325 B2 9/2016 DeShiell et al.
9,630,070 B2 4/2017 Parsons et al.
9,662,545 B2 * 5/2017 Beach ..... A63B 60/52
9,682,295 B1 6/2017 Dawson et al.
9,700,765 B2 * 7/2017 Frame ..... A63B 60/52
9,821,201 B1 11/2017 Parsons et al.
9,833,667 B1 * 12/2017 Parsons ..... A63B 53/04
9,839,821 B2 12/2017 DeShiell et al.
9,914,029 B2 * 3/2018 Parsons ..... A63B 60/02
9,937,390 B2 * 4/2018 Luttrell ..... A63B 53/06
9,981,160 B2 * 5/2018 Parsons ..... A63B 60/54
9,999,814 B2 * 6/2018 Parsons ..... A63B 53/04
10,080,934 B2 * 9/2018 Beach ..... A63B 53/02
10,099,093 B2 * 10/2018 Parsons ..... A63B 53/04
10,137,336 B2 * 11/2018 Mizutani ..... A63B 60/52
10,159,879 B2 * 12/2018 Jertson ..... A63B 53/04
10,195,501 B2 * 2/2019 Parsons ..... A63B 53/0466
10,213,659 B2 * 2/2019 Parsons ..... A63B 53/06
10,272,299 B2 * 4/2019 Mizutani ..... A63B 53/0466
10,384,102 B2 * 8/2019 Parsons ..... A63B 53/0466
10,420,989 B2 * 9/2019 Parsons ..... A63B 53/04
10,441,855 B2 * 10/2019 Parsons ..... A63B 53/0466
10,709,942 B2 * 7/2020 Parsons ..... A63B 53/04
10,722,764 B2 * 7/2020 Parsons ..... A63B 60/52
10,898,766 B2 * 1/2021 Parsons ..... A63B 60/002
11,173,356 B2 * 11/2021 Parsons ..... A63B 60/54
11,344,774 B2 * 5/2022 Parsons ..... A63B 60/02
11,406,880 B1 8/2022 Roach et al.
12,036,451 B2 * 7/2024 Parsons ..... A63B 60/02
2003/0027662 A1 2/2003 Werner et al.
2003/0104878 A1 6/2003 Yabu
2004/0033846 A1 2/2004 Caldwell
2004/0087388 A1 5/2004 Beach et al.
2004/0116207 A1 6/2004 De Shiell et al.
2004/0192468 A1 9/2004 Onoda et al.
2005/0049074 A1 3/2005 Chen et al.
2005/0096154 A1 5/2005 Chen
2005/0101408 A1 5/2005 Sanchez et al.
2005/0181884 A1 8/2005 Beach et al.
2005/0192116 A1 9/2005 Imamoto
2005/0209024 A1 9/2005 Oyama
2005/0239576 A1 10/2005 Stites et al.
2005/0261082 A1 11/2005 Yamamoto
2006/0105856 A1 5/2006 Lo
2006/0111200 A1 5/2006 Poynor
2006/0122004 A1 6/2006 Chen et al.
2007/0004527 A1 1/2007 Helmstetter
2007/0238551 A1 * 10/2007 Yokota ..... A63B 60/52 473/349
2007/0293344 A1 12/2007 Davis
2008/0004133 A1 1/2008 Schweigert
2008/0015049 A1 1/2008 Imamoto
2008/0188322 A1 8/2008 Anderson et al.
2008/0261715 A1 10/2008 Carter
2009/0029795 A1 1/2009 Schweigert et al.
2009/0258726 A1 10/2009 Abe
2010/0075774 A1 3/2010 Ban
2010/0144461 A1 6/2010 Ban
2010/0167837 A1 7/2010 Ban
2010/0331102 A1 12/2010 Golden et al.
2011/0143858 A1 6/2011 Peralta et al.
2012/0083359 A1 4/2012 Stites
2012/0142445 A1 6/2012 Burnett et al.
2012/0190479 A1 7/2012 Rice et al.
2012/0202615 A1 * 8/2012 Beach ..... A63B 60/52 473/345
2012/0220387 A1 * 8/2012 Beach ..... A63B 53/02 473/307
2013/0102410 A1 * 4/2013 Stites ..... A63B 53/0466 473/335
2013/0109502 A1 5/2013 Hayase et al.
2013/0130826 A1 5/2013 Soracco
2013/0210542 A1 * 8/2013 Harbert ..... A63B 53/06 473/338
2013/0303304 A1 11/2013 Sato
2013/0318772 A1 12/2013 Wahl et al.
2013/0324281 A1 * 12/2013 Boyd ..... A63B 53/0466 473/305
2014/0080625 A1 * 3/2014 Fossum ..... A63B 59/70 473/329
2014/0080634 A1 * 3/2014 Golden ..... A63B 53/0466 473/345
2014/0235369 A1 8/2014 Willett et al.
2014/0274457 A1 * 9/2014 Beach ..... A63B 53/0412 473/335
2015/0094164 A1 * 4/2015 Galvan ..... A63B 60/54 473/329
2015/0126304 A1 * 5/2015 Cleghorn ..... A63B 60/52 473/338
2015/0174461 A1 * 6/2015 Bennett ..... A63B 53/0466 473/329
2015/0182818 A1 * 7/2015 James ..... A63B 60/52 473/349
2015/0190688 A1 * 7/2015 Bennett ..... A63B 53/0466 473/329
2015/0217167 A1 * 8/2015 Frame ..... A63B 60/54 473/329
2015/0231454 A1 8/2015 Parsons et al.

(56) References Cited

U.S. PATENT DOCUMENTS

| | | | | |
|---|---|---|---|---|
| 2015/0290503 | A1 | 10/2015 | Su | |
| 2015/0360098 | A1 | 12/2015 | Parsons et al. | |
| 2016/0059088 | A1 | 3/2016 | Parsons et al. | |
| 2016/0129319 | A1* | 5/2016 | Bennett | A63B 53/0466 473/345 |
| 2016/0158610 | A1* | 6/2016 | Parsons | A63B 60/54 473/346 |
| 2016/0256753 | A1 | 9/2016 | Westrum et al. | |
| 2016/0339308 | A1 | 11/2016 | Parsons et al. | |
| 2016/0346646 | A1* | 12/2016 | Bennett | A63B 60/00 |
| 2017/0028284 | A1* | 2/2017 | Galvan | A63B 60/52 |
| 2017/0151472 | A1* | 6/2017 | Beach | A63B 60/00 |
| 2017/0203167 | A1* | 7/2017 | de la Cruz | A63B 60/00 |
| 2017/0225050 | A1* | 8/2017 | Cleghorn | A63B 60/54 |
| 2017/0282021 | A1* | 10/2017 | Golden | A63B 53/06 |
| 2017/0312592 | A1 | 11/2017 | Parsons et al. | |
| 2018/0001159 | A1* | 1/2018 | Mizutani | A63B 53/0466 |
| 2018/0001170 | A1* | 1/2018 | Mizutani | A63B 60/52 |
| 2018/0147459 | A1* | 5/2018 | Martens | A63B 60/00 |
| 2018/0185719 | A1* | 7/2018 | Johnson | A63B 53/06 |
| 2018/0345099 | A1* | 12/2018 | Harbert | A63B 53/0433 |
| 2019/0030403 | A1* | 1/2019 | Beach | A63B 60/00 |

OTHER PUBLICATIONS

Examination Report dated Sep. 12, 2019 for UK Application No. GB1911896.7.

International Search Report and Written Opinion Issued in Connection With Corresponding Application No. PCT/US16/17474 dated May 12, 2016 (8 Pages).

International Search Report and Written Opinion Issued in Connection With Corresponding Application No. PCT/US2017/013513 dated Mar. 17, 2017 (8 Pages).

International Search Report and Written Opinion received in connection with corresponding application No. PCT/US2015/016666, dated May 14, 2015 (8 pages).

International Search Report and Written Opinion received in connection with corresponding application No. PCT/US2017/055155, dated Jan. 25, 2018 (8 pages).

International Search Report and Written Opinion received in connection with PCT Application PCTUS2015042282 dated Oct. 13, 2015 (12 pages).

International Search Report and Written Opinion received in connection with PCT/US15/42484 dated Oct. 19, 2015 (12 pages).

Spotted: Three New PXG Drivers Appear on the USGA Conforming List (GOLFWRX). Dec. 18, 2017. Retrieved From the Internet on Jan. 16, 2019. URL:.http://www.golfwrx.com/482592/spotted-three-new-pxg-drivers-appear-on-the-usga-conforming-list/.

U.S. Appl. No. 29/512,313, Nicolette, "Golf Club Head," filed Dec. 18, 2014.

Wall, Jonathan, "Details: Phil's Prototype Mack Daddy PM-Grind Wedge," (http://www.pgatour.com/equipmentreport/2015/01/21/callaway-wedge.html), www.pgatour.com, PGA Tour, Inc., published Jan. 21, 2015.

* cited by examiner

GOLF CLUB HEADS AND METHODS TO MANUFACTURE GOLF CLUB HEADS

CROSS REFERENCE

This application is a continuation-in-part of application Ser. No. 18/229,760, filed Aug. 3, 2023, which is a continuation of application Ser. No. 17/205,887, filed Mar. 18, 2021, now U.S. Pat. No. 11,752,402, which is a continuation of application Ser. No. 16/820,366, filed Mar. 16, 2020, now U.S. Pat. No. 10,981,037, which is a continuation of application Ser. No. 16/418,691, filed May 21, 2019, now U.S. Pat. No. 10,653,928, which is a continuation of application Ser. No. 15/803,157, filed Nov. 3, 2017, now U.S. Pat. No. 10,335,645, which is a continuation of application Ser. No. 15/290,859, filed Oct. 11, 2016, now U.S. Pat. No. 9,814,945, which is a continuation of application Ser. No. 15/040,892, filed Feb. 10, 2016, now U.S. Pat. No. 9,550,096, which claims the benefit of U.S. Provisional Application No. 62/115,024, filed Feb. 11, 2015, U.S. Provisional Application No. 62/120,760, filed Feb. 25, 2015, U.S. Provisional Application No. 62/138,918, filed Mar. 26, 2015, U.S. Provisional Application No. 62/184,757, filed Jun. 25, 2015, U.S. Provisional No. 62/194,135, filed Jul. 17, 2015, and U.S. Provisional Application No. 62/195,211, filed Jul. 21, 2015.

U.S. application Ser. No. 16/820,366, filed Mar. 16, 2020, is a continuation-in-part of application Ser. No. 16/372,009, filed Apr. 1, 2019, now U.S. Pat. No. 10,821,334, which is a continuation of application Ser. No. 15/875,416, filed Jan. 19, 2018, now U.S. Pat. No. 10,293,220, which is a continuation of application Ser. No. 15/446,842, filed Mar. 1, 2017, now U.S. Pat. No. 9,895,582, which is a continuation of application Ser. No. 15/377,120, filed Dec. 13, 2016, now U.S. Pat. No. 9,802,087, which is a continuation of application Ser. No. 14/939,849, filed Nov. 12, 2015, now U.S. Pat. No. 9,555,295, which is a continuation of application Ser. No. 14/615,606, filed Feb. 6, 2015, now U.S. Pat. No. 9,199,140.

U.S. application Ser. No. 16/820,366, filed Mar. 16, 2020, is a continuation-in-part of application Ser. No. 16/290,610, filed Mar. 1, 2019, now U.S. Pat. No. 10,617,918, which is a continuation of application Ser. No. 15/875,496, filed Jan. 19, 2018, now U.S. Pat. No. 10,252,123, which is a continuation of application Ser. No. 15/457,627, filed Mar. 13, 2017, now U.S. Pat. No. 9,895,583, which is a continuation of application Ser. No. 15/189,806, filed Jun. 22, 2016, now U.S. Pat. No. 9,636,554, which is a continuation of application Ser. No. 14/667,546, filed Mar. 24, 2015, now U.S. Pat. No. 9,399,158, which is a continuation-in-part of application Ser. No. 14/615,606, filed Feb. 6, 2015, now U.S. Pat. No. 9,199,140, which claims the benefit of U.S. Provisional Application No. 62/042,155, filed Aug. 26, 2014, U.S. Provisional Application No. 62/048,693, filed Sep. 10, 2014, U.S. Provisional Application No. 62/101,543, filed Jan. 9, 2015, U.S. Provisional Application No. 62/105,123, filed Jan. 19, 2015, and U.S. Provisional Application No. 62/109,510, filed Jan. 29, 2015.

U.S. application Ser. No. 16/820,366, filed Mar. 16, 2020, is a continuation-in-part of application Ser. No. 16/375,553, filed Apr. 4, 2019, now U.S. Pat. No. 10,695,623, which is a continuation of application Ser. No. 15/967,117, filed Apr. 30, 2018, now U.S. Pat. No. 10,293,221, which is a continuation application Ser. No. 15/457,618, filed Mar. 13, 2017, now U.S. Pat. No. 9,987,526, which is a continuation of application Ser. No. 15/163,393, filed May 24, 2016, now U.S. Pat. No. 9,662,547, which is a continuation of application Ser. No. 14/667,541, filed Mar. 24, 2015, now U.S. Pat. No. 9,352,197, which is a continuation-in-part of application Ser. No. 14/615,606, filed Feb. 6, 2015, now U.S. Pat. No. 9,199,140, which claims the benefit of U.S. Provisional Application No. 62/042,155, filed Aug. 26, 2014, U.S. Provisional Application No. 62/048,693, filed Sep. 10, 2014, U.S. Provisional Application No. 62/101,543, filed Jan. 9, 2015, U.S. Provisional Application No. 62/105,123, filed Jan. 19, 2015, and U.S. Provisional Application No. 62/109,510, filed Jan. 29, 2015.

This application is a continuation-in-part application Ser. No. 18/201,320, filed May 24, 2023, which is a continuation of application Ser. No. 17/231,832, filed Apr. 15, 2021, now U.S. Pat. No. 11,697,050, which is a continuation of application Ser. No. 16/713,942, filed Dec. 13, 2019, now U.S. Pat. No. 11,000,742, which is a continuation of application Ser. No. 16/198,128, filed Nov. 21, 2018, now U.S. Pat. No. 10,532,257, which is a continuation of application Ser. No. 15/583,756, filed May 1, 2017, now U.S. Pat. No. 10,143,899, which is a continuation of application Ser. No. 15/271,574, filed Sep. 21, 2016, now U.S. Pat. No. 9,669,270, which claims the benefit of U.S. Provisional Application No. 62/291,793, filed Feb. 5, 2016.

This application is a continuation-in-part of application Ser. No. 17/731,402, filed Apr. 28, 2022, which is a continuation of application Ser. No. 17/138,797, filed Dec. 30, 2020, now U.S. Pat. No. 11,344,774, which is a continuation of application Ser. No. 16/542,548, filed Aug. 16, 2019, now U.S. Pat. No. 10,898,766, which is a continuation of application Ser. No. 15/967,098, filed Apr. 30, 2018, now U.S. Pat. No. 10,420,989, which is a continuation of application Ser. No. 15/687,273, filed Aug. 25, 2017, now U.S. Pat. No. 9,981,160, which claims the benefit of U.S. Provisional Application No. 62/380,727, filed Aug. 29, 2016.

U.S. patent application Ser. No. 16/542,548, filed Aug. 16, 2019 is also a continuation-in-part of application Ser. No. 16/222,580, filed Dec. 17, 2018, now U.S. Pat. No. 10,722,764, which is a continuation of application Ser. No. 15/831,148, filed Dec. 4, 2017, now U.S. Pat. No. 10,195,101, which is a continuation of application Ser. No. 15/453,701, filed Mar. 8, 2017, now U.S. Pat. No. 9,833,667, which claims the benefit of U.S. Provisional Application No. 62/356,539, filed Jun. 30, 2016, and U.S. Provisional Application No. 62/360,802, filed Jul. 11, 2016.

This application is a continuation of application Ser. No. 17/505,851, filed Oct. 20, 2021, which is a continuation of application Ser. No. 15/970,665, filed May 3, 2018, now U.S. Pat. No. 11,173,356, which is a continuation of application Ser. No. 15/667,343, filed Aug. 2, 2017, now U.S. Pat. No. 10,213,659, which claims the benefit of U.S. Provisional Application No. 62/512,275, filed May 30, 2017.

U.S. patent application Ser. No. 15/970,665, filed May 3, 2018, is also a continuation-in-part application Ser. No. 15/808,552, filed Nov. 9, 2017, now U.S. Pat. No. 10,099,093, which is a continuation of application Ser. No. 15/492,711, filed Apr. 20, 2017, now U.S. Pat. No. 9,821,201, which claims the benefit of U.S. Provisional Application No. 62/329,662, filed Apr. 29, 2016.

U.S. patent application Ser. No. 15/970,665, filed May 3, 2018, is also a continuation-in-part of application Ser. No. 15/724,035, filed Oct. 3, 2017, now U.S. Pat. No. 9,999,814 which is a continuation of application Ser. No. 15/440,968, filed Feb. 23, 2017, now U.S. Pat. No. 9,795,842, which claims the benefit of U.S. Provisional Application No. 62/444,671, filed Jan. 10, 2017, and U.S. Provisional Application No. 62/445,878, filed Jan. 13, 2017.

U.S. patent application Ser. No. 15/970,665, filed May 3, 2018, is also a continuation-in-part of application Ser. No. 15/807,201, filed Nov. 8, 2017, now U.S. Pat. No. 10,010,770, which is a continuation of application Ser. No. 15/463,306, filed Mar. 20, 2017, now U.S. Pat. No. 9,821,200, which is a continuation of application Ser. No. 15/249,857, filed Aug. 29, 2016, now U.S. Pat. No. 9,630,070, which claims the benefit of U.S. Provisional Application No. 62/337,184, filed May 16, 2016, and U.S. Provisional Application No. 62/361,988, filed Jul. 13, 2016.

U.S. patent application Ser. No. 15/970,665, filed May 3, 2018, is also a continuation-in-part of application Ser. No. 15/725,900, filed Oct. 5, 2017, now U.S. Pat. No. 10,052,532, which is a continuation of application Ser. No. 15/445,253, filed Feb. 28, 2017, now U.S. Pat. No. 9,795,843, which is a continuation of application Ser. No. 15/227,281, filed Aug. 3, 2016, now U.S. Pat. No. 9,782,643, which claims the benefit of U.S. Provisional Application No. 62/281,639, filed Jan. 21, 2016, U.S. Provisional Application No. 62/296,506, filed Feb. 17, 2016, U.S. Provisional Application No. 62/301,756, filed Mar. 1, 2016, and U.S. Provisional Application No. 62/362,491, filed Jul. 14, 2016.

U.S. patent application Ser. No. 15/970,665, filed May 3, 2018, is also a continuation-in-part of application Ser. No. 15/477,972, filed Apr. 3, 2017, now U.S. Pat. No. 9,914,029, which is a continuation of application Ser. No. 15/406,408, filed Jan. 13, 2017, now U.S. Pat. No. 9,861,867, which claims the benefit of U.S. Provisional Application No. 62/406,856, filed Oct. 11, 2016, U.S. Provisional Application No. 62/412,389, filed Oct. 25, 2016, and U.S. Provisional Application No. 62/419,242, filed Nov. 8, 2016.

The disclosures of the above-referenced applications are incorporated by reference herein in their entirety.

COPYRIGHT AUTHORIZATION

The present disclosure may be subject to copyright protection. The copyright owner has no objection to the facsimile reproduction by anyone of the present disclosure and its related documents, as they appear in the Patent and Trademark Office patent files or records, but otherwise reserves all applicable copyrights.

FIELD

The present disclosure generally relates to sports equipment, and more particularly, to golf club heads and methods to manufacture golf club heads.

BACKGROUND

In golf, various factors may affect the distance and direction that a golf ball may travel. In particular, the center of gravity (CG) and/or the moment of inertia (MOI) of a golf club head may affect the launch angle, the spin rate, and the direction of the golf ball at impact. Such factors may vary significantly based the type of golf swing.

Figure 23:
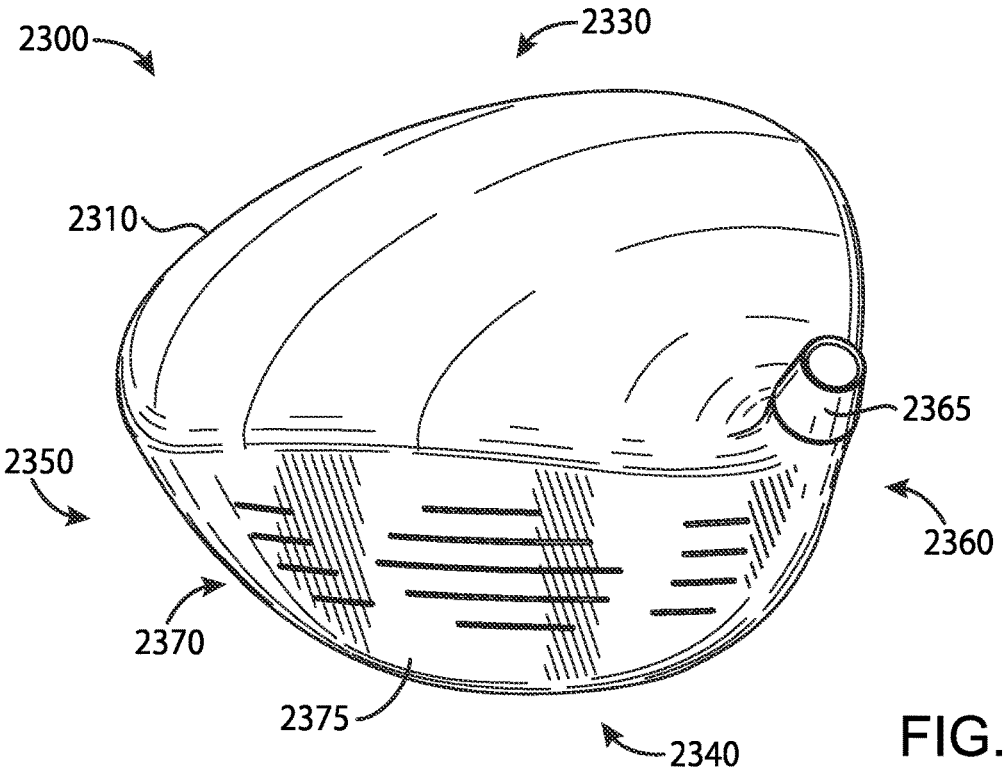
FIG. 23 is top perspective view of an example golf club head according to an embodiment of the apparatus, methods, and articles of manufacture described herein.
Figure 29:
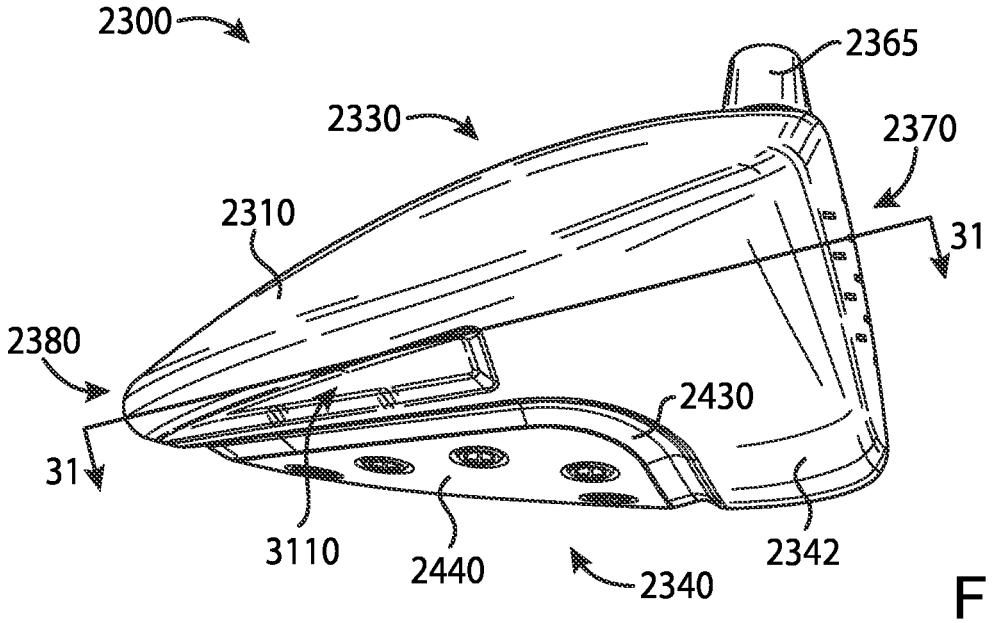
FIG. 29 depicts a toe view of the example golf club head of FIG. 23.
Figure 30:
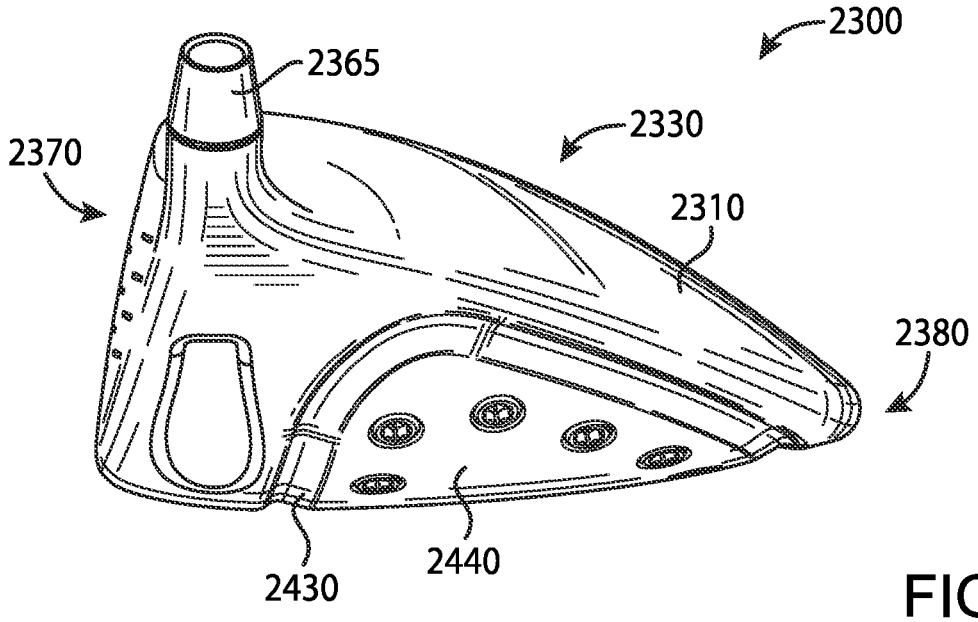
FIG. 30 depicts a heel view of the example golf club head of FIG. 23.
Figure 36:
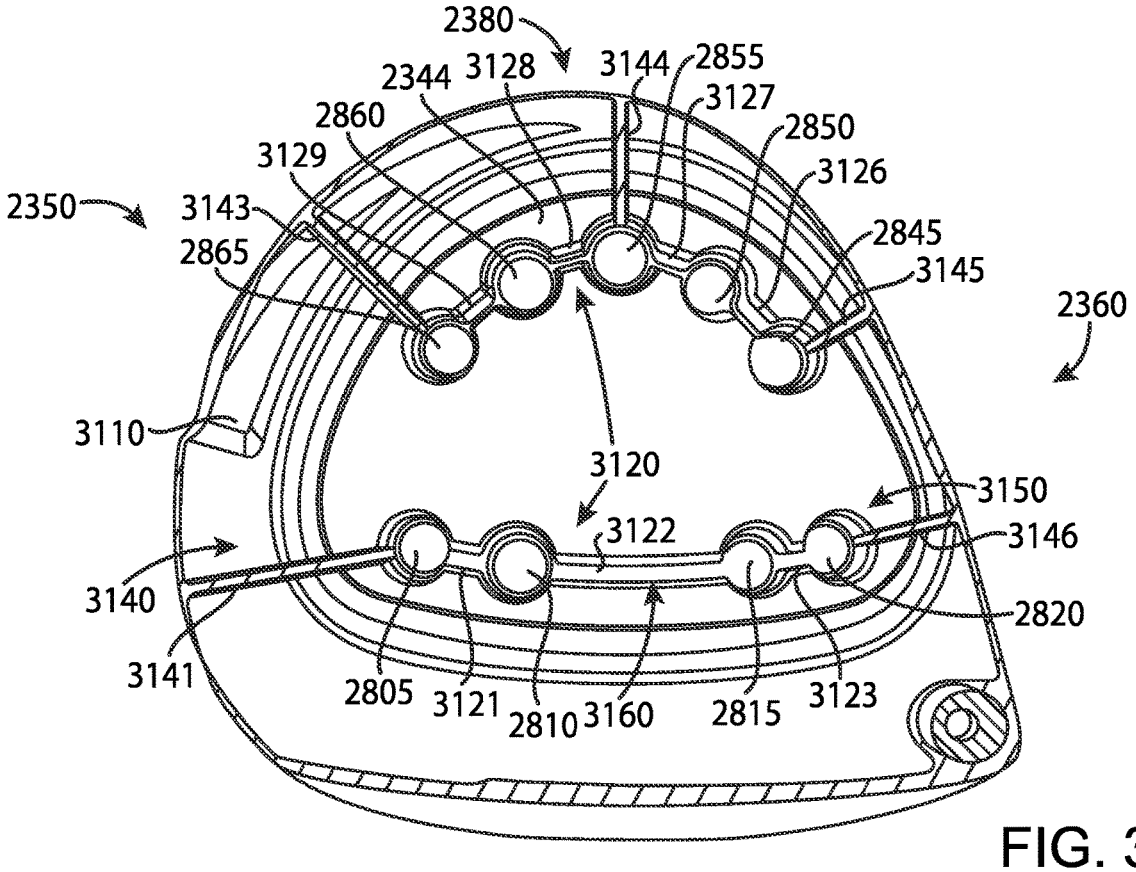

FIG. 36 depicts a cross-sectional view of an example golf club head of FIG. 23 taken at section line 31-31 of FIG. 29 according to an embodiment of the apparatus, methods, and articles of manufacture described herein.

Figure 37:
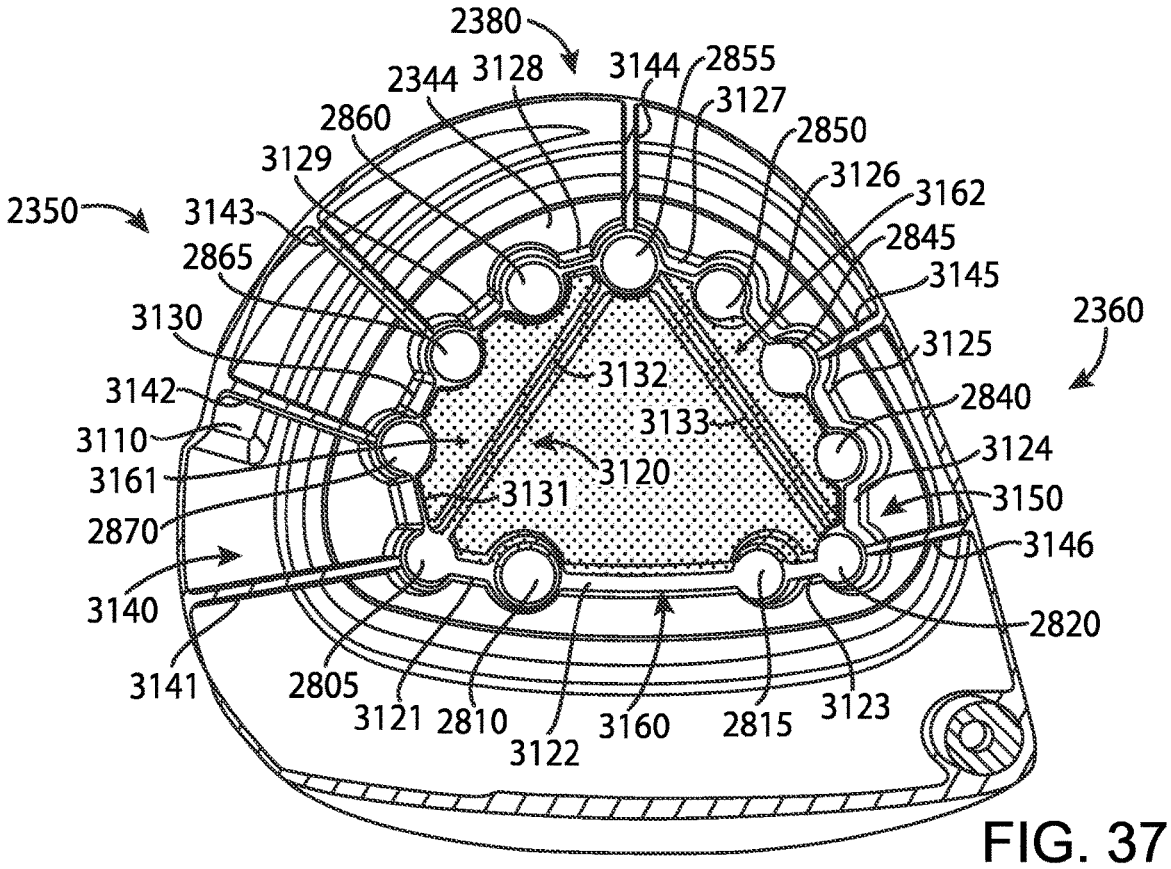

FIG. 37 depicts a cross-sectional view of an example golf club head of FIG. 23 taken at section line 31-31 of FIG. 29 according to an embodiment of the apparatus, methods, and articles of manufacture described herein.

Figure 38:
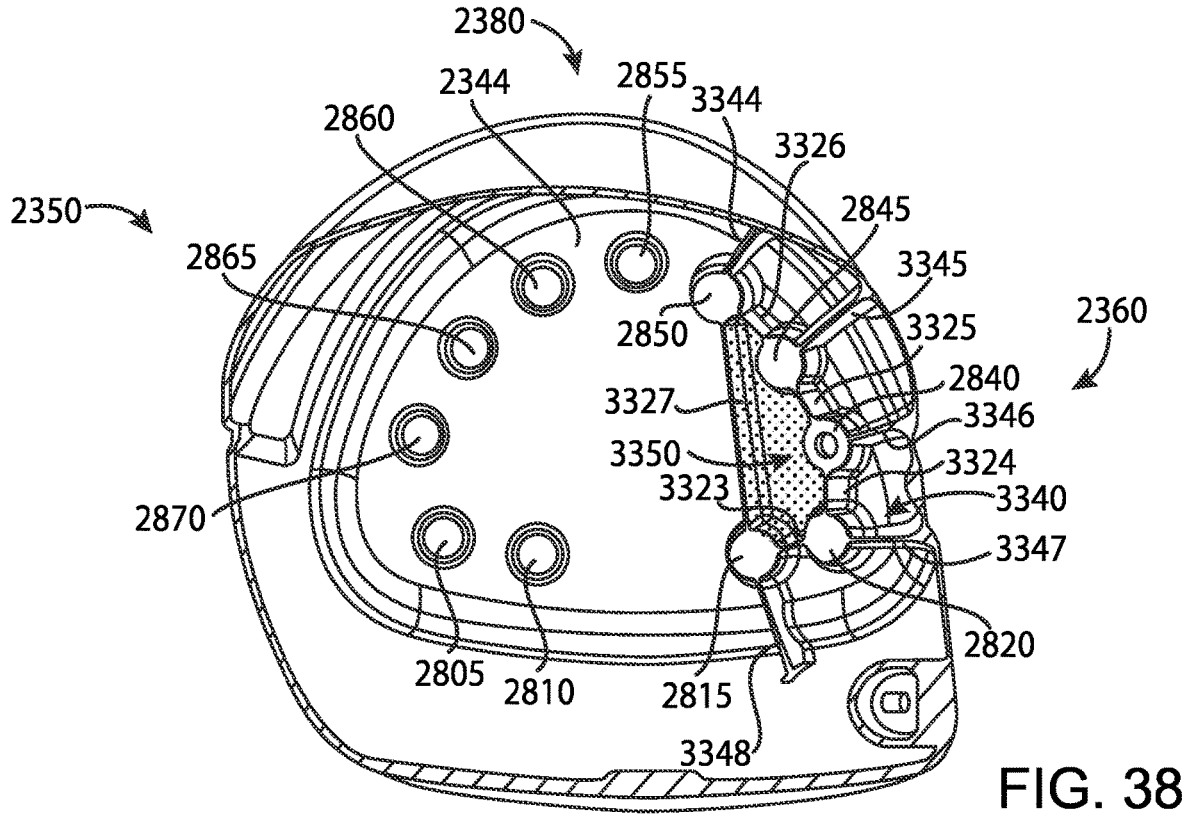

FIG. 38 depicts a cross-sectional view of an example golf club head of FIG. 23 taken at section line 31-31 of FIG. 29 according to an embodiment of the apparatus, methods, and articles of manufacture described herein.

Figure 39:
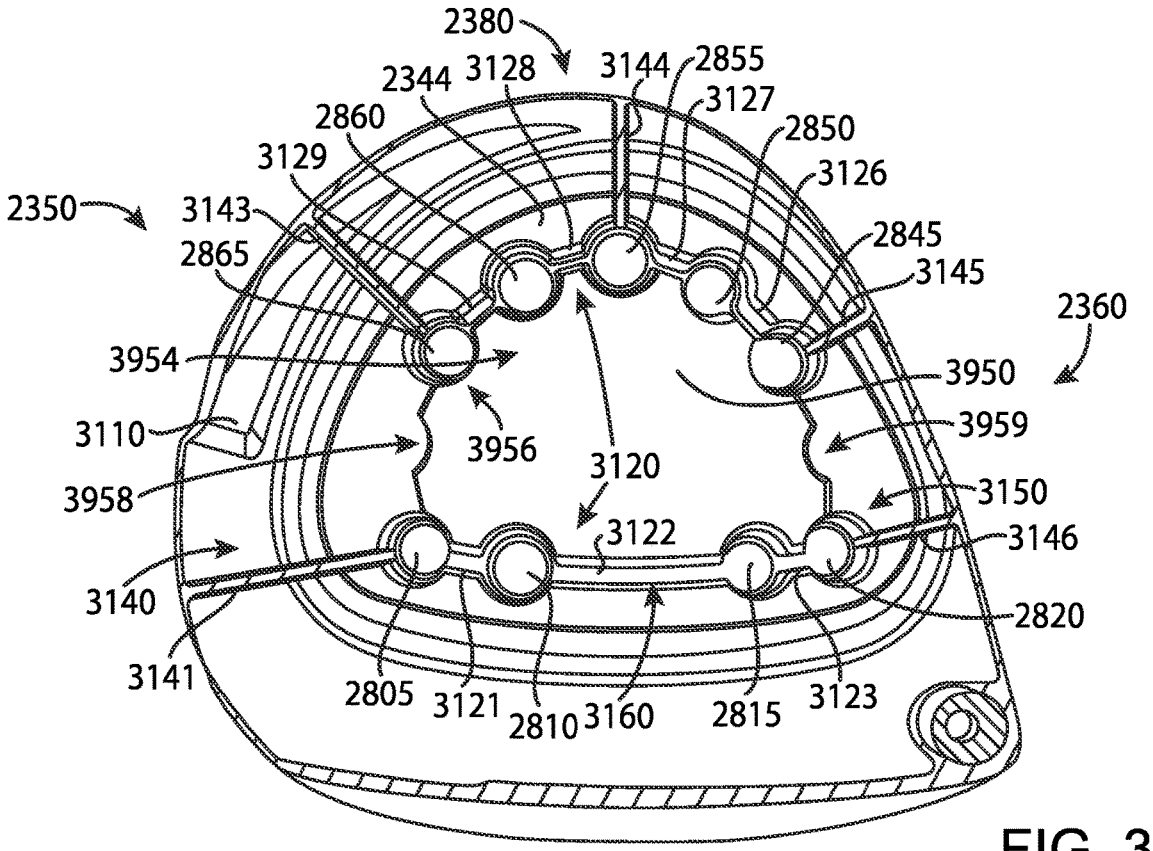

FIG. 39 depicts a cross-sectional view of an example golf club head of FIG. 23 taken at section line 31-31 of FIG. 29 according to an embodiment of the apparatus, methods, and articles of manufacture described herein.

Figure 40:
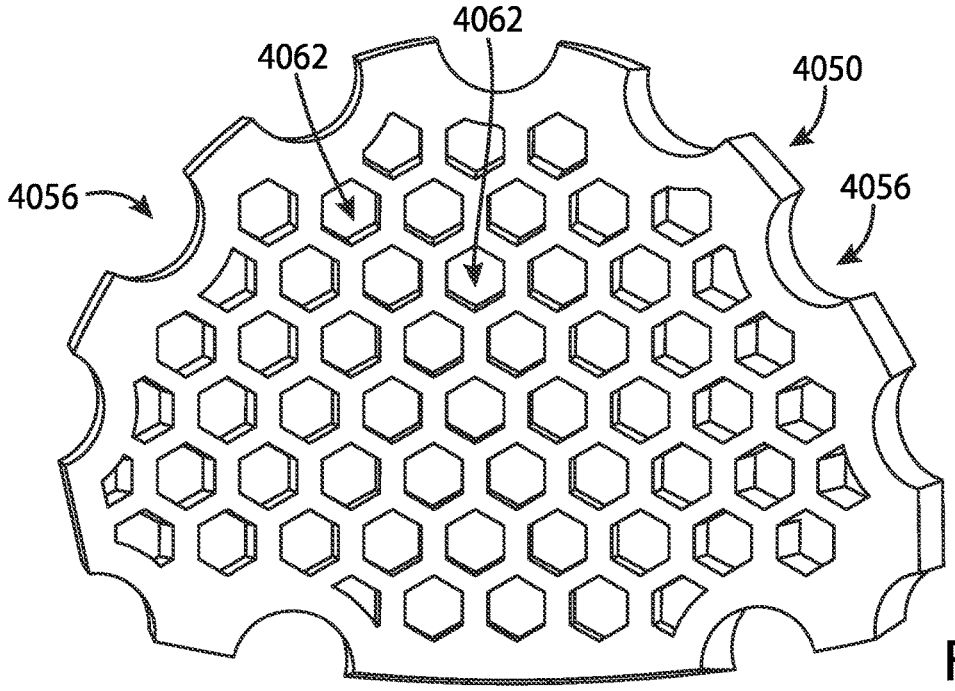

FIG. 40 depicts a perspective view of an elastic polymer insert according to an embodiment of the apparatus, methods, and articles of manufacture described herein.

Figure 41:
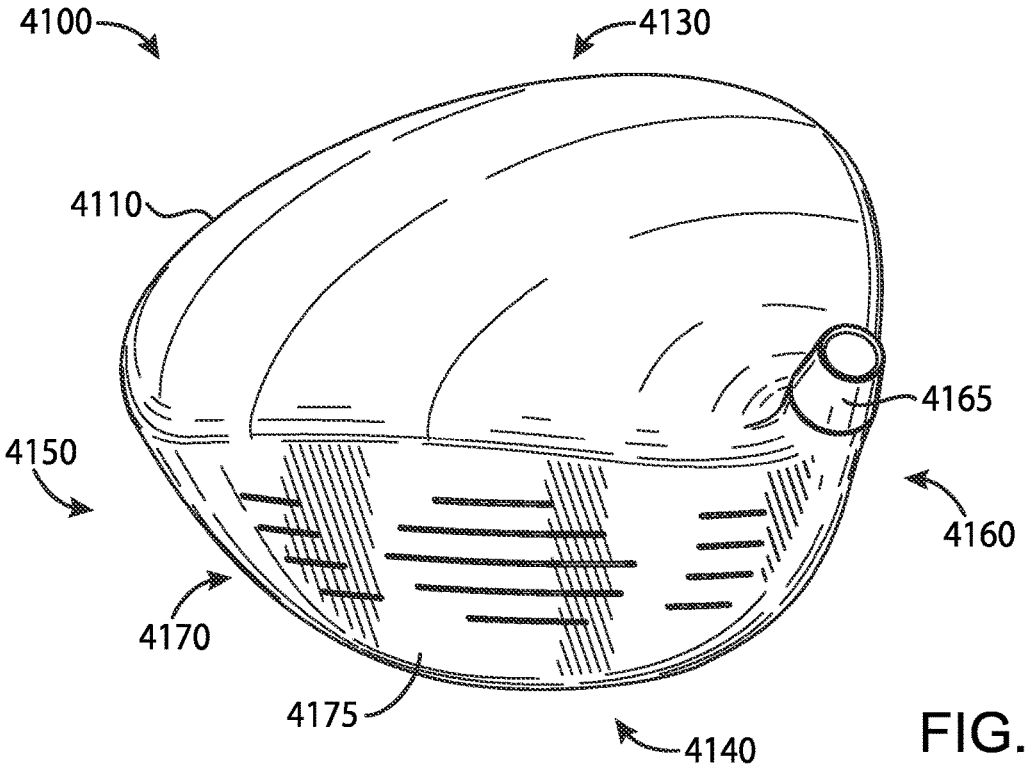

FIG. 41 is top perspective view of an example golf club head according to an embodiment of the apparatus, methods, and articles of manufacture described herein.

Figure 42:
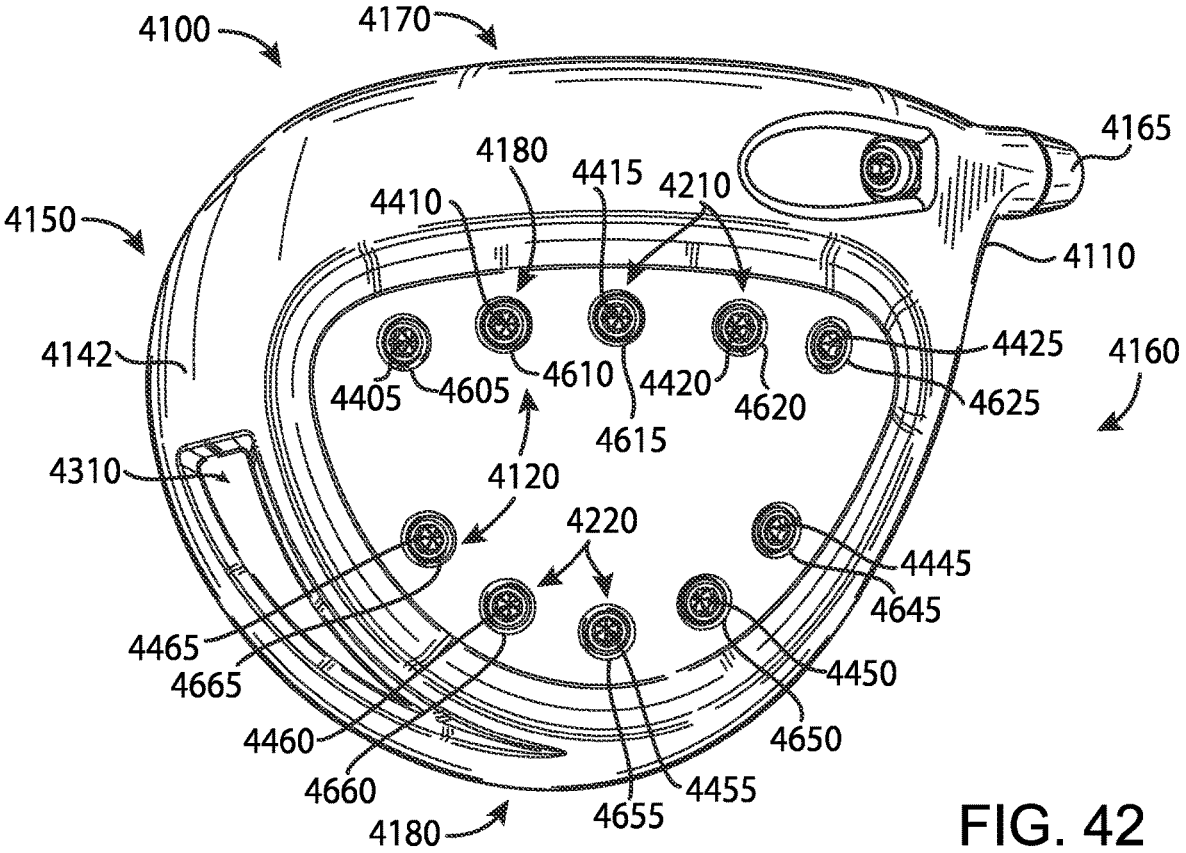

FIG. 42 depicts a bottom view of the example golf club head of FIG. 41.

Figure 43:
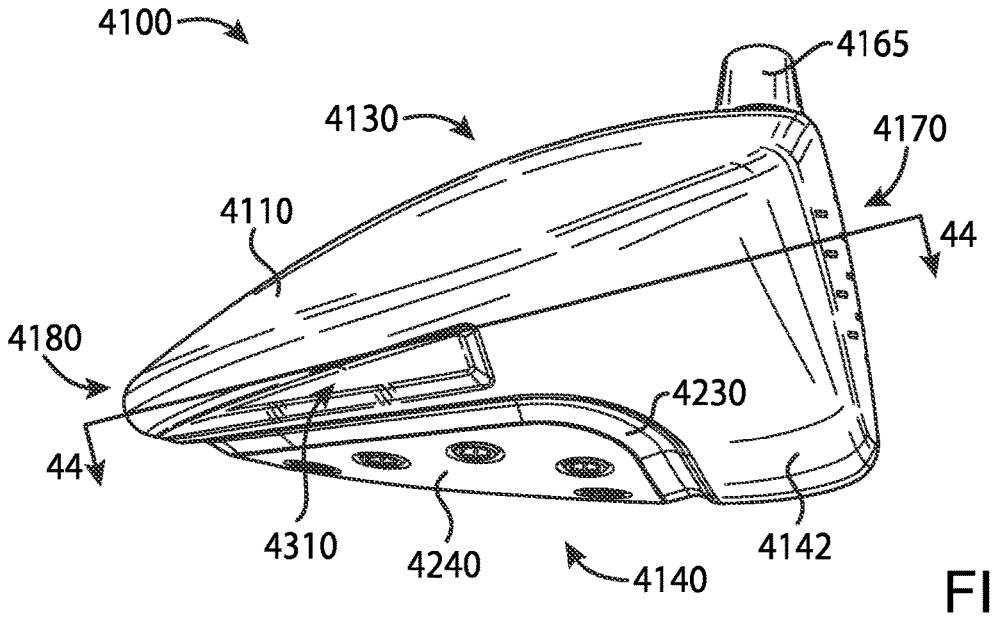

FIG. 43 depicts a toe view of the example golf club head of FIG. 41.

Figure 44:
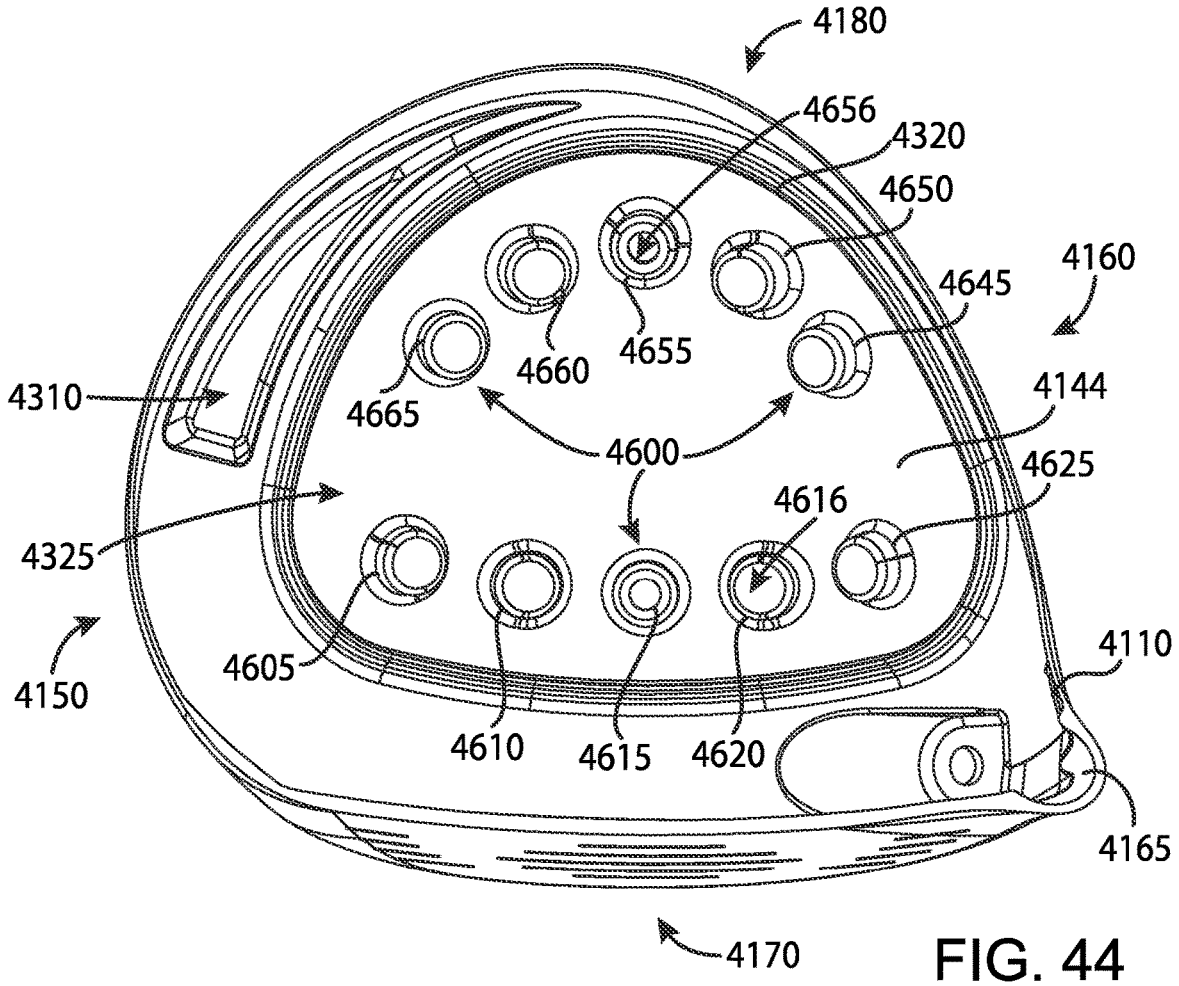

FIG. 44 depicts a top perspective cross-sectional view of the golf club head of FIG. 41 taken at section line 44-44 of FIG. 43.

Figure 45:
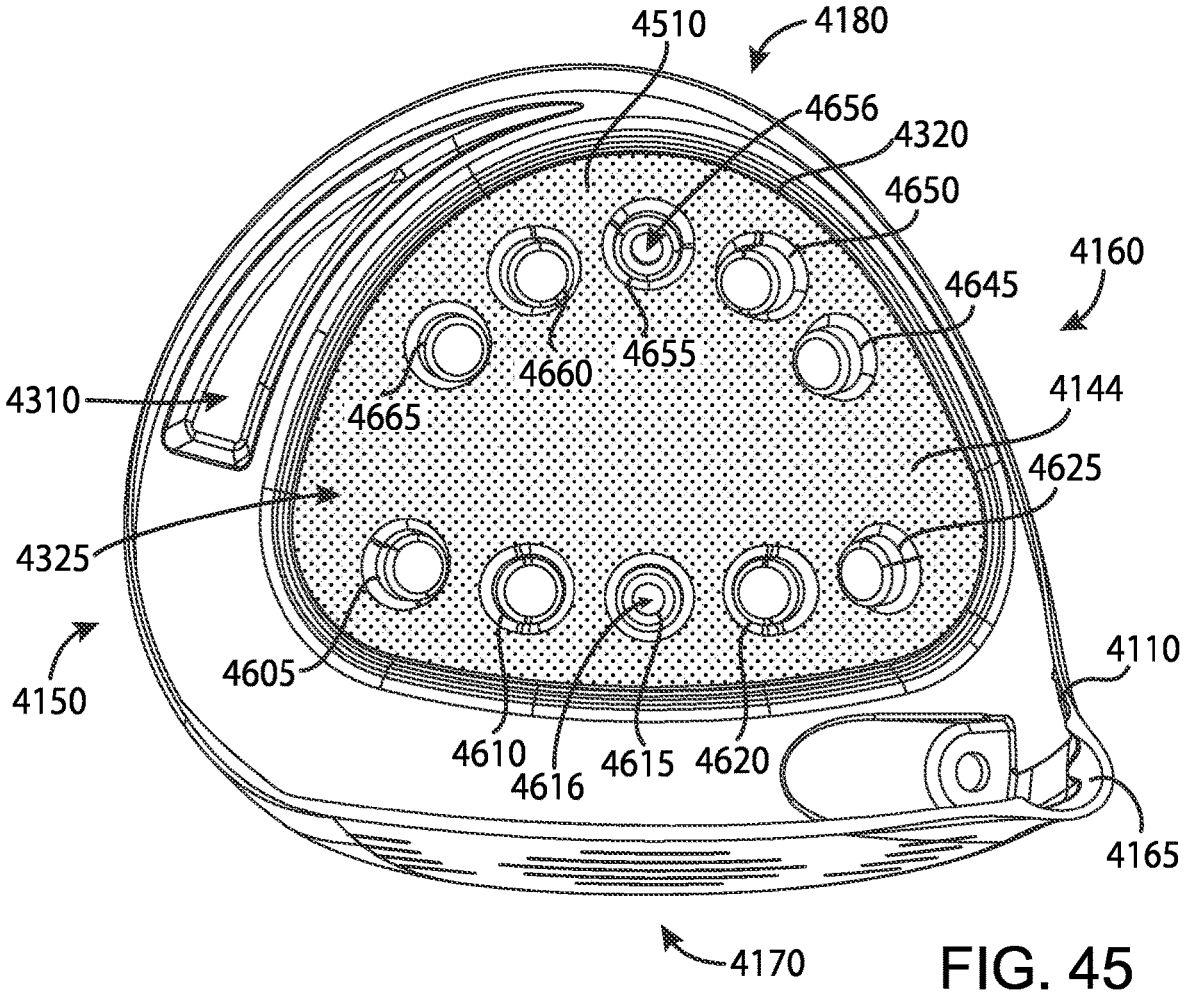

FIG. 45 depicts a top perspective cross-sectional view of an example of the golf club head of FIG. 41 taken at section line 44-44 of FIG. 43 according to an embodiment of the apparatus, methods, and articles of manufacture described herein.

Figure 46:
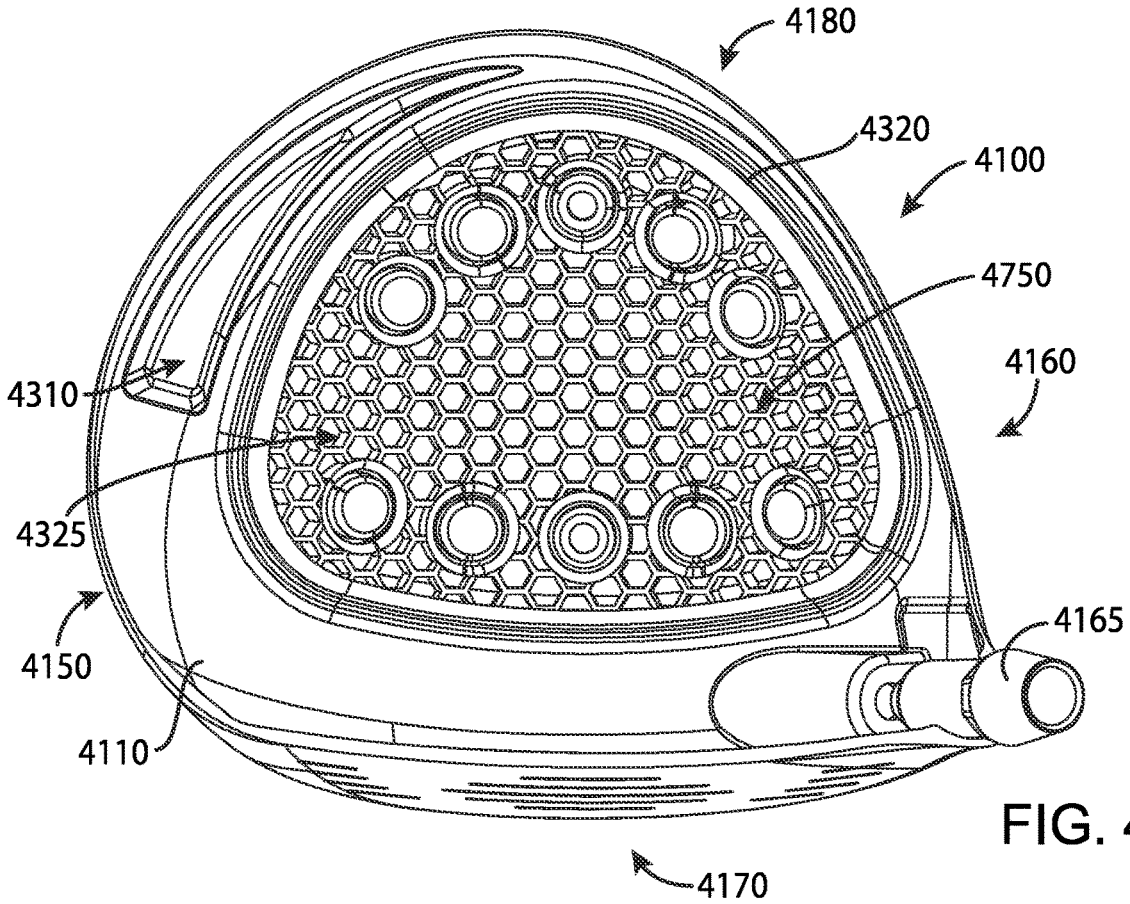

FIG. 46 depicts a top perspective cross-sectional view an example of the golf club head of FIG. 41 taken at section line 44-44 of FIG. 43 according to an embodiment of the apparatus, methods, and articles of manufacture described herein.

Figure 47:
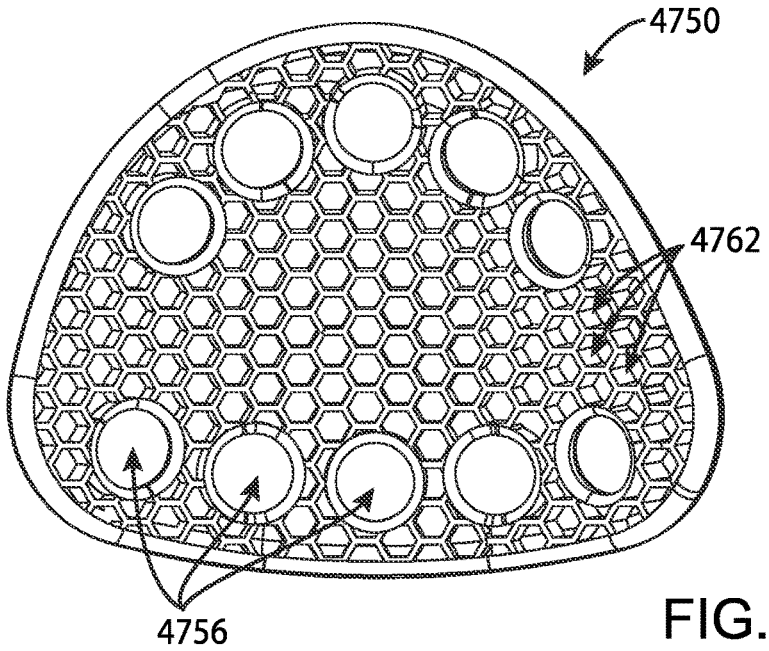

FIG. 47 depicts a perspective view of an elastic polymer insert according to an embodiment of the apparatus, methods, and articles of manufacture described herein.

Figure 48:
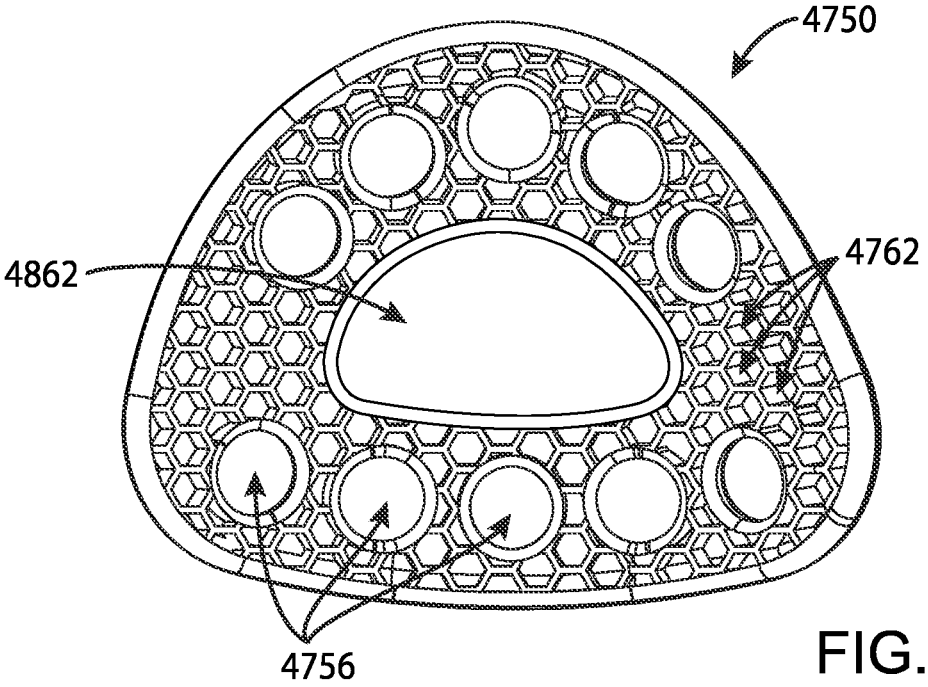

FIG. 48 depicts a perspective view of an elastic polymer insert according to an embodiment of the apparatus, methods, and articles of manufacture described herein.

Figure 49:
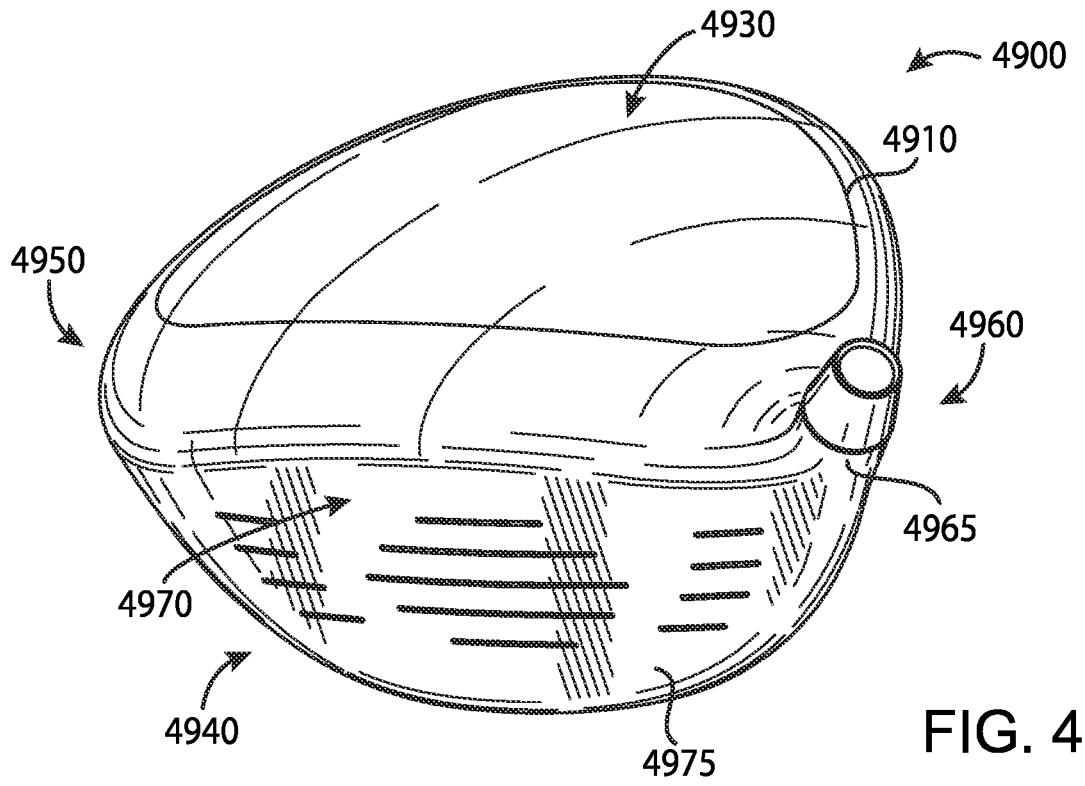

FIG. 49 is top perspective view of an example golf club head according to an embodiment of the apparatus, methods, and articles of manufacture described herein.

Figure 50:
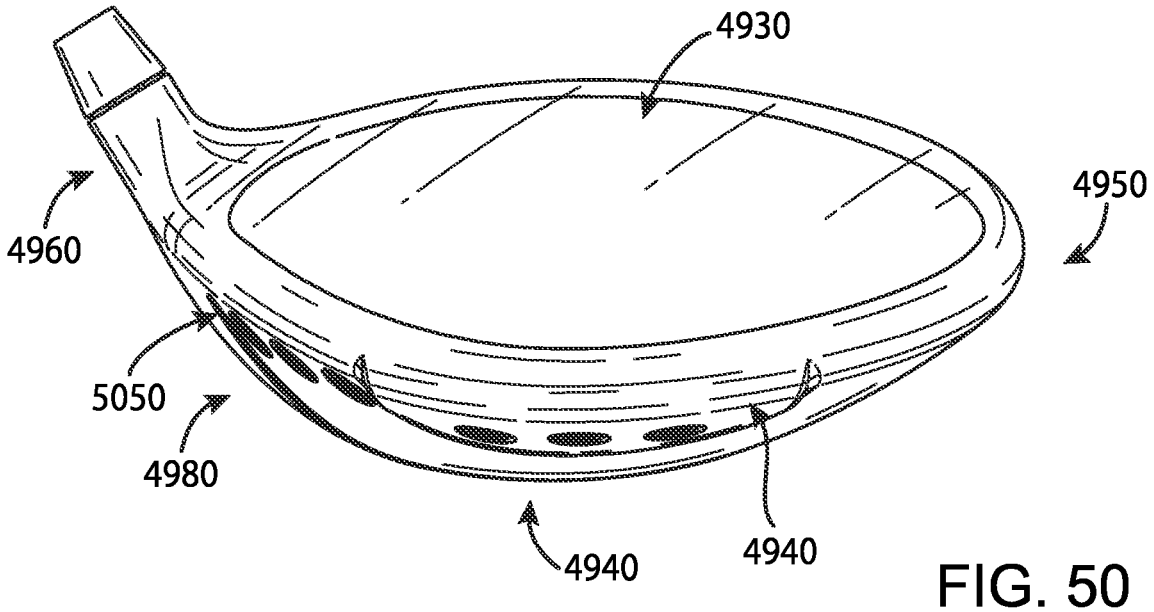

FIG. 50 depicts a rear perspective view of the example golf club head of FIG. 49.

Figure 51:
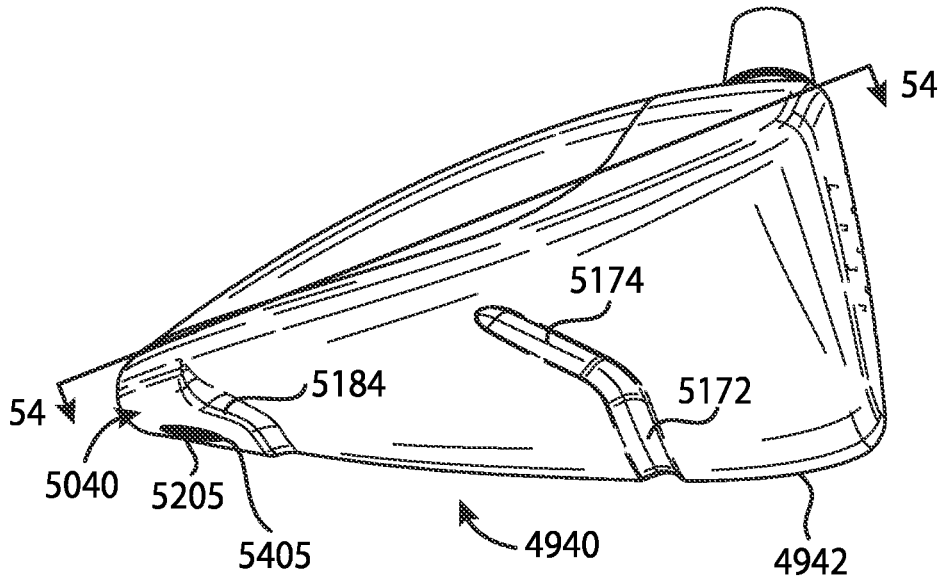

FIG. 51 depicts a toe perspective view of the example golf club head of FIG. 49.

Figure 52:
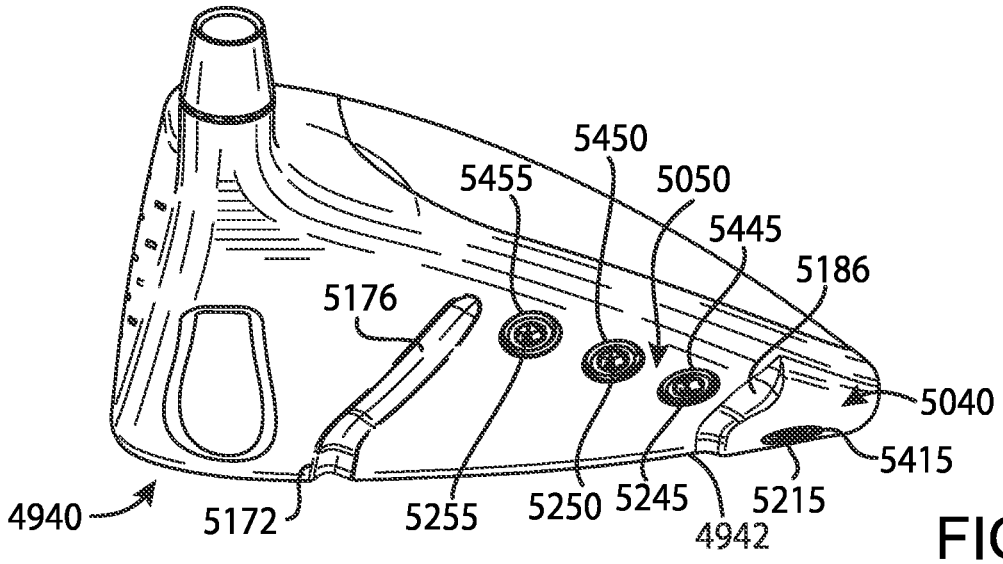

FIG. 52 depicts a heel perspective view of the example golf club head of FIG. 49.

Figure 53:
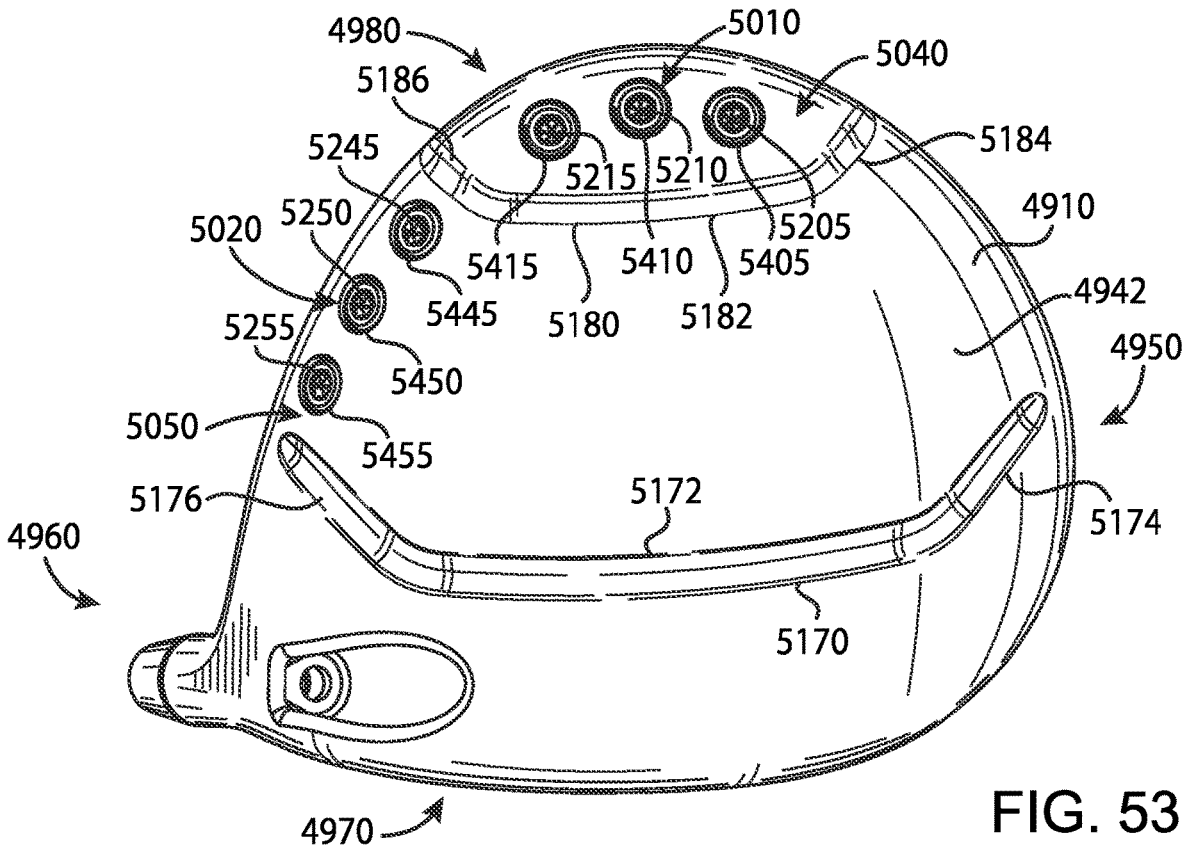

FIG. 53 depicts a bottom perspective view of the example golf club head of FIG. 49.

Figure 54:
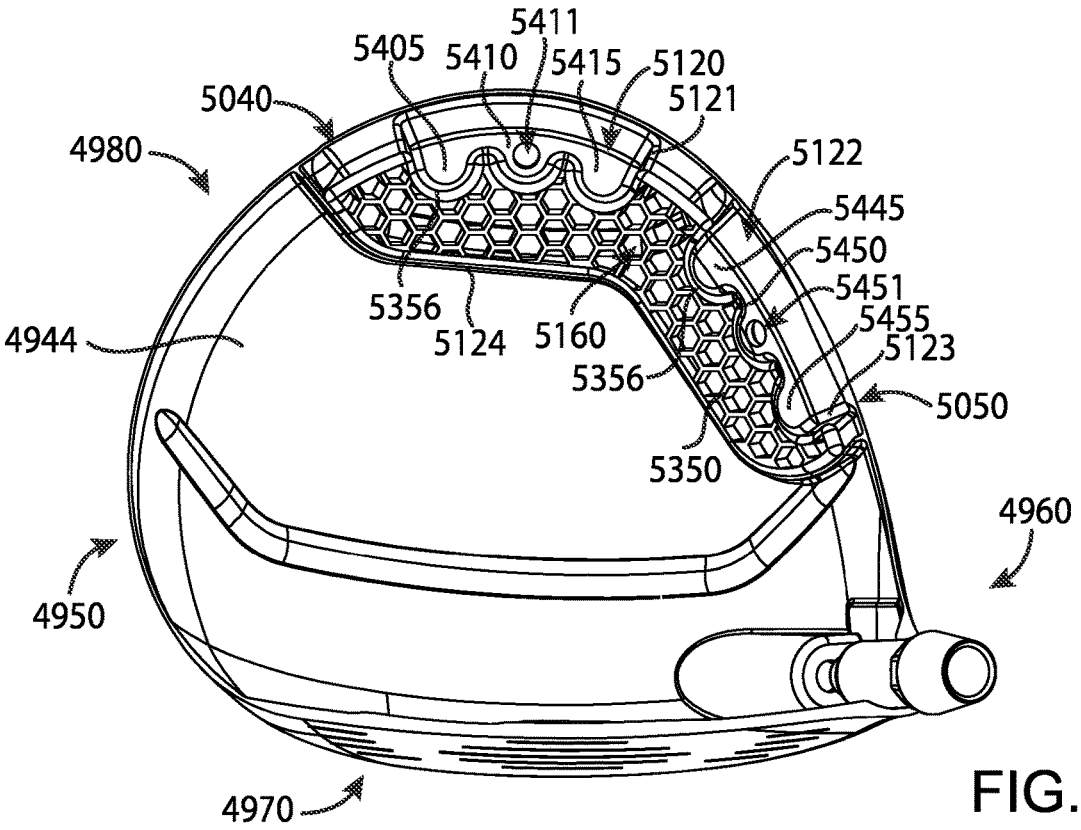

FIG. 54 depicts a cross-sectional view of the example golf club head of FIG. 48 taken at section line 54-54 of FIG. 51.

Figure 55:
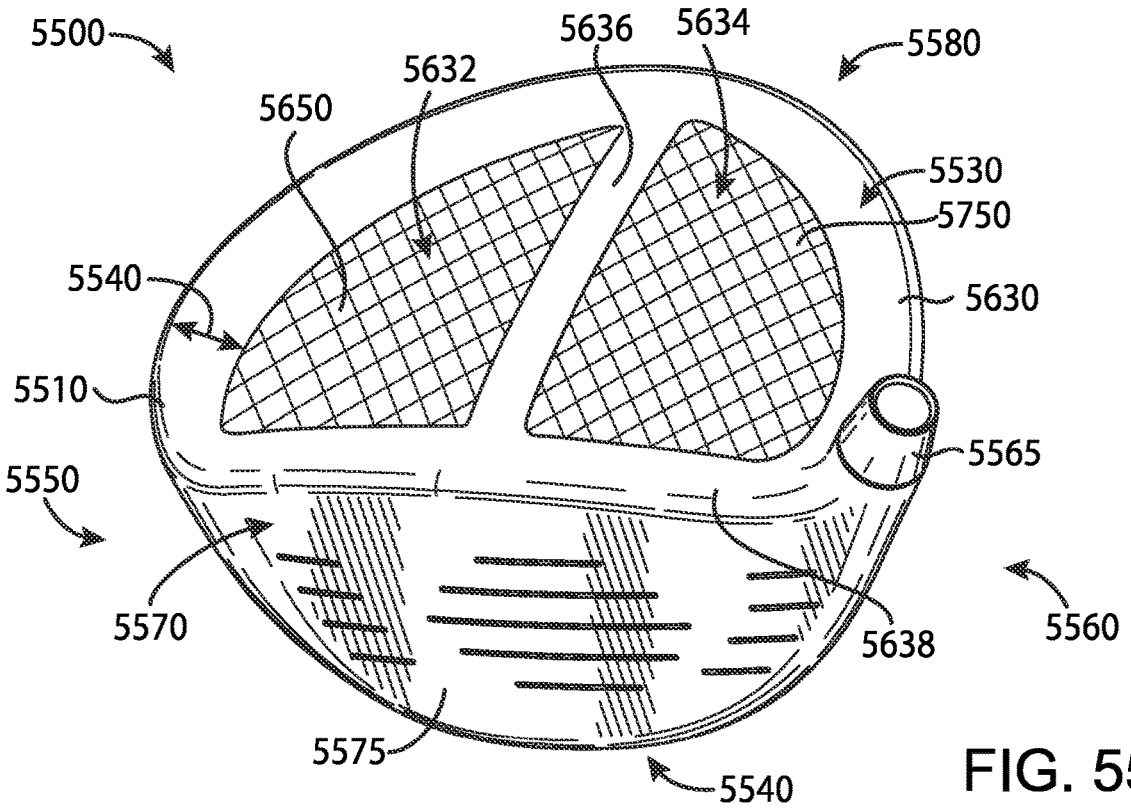

FIG. 55 is top perspective view of an example golf club head according to an embodiment of the apparatus, methods, and articles of manufacture described herein.

Figure 56:
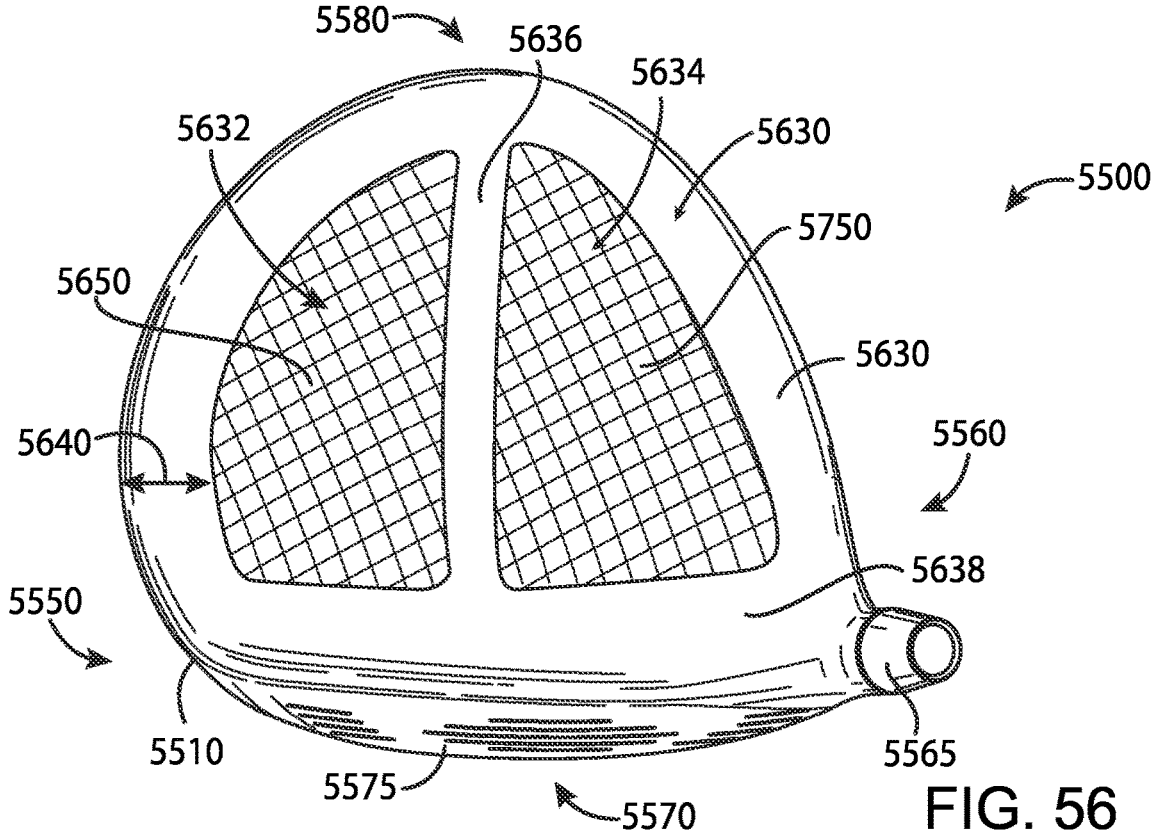

FIG. 56 depicts a top view of the example golf club head of FIG. 55.

Figure 57:
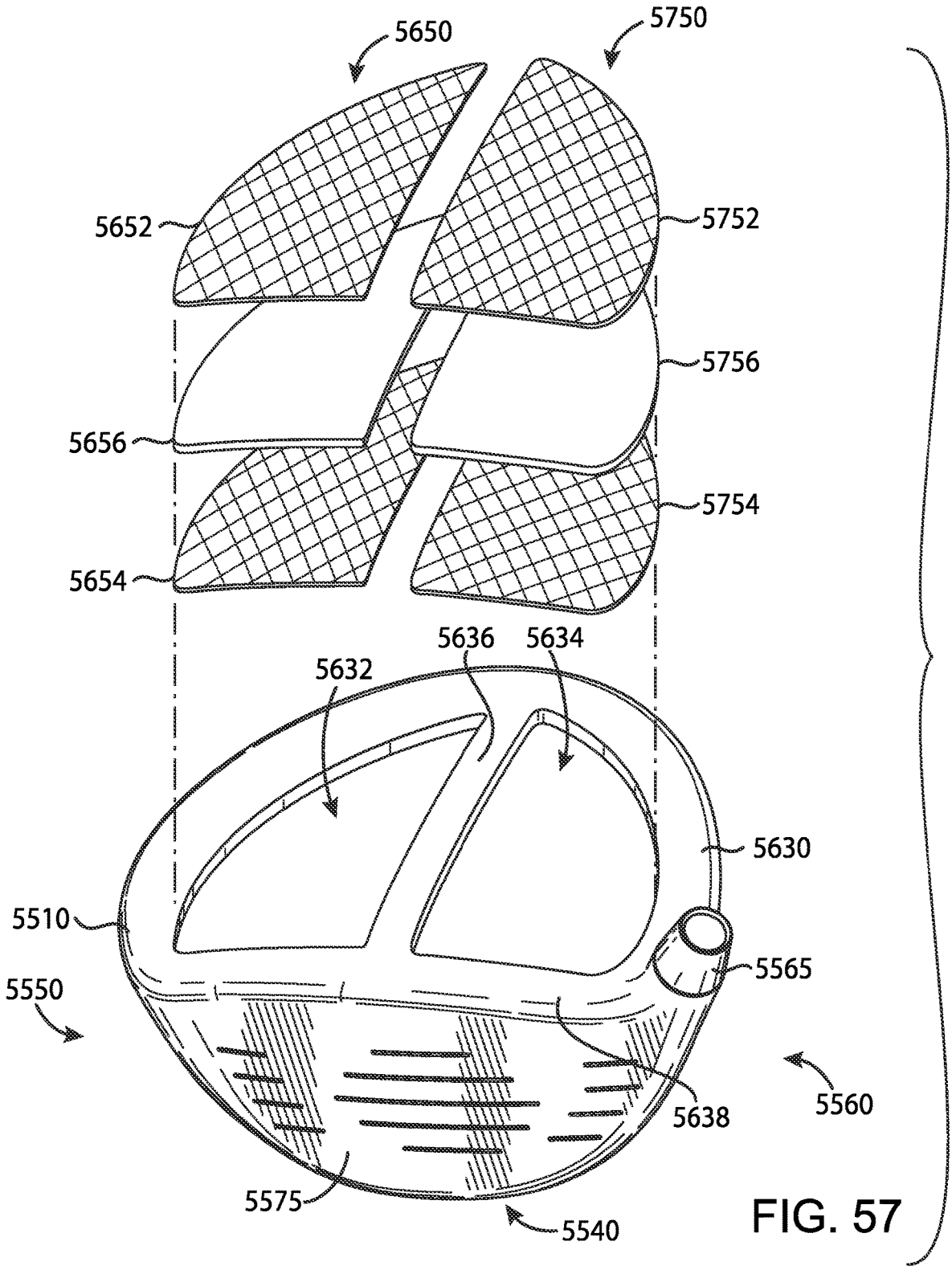

FIG. 57 depicts a perspective exploded view of the example golf club head of FIG. 55.

Figure 58:
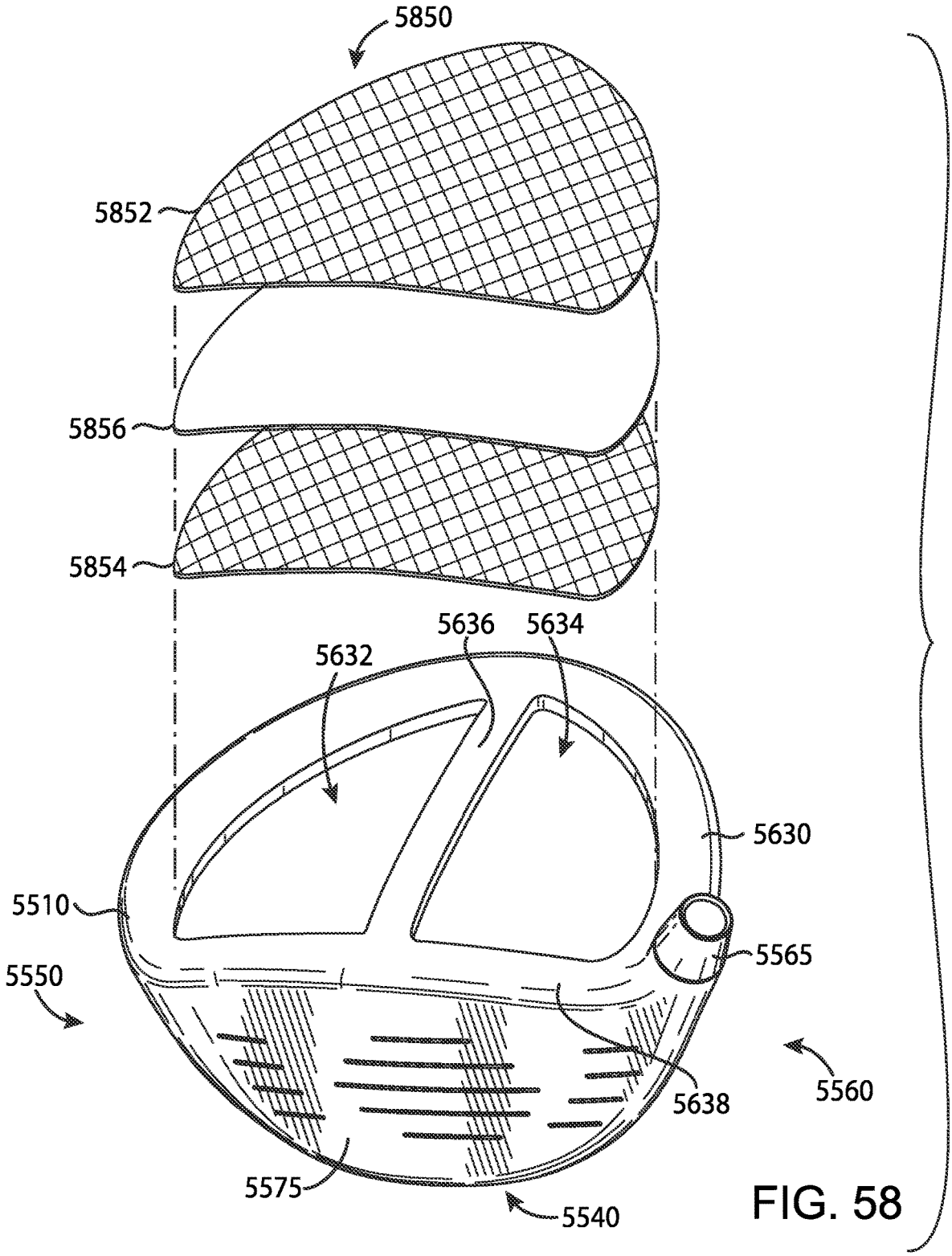

FIG. 58 depicts a perspective exploded view of another example golf club head of FIG. 55.

Figure 59:
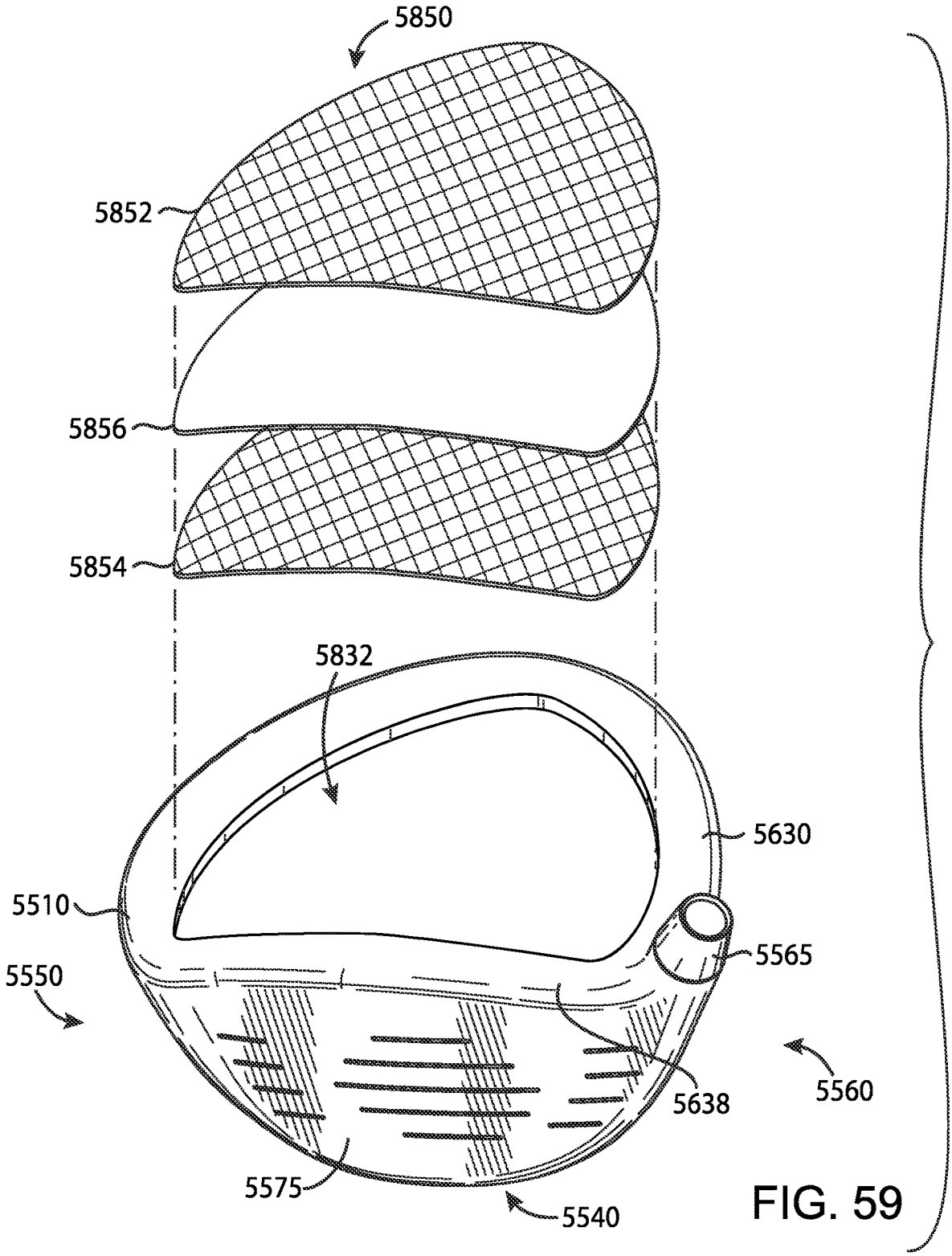

FIG. 59 depicts a perspective exploded view of another example golf club head of FIG. 55.

Figure 60:
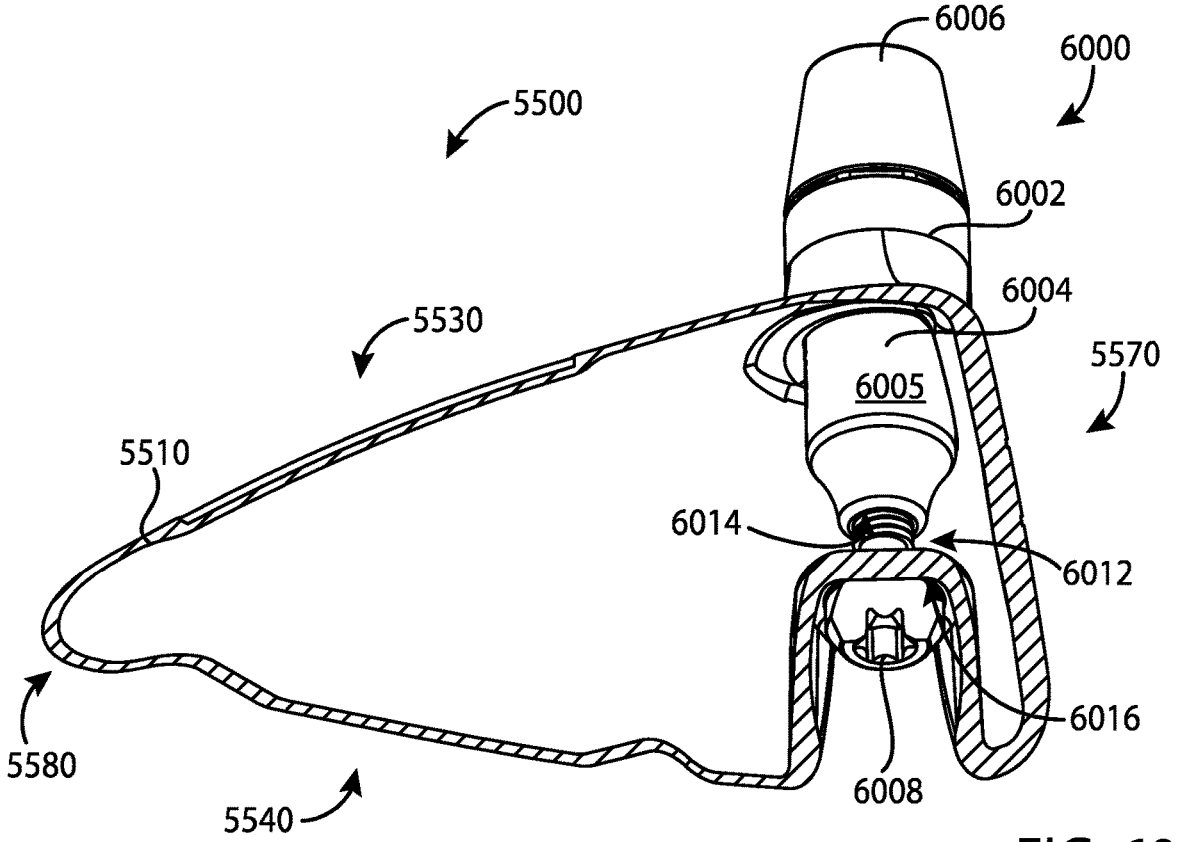

FIG. 60 depicts a side perspective cross-sectional view of an example golf club head according to an embodiment of the apparatus, methods, and articles of manufacture described herein.

Figure 61:
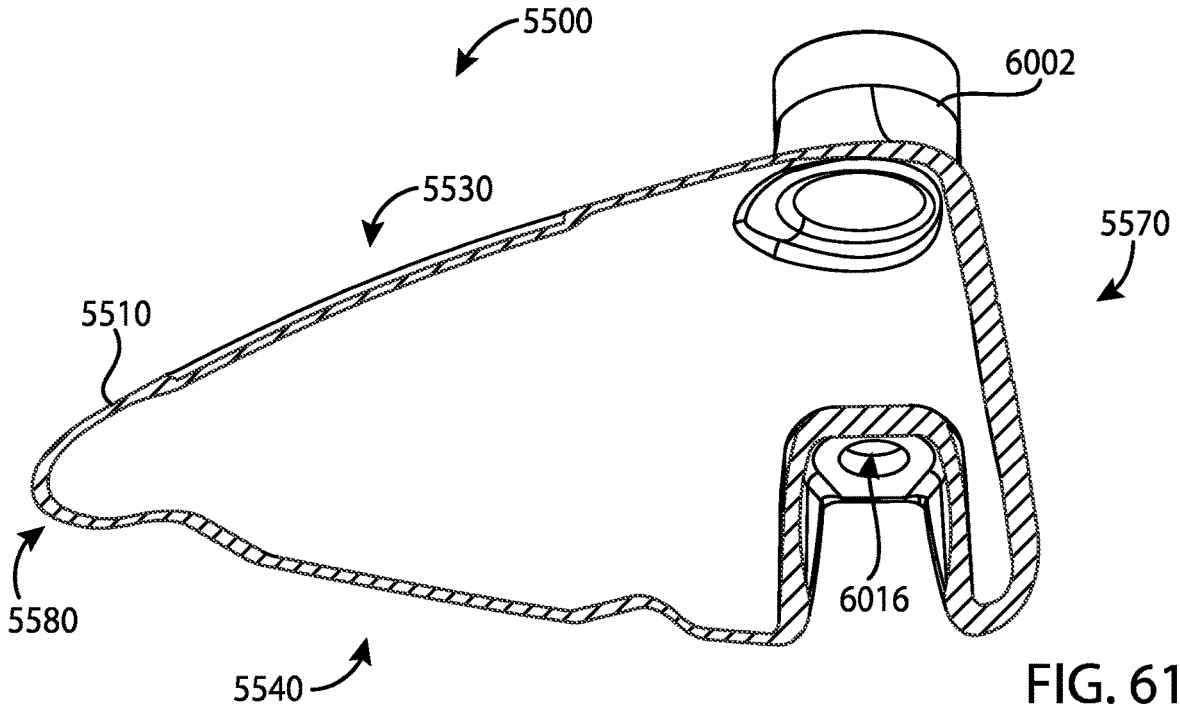

FIG. 61 depicts another side perspective cross-sectional view of the golf club head of FIG. 60.

For simplicity and clarity of illustration, the drawing figures illustrate the general manner of construction, and descriptions and details of well-known features and techniques may be omitted to avoid unnecessarily obscuring the present disclosure. Additionally, elements in the drawing figures are not necessarily drawn to scale. For example, the dimensions of some of the elements in the figures may be exaggerated relative to other elements to help improve understanding of embodiments of the present disclosure.

DESCRIPTION

Figure 1:
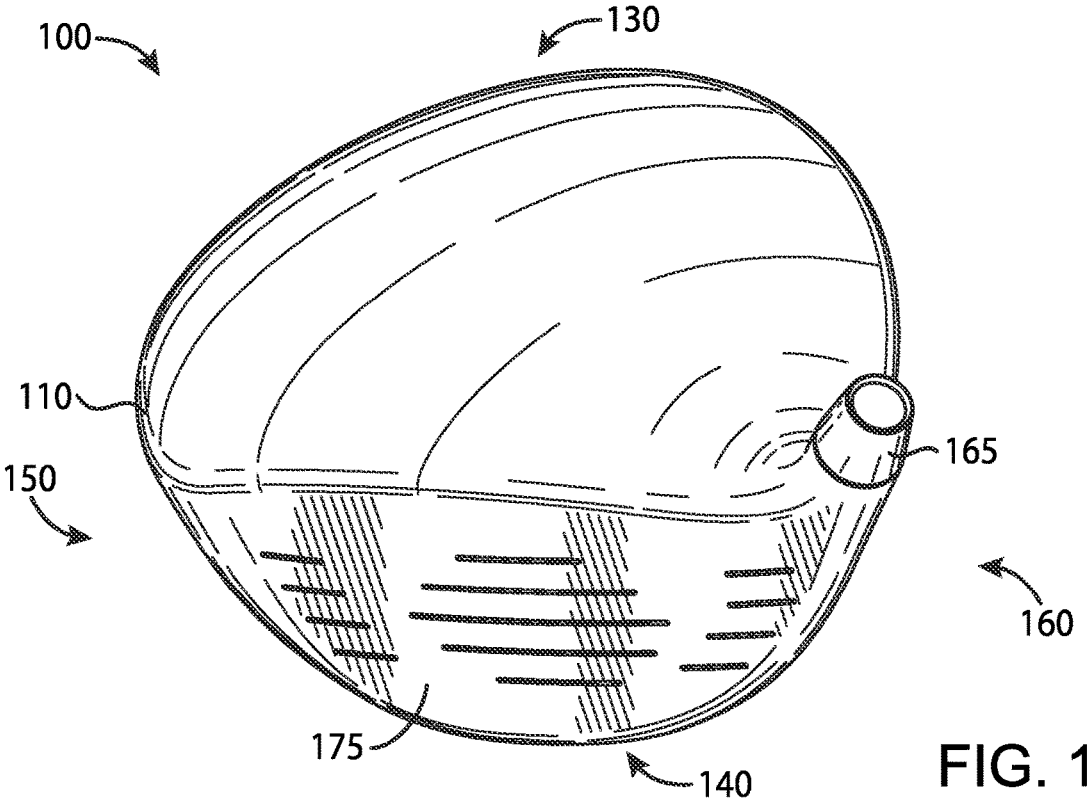
FIG. 1 is top perspective view of an example golf club head according to an embodiment of the apparatus, methods, and articles of manufacture described herein.
Figure 2:
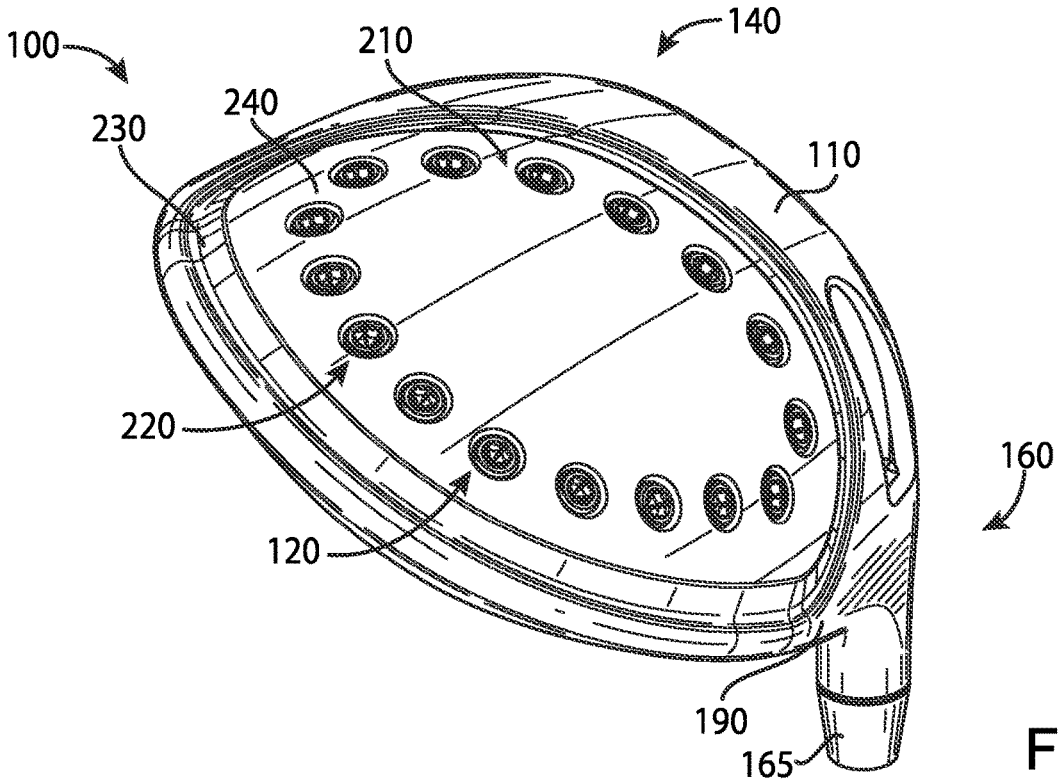
FIG. 2 depicts a bottom perspective view of the example golf club head of FIG. 1.
Figure 3:
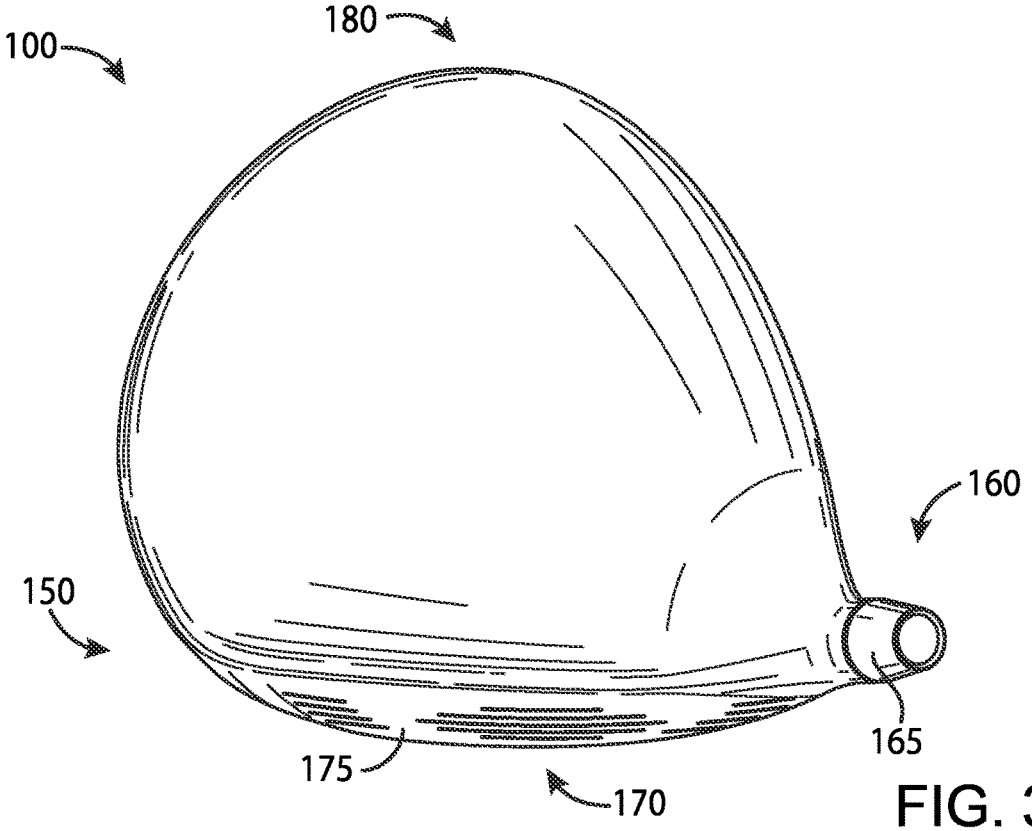
FIG. 3 depicts a top view of the example golf club head of FIG. 1.

In general, golf club heads and methods to manufacture golf club heads are described herein. The apparatus, methods, and articles of manufacture described herein are not limited in this regard. In the example of FIGS. 1-13, a golf club head 100 may include a body portion 110, and a plurality of weight portions 120, generally, shown as a first set of weight portions 210 (FIG. 2) and a second set of weight portions 220 (FIG. 2). The body portion 110 may include a top portion 130, a bottom portion 140, a toe portion 150, a heel portion 160, a front portion 170, and a rear portion 180. The bottom portion 140 may include a skirt portion 190 defined as a side portion of the golf club head 100 between the top portion 130 and the bottom portion 140 excluding the front portion 170 and extending across a periphery of the golf club head 100 from the toe portion 150, around the rear portion 180, and to the heel portion 160. The bottom portion 140 may include a transition region 230 and a weight port region 240. For example, the weight port region 240 may be a D-shape region. The weight port region 240 may include a plurality of weight ports 900 (FIG. 9) to receive the plurality of weight portions 120. The front portion 170 may include a face portion 175 to engage a golf ball (not shown). The body portion 110 may also include a hosel portion 165 to receive a shaft (not shown). Alternatively, the body portion 110 may include a bore instead of the hosel portion 165. For example, the body portion 110 may be made partially or entirely of an aluminum-based material, a magnesium-type material, a steel-based material, a titanium-based material, any combination thereof, or any other suitable material. In another example the body portion 110 may be made partially or entirely of a non-metal material such as a ceramic material, a composite material, any combination thereof, or any other suitable material.

The golf club head 100 may have a club head volume greater than or equal to 300 cubic centimeters (cm 3 or cc). In one example, the golf club head 100 may be about 460 cc. Alternatively, the golf club head 100 may have a club head volume less than or equal to 300 cc. In particular, the golf club head 100 may have a club head volume between 100 cc and 200 cc. The club head volume of the golf club head 100 may be determined by using the weighted water displacement method (i.e., Archimedes Principle). For example, procedures defined by golf standard organizations and/or governing bodies such as the United States Golf Association (USGA) and/or the Royal and Ancient Golf Club of St.

Andrews (R&A) may be used for measuring the club head volume of the golf club head 100. Although FIG. 1 may depict a particular type of club head (e.g., a driver-type club head), the apparatus, methods, and articles of manufacture described herein may be applicable to other types of club head (e.g., a fairway wood-type club head, a hybrid-type club head, an iron-type club head, a putter-type club head, etc.). The apparatus, methods, and articles of manufacture described herein are not limited in this regard.

Each of the first set of weight portions 210, generally shown as 405, 410, 415, 420, 425, 430, and 435 (FIG. 4), may be associated with a first mass. Each of the second set of weight portions 220, generally shown as 440, 445, 450, 455, 460, 465, 470, 475, and 480 (FIG. 4), may be associated with a second mass. The first mass may be greater than the second mass or vice versa. In one example, the first set of weight portions 210 may be made of a tungsten-based material whereas the second set of weight portions 220 may be made of an aluminum-based material. As described in detail below, the first and second set of weight portions 210 and 220, respectively, may provide various weight configurations (e.g., FIGS. 15-18).

Figure 9:
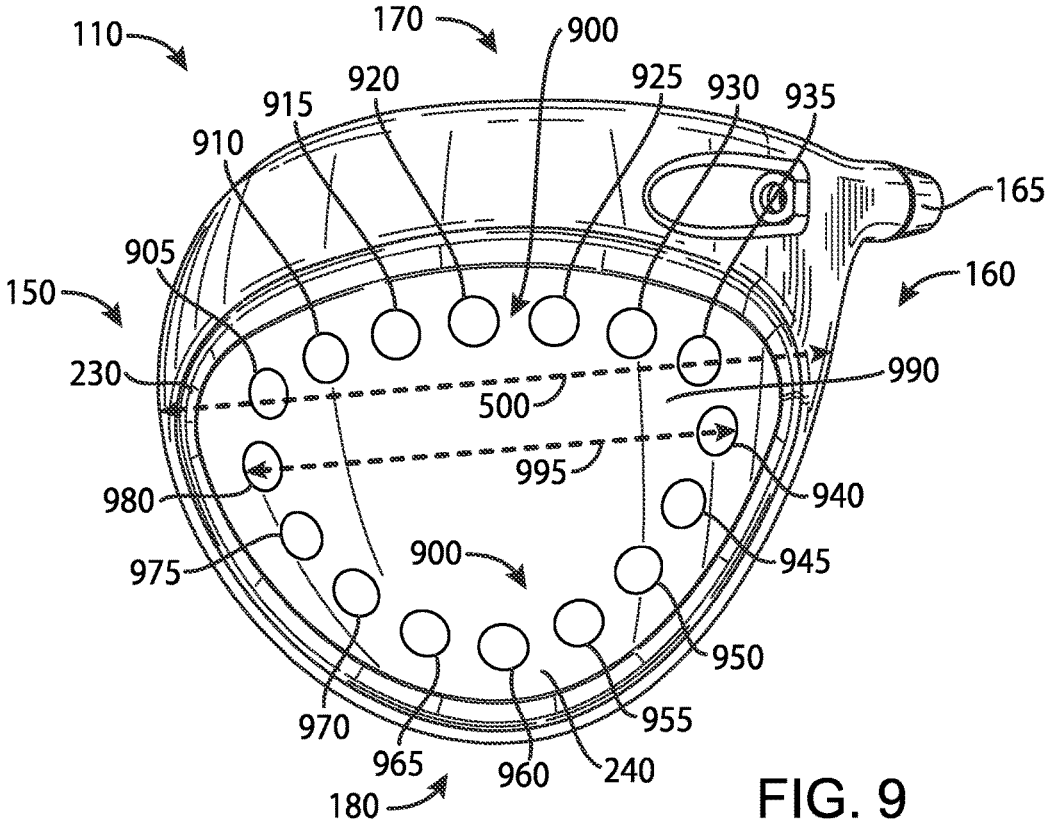
FIG. 9 depicts a bottom view of an example body portion of the example golf club head of FIG. 1.
Figure 10:
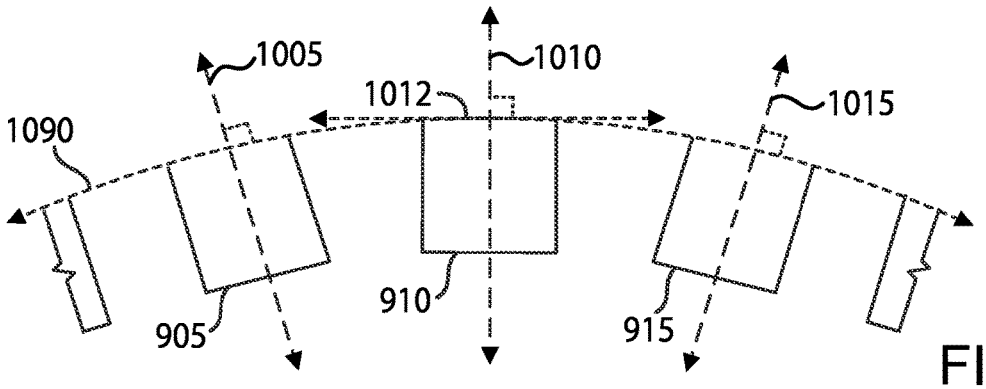
FIG. 10 depicts a cross-sectional view of the example body portion of the example golf club head of FIG. 1.
Figure 11:
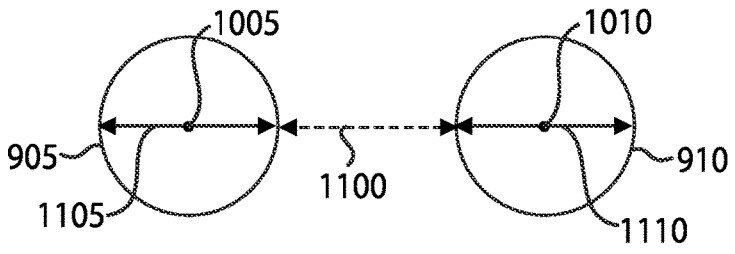
FIG. 11 depicts two weight ports of the example golf club head of FIG. 1.

Referring to FIGS. 9-11, for example, the bottom portion 140 of the body portion 110 may include a plurality of weight ports 900. The plurality of weight ports 900, generally shown as 905, 910, 915, 920, 925, 930, 935, 940, 945, 950, 955, 960, 965, 970, 975, and 980, may be located along a periphery of the weight port region 240 of the bottom portion 140. The plurality of weight ports 900 may extend across the bottom portion 140. In particular, the plurality of weight ports 900 may extend between the toe and heel portions 150 and 160, respectively, across the bottom portion 140. The plurality of weight ports 900 may also extend between the front and rear portions 170 and 180, respectively, across the bottom portion 140. The plurality of weight ports 900 may be arranged across the bottom portion 140 along a path that defines a generally D-shaped loop. In one example, the plurality of weight ports 900 may extend more than 50% of a maximum toe-to-heel distance 500 between of the toe and heel portions 150 and 160, respectively, across the bottom portion 140. The maximum toe-to-heel distance 500 of the golf club head 100 may be measured from transition regions between the top and bottom portions 130 and 140, respectively, at the toe and heel portions 150 and 160, respectively. Alternatively, the maximum toe-to-heel distance 500 may be a horizontal distance between vertical projections of the outermost points of the toe and heel portions 150 and 160, respectively. For example, the maximum toe-to-heel distance 500 may be measured when the golf club head 100 is at a lie angle 510 of about 60 degrees. If the outermost point of the heel portion 160 is not readily defined, the outermost point of the heel portion 160 may be located at a height 520 of about 0.875 inches (22.23 millimeters) above a ground plane 530 (i.e., a horizontal plane on which the golf club head 100 is lying on). The plurality of weight ports 900 may extend more than 50% of a maximum toe-to-heel club head distance 500 of the golf club head 100. In particular, the plurality of weight ports 900 may extend between the toe portion 150 and the heel portion 160 at a maximum toe-to-heel weight port distance 995, which may be more than 50% of the maximum toe-to-heel club head distance 500 of the golf club head 100. In one example, the maximum toe-to-heel club head distance 500 of the golf club head 100 may be no more than 5 inches (127 millimeters). Accordingly, the plurality of weight ports 900 may extend a weight port maximum toe-to-heel weight port distance of at least 2.5 inches between the toe and heel portions 150 and 160, respectively. A maximum toe-to-heel weight port distance 995 may be the maximum distance between the heel-side boundary of the weight port farthest from the toe portion 150 and the toe-side boundary of the weight port farthest from the heel portion 160. In the example of FIG. 9, the weight port maximum toe-to-heel weight port distance 995 may be the maximum distance between the heel-side boundary of the weight port 940 and toe-side boundary of the weight port 980. For example, the maximum toe-to-heel weight port distance 995 may be about 3.7 inches. As the rules of golf may change from time to time (e.g., new regulations may be adopted or old rules may be eliminated or modified by golf standard organizations and/or governing bodies), the lie angle 510 and/or the height 520 for measuring the maximum toe-to-heel club head distance 500 may also change. The apparatus, methods, and articles of manufacture described herein are not limited in this regard.

Each of the plurality of weight ports 900 may be associated with a port diameter ($D_{port}$) (e.g., two shown as 1105 and 1110 in FIG. 11). For example, the port diameter of each weight port of the plurality of weight ports 900 may be about 0.3 inch (7.65 millimeters). Alternatively, the port diameters of adjacent weight ports may be different. In one example, the weight port 905 may be associated with a port diameter 1105, and the weight port 910 may be associated with a port diameter 1110. In particular, the port diameter 1105 of the weight port 905 may be larger than the port diameter 1110 of the weight port 910 or vice versa. The apparatus, methods, and articles of manufacture described herein are not limited in this regard.

The bottom portion 140 may also include an outer surface 990. As illustrated in FIG. 10, for example, the plurality of weight ports 900 may be formed on the bottom portion 140 relative to an outer surface curve 1090 formed by the outer surface 990. In particular, each of the plurality of weight ports 900 may be associated with a port axis generally shown as 1005, 1010, and 1015. A center of a weight port may define the port axis of the weight port. Each port axis may be perpendicular or substantially perpendicular to a plane that is tangent to the outer surface curve 1090 at the point of intersection of the port axis and the outer surface curve 1090. In one example, substantially perpendicular may refer to a deviation of ±5° from perpendicular. In another example, substantially perpendicular may refer to a deviation of ±3° from perpendicular. The deviation from perpendicular may depend on manufacturing tolerances.

In one example, the port axis 1010 may be perpendicular or substantially perpendicular (i.e., normal) to a tangent plane 1012 of the outer surface curve 1090. Multiple fixtures may be used to manufacture the plurality of weight ports 900 by positioning the golf club head 100 in various positions. Alternatively, the weight ports may be manufactured by multiple-axis machining processes, which may be able to rotate the golf club head around multiple axes to mill away excess material (e.g., by water jet cutting and/or laser cutting) to form the plurality of weight ports 900. Further, multiple-axis machining processes may provide a suitable surface finish because the milling tool may be moved tangentially about a surface. Accordingly, the apparatus, methods, and articles of manufacture described herein may use a multiple-axis machining process to form each of the plurality of weight ports 900 on the bottom portion 140. For example, a five-axis milling machine may form the plurality of weight ports 900 so that the port axis 1000 of each of the plurality weight ports 900 may be perpendicular or substantially perpendicular to the outer surface curve 1090. The tool of the five-axis milling machine may be moved tangentially about the outer surface curve 1090 of the outer surface 990.

Turning to FIG. 11, for example, two adjacent weight ports may be separated by a port distance 1100, which may be the shortest distance between two adjacent weight ports on the outer surface 990. In particular, the port distance 1100 may be less than or equal to the port diameter of any of the two adjacent weight ports. In one example, the port distance 1100 between the weight ports 905 and 910 may be less than or equal to either the port diameter 1105 or the port diameter 1110. The apparatus, methods, and articles of manufacture described herein are not limited in this regard.

The plurality of weight portions 120 may have similar or different physical properties (e.g., density, shape, mass, volume, size, color, etc.). In one example, the first set of weight portions 210 may be a black color whereas the second set of weight portions 220 may be a gray color or a steel color. Some or all of the plurality of weight portions 120 may be partially or entirely made of a metal material such as a steel-based material, a tungsten-based material, an aluminum-based material, any combination thereof or suitable types of materials. Alternatively, some or all of the plurality of weight portions 120 may be partially or entirely made of a non-metal material (e.g., composite, plastic, etc.).

Figure 12:
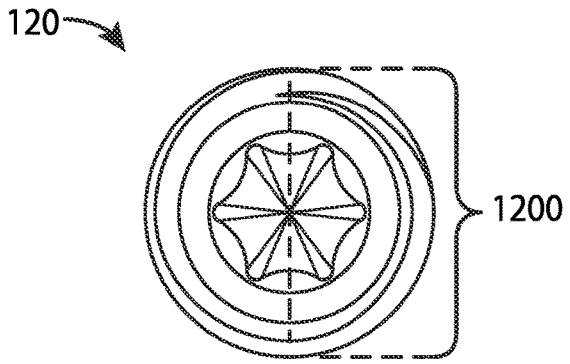
FIG. 12 depicts a top view of an example weight portion of the example golf club head of FIG. 1.
Figure 13:
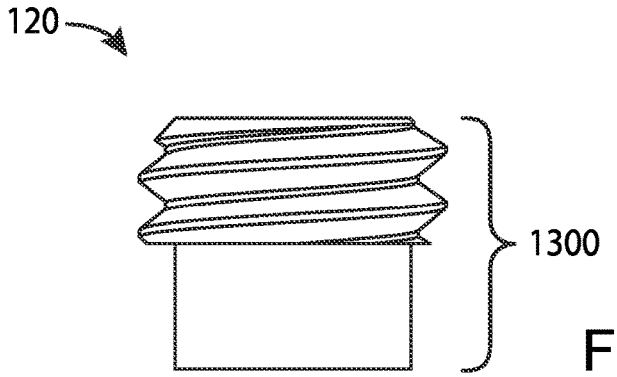
FIG. 13 depicts a side view of the example weight portion of FIG. 10.

In the illustrated example as shown in FIGS. 12 and 13, each weight portion of the plurality of weight portions 120 may have a cylindrical shape (e.g., a circular cross section). Although the above examples may describe weight portions having a particular shape, the apparatus, methods, and articles of manufacture described herein may include weight portions of other suitable shapes (e.g., a portion of or a whole sphere, cube, cone, cylinder, pyramid, cuboidal, prism, frustum, or other suitable geometric shape). Each weight portion of the plurality of weight portions 120 may be associated with a diameter 1200 and a height 1300. In one example, each weight portion of the plurality of weight portions 120 may have a diameter of about 0.3 inch (7.62 millimeters) and a height of about 0.2 inch (5.08 millimeters). Alternatively, the first and second sets of weight portions 210 and 220, respectively, may be different in width and/or height.

Instead of a rear-to-front direction as in other golf club heads, each weight portion of the plurality of weight portions 120 may engage one of the plurality of weight ports 400 in a bottom-to-top direction. The plurality of weight portions 120 may include threads to secure in the weight ports. For example, each weight portion of the plurality of weight portions 120 may be a screw. The plurality of weight portions 120 may not be readily removable from the body portion 110 with or without a tool. Alternatively, the plurality of weight portions 120 may be readily removable (e.g., with a tool) so that a relatively heavier or lighter weight portion may replace one or more of the plurality of weight portions 120. In another example, the plurality of weight portions 120 may be secured in the weight ports of the body portion 110 with epoxy or adhesive so that the plurality of weight portions 120 may not be readily removable. In yet another example, the plurality of weight portions 120 may be secured in the weight ports of the body portion 110 with both epoxy and threads so that the plurality of weight portions 120 may not be readily removable. The apparatus, methods, and articles of manufacture described herein are not limited in this regard.

Figure 14:
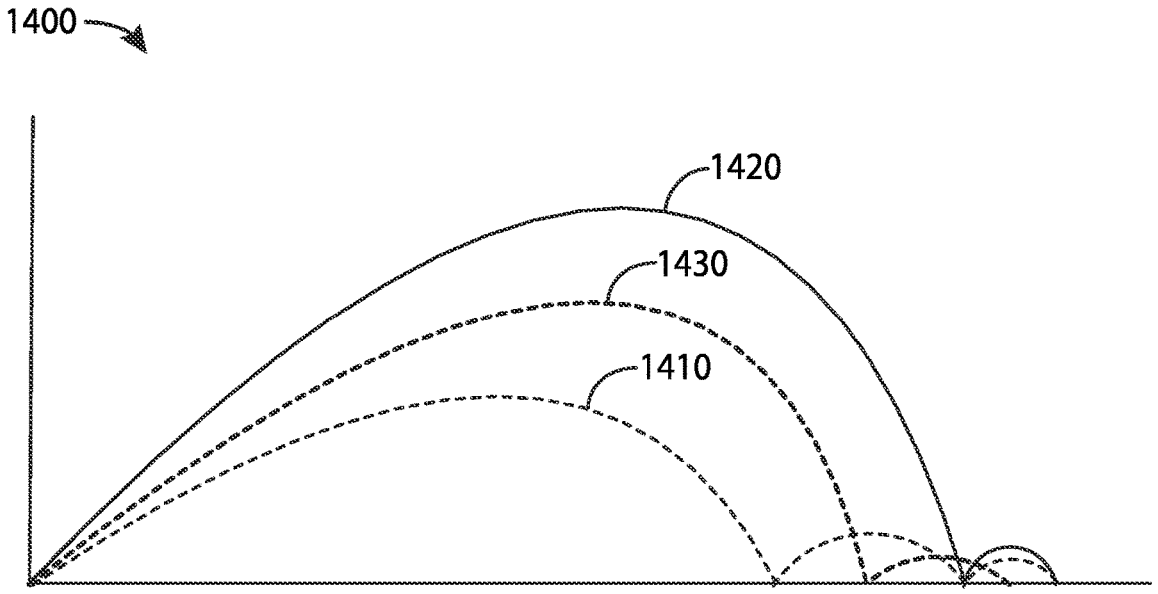
FIG. 14 depicts example launch trajectory profiles of the example golf club head of FIG. 1.
Figure 15:
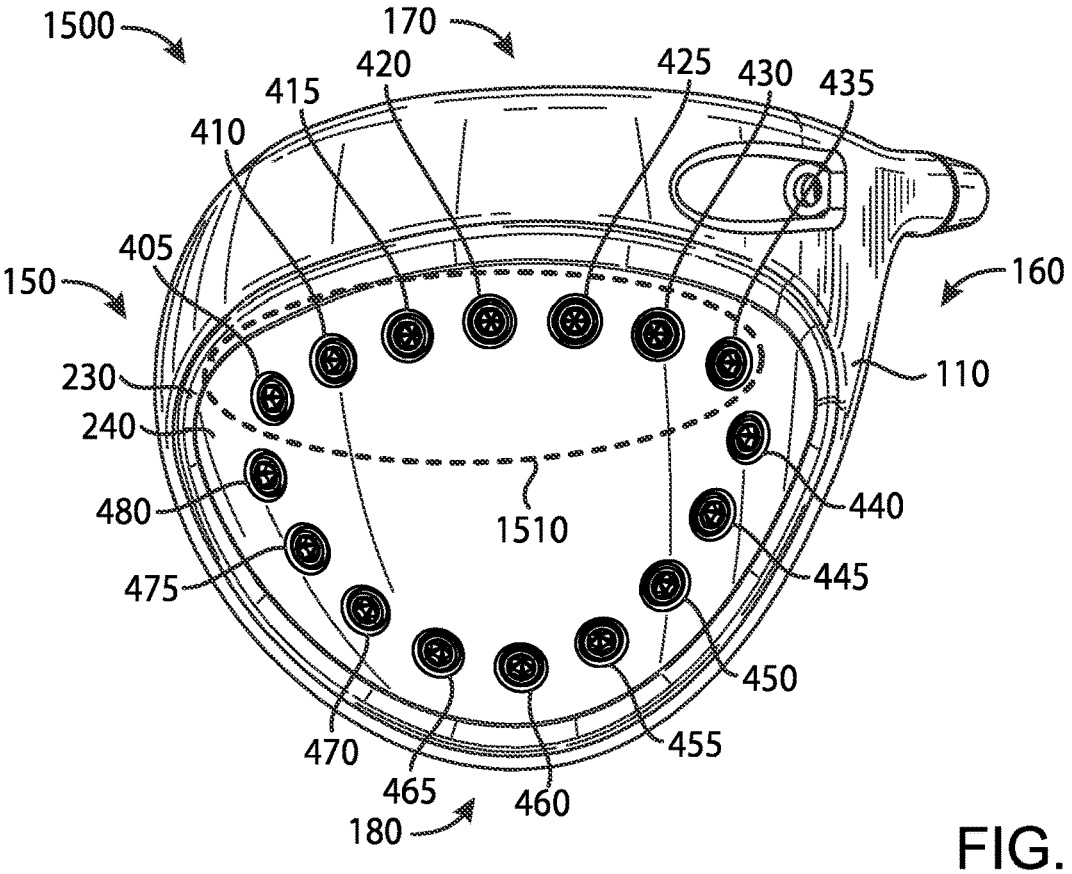
FIG. 15 depicts a first weight configuration of the example weight portions.

In contrast to other golf club heads, the golf club head 100 may accommodate at least four different types of golf swings. As illustrated in FIG. 14, for example, each weight configuration may be associated with one of the plurality of launch trajectory profiles 1400, generally shown as 1410, 1420, and 1430. Referring to FIG. 15, for example, in a first weight configuration 1500, a first set of weight portions, which may be defined by the weight portions 405, 410, 415, 120, 425, 430 and 435, may be disposed toward the front portion 170, whereas a second set of weight portions, which may be defined by the weight portions 440, 445, 450, 455, 460, 465, 470, 475, may be disposed toward the rear portion 180 according to the configuration of the first set of weight ports 1510. The first weight configuration 1500 may be associated with the first launch trajectory profile 1410 (FIG. 14). In particular, the first weight configuration 1500 may decrease spin rate of a golf ball. By placing relatively heavier weight portions (i.e., the first set of weight portions) towards the front portion 170 of the golf club head 100 according to the configuration of the first set of weight ports 1510, the center of gravity (GC) of the golf club head 100 may move relatively forward and lower to produce a relatively lower launch and spin trajectory. As a result, the first launch trajectory profile 1410 may be associated with a relatively greater roll distance (i.e., distance after impact with the ground). While the above example may describe the weight portions being disposed in certain weight ports, any weight portion of the first set of weight portions 210 may be disposed in any weight port of the first set of weight ports 1510.

Figure 16:
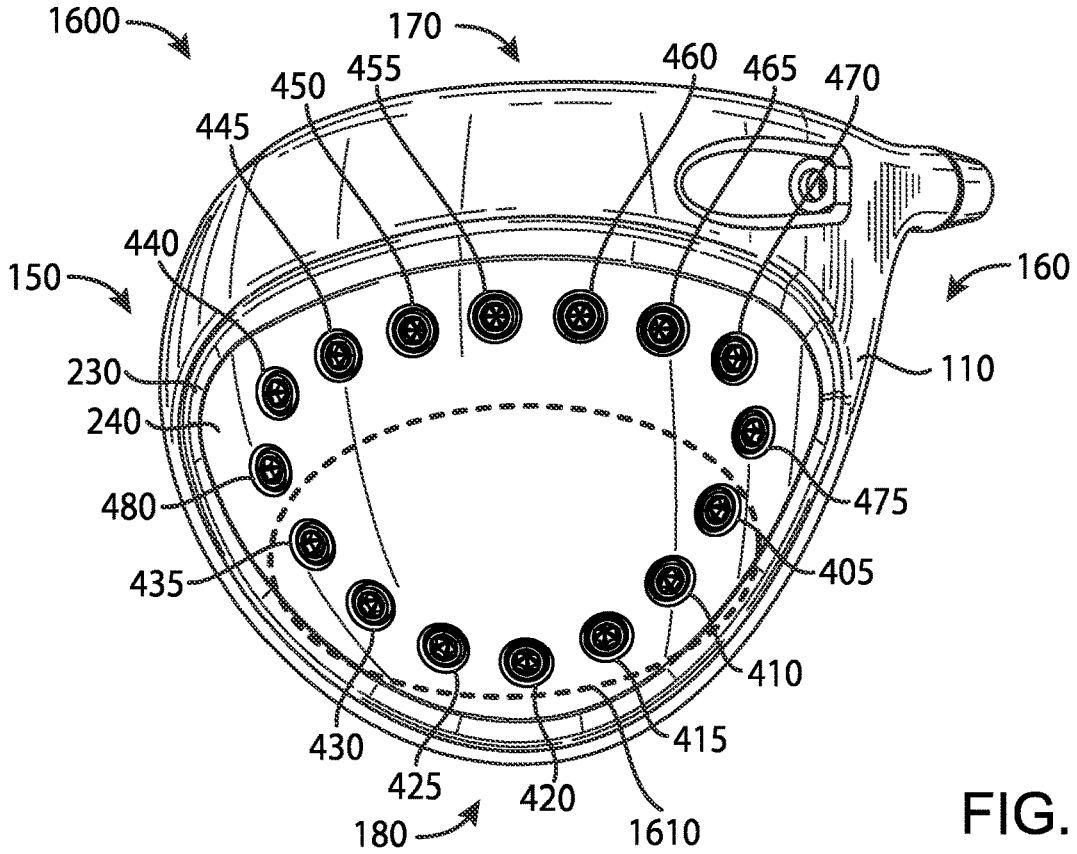
FIG. 16 depicts a second weight configuration of the example weight portions.

Turning to FIG. 16, for example, in a second weight configuration 1600, a first set of weight portions, which may be defined by the weight portions 405, 410, 415, 120, 425, 430 and 435, may be disposed toward the rear portion 180 whereas a second set of weight portions, which may be defined by the weight portions 440, 445, 450, 455, 460, 465, 470, 475, may be disposed toward the front portion 170 according to the configuration of the second set of weight ports 1610. The second weight configuration 1600 may be associated with the second launch trajectory profile 1420 (FIG. 14). In particular, the second weight configuration 1600 may increase launch angle of a golf ball and maximize forgiveness. By placing the relatively heavier weight portion (i.e., the first set of weight portions) towards the rear portion 180 of the golf club head 100 according to the configuration of the second set of weight ports 1610, the center of gravity (GC) of the golf club head 100 may move relatively back and up to produce a relatively higher launch and spin trajectory. Further, the moment of inertia (MOI) of the golf club head 100 may increase in both the horizontal (front-to-back axis) and vertical axes (top-to-bottom axis), which in turn, provides relatively more forgiveness on off-center hits. As a result, the second launch trajectory profile 1420 may be associated with a relatively greater carry distance (i.e., in-the-air distance).

Figure 17:
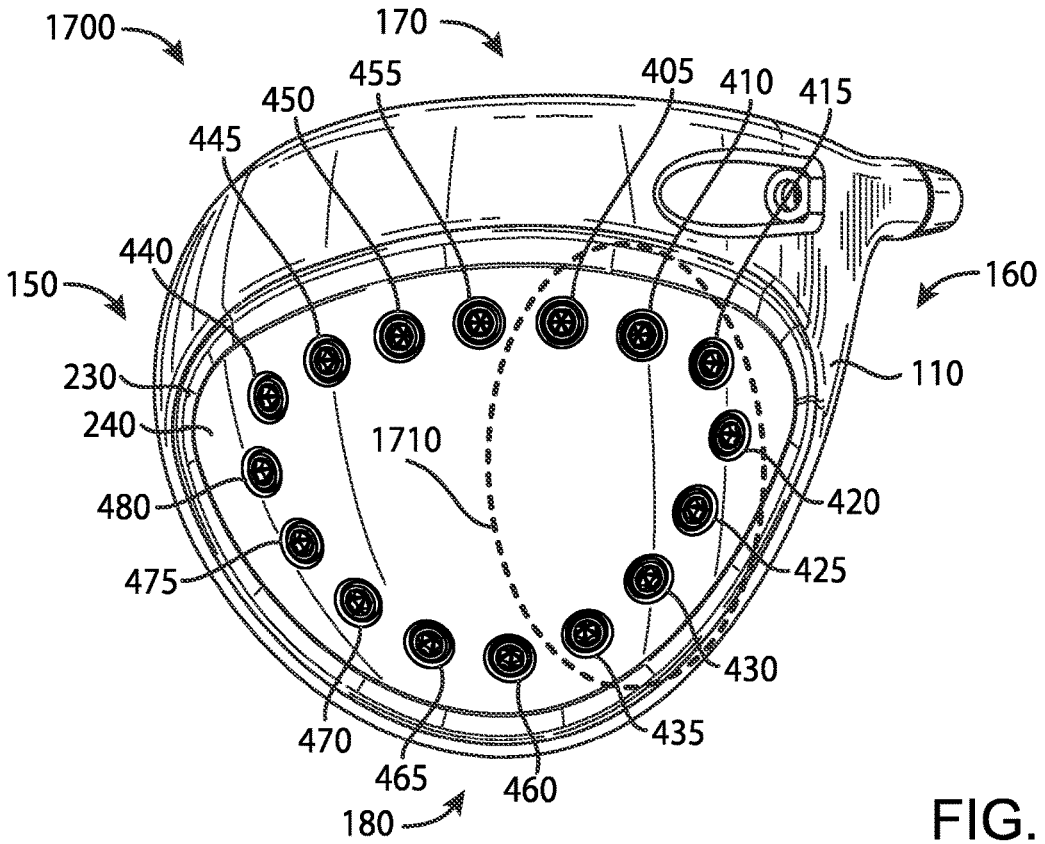
FIG. 17 depicts a third weight configuration of the example weight portions.

Turning to FIG. 17, for example, in a third weight configuration, a first set of weight portions, which may be defined by the weight portions 405, 410, 415, 120, 425, 430 and 435, may be disposed toward the heel portion 160 whereas a second set of weight portions, which may be defined by the weight portions 440, 445, 450, 455, 460, 465, 470, 475, may be disposed toward the toe portion 150 according to the configuration of the third set of weight ports 1710. The third weight configuration 1700 may be associated with a third launch trajectory profile 1430 (FIG. 14). In particular, the third weight configuration 1700 may allow an individual to turn over the golf club head 100 relatively easier (i.e., square up the face portion 175 to impact a golf ball). By placing the relatively heavier weight portions (i.e., the first set of weight portions) towards the heel portion 160 of the golf club head 100, the center of gravity (GC) of the golf club head 100 may move relatively closer to the axis of the shaft.

Figure 18:
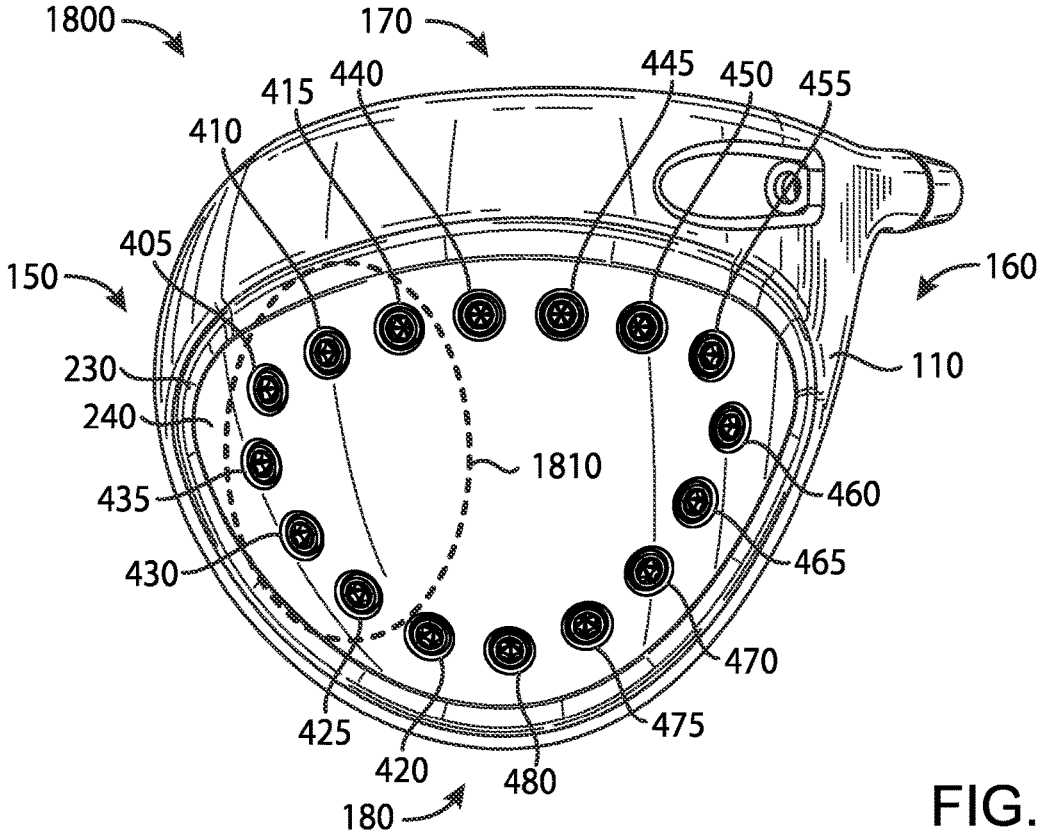
FIG. 18 depicts a fourth weight configuration of the example weight portions.
Figure 19:
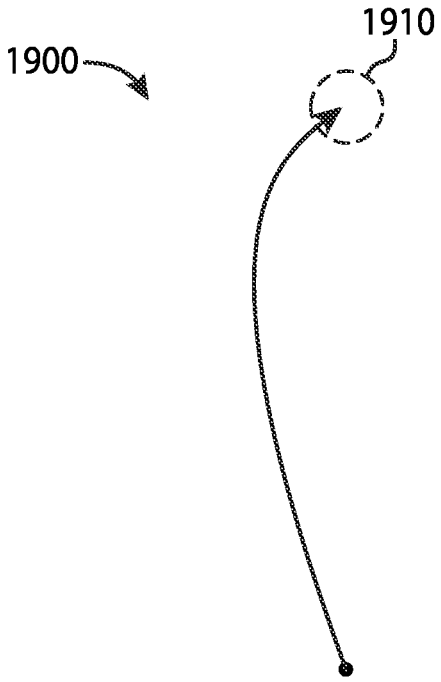
FIG. 19 depicts an example launch trajectory profile of the example golf club head of FIG. 18.

Turning to FIG. 18, for example, in a fourth weight configuration 1800, a first set of weight portions, which may be defined by the weight portions 405, 410, 415, 120, 425, 430 and 435, may be disposed toward the toe portion 150 whereas a second set of weight portions, which may be defined by the weight portions 440, 445, 450, 455, 460, 465, 470, 475, may be disposed toward the heel portion 160 according to the configuration of the fourth set of weight ports 1810. The fourth weight configuration 1800 may be associated with the third launch trajectory profile 1430 (FIG. 14). In particular, the fourth weight configuration 1800 may prevent an individual from turning over the golf club head 100 (i.e., the face portion 175 may be more open to impact a golf ball). By placing the relatively heavier weight portions (i.e., the first set of weight portions) towards the toe portion 150 of the golf club head 100, the center of gravity (GC) of the golf club head 100 may move relatively farther away from the axis of the shaft. The fourth weight configuration 1800 may result in a fade golf shot (as shown in FIG. 19, for example, a trajectory or ball flight in which a golf ball travels to the left of a target 1910 and curving back to the right of the target for a right-handed individual). The apparatus, methods, and articles of manufacture described herein are not limited in this regard.

Figure 20:
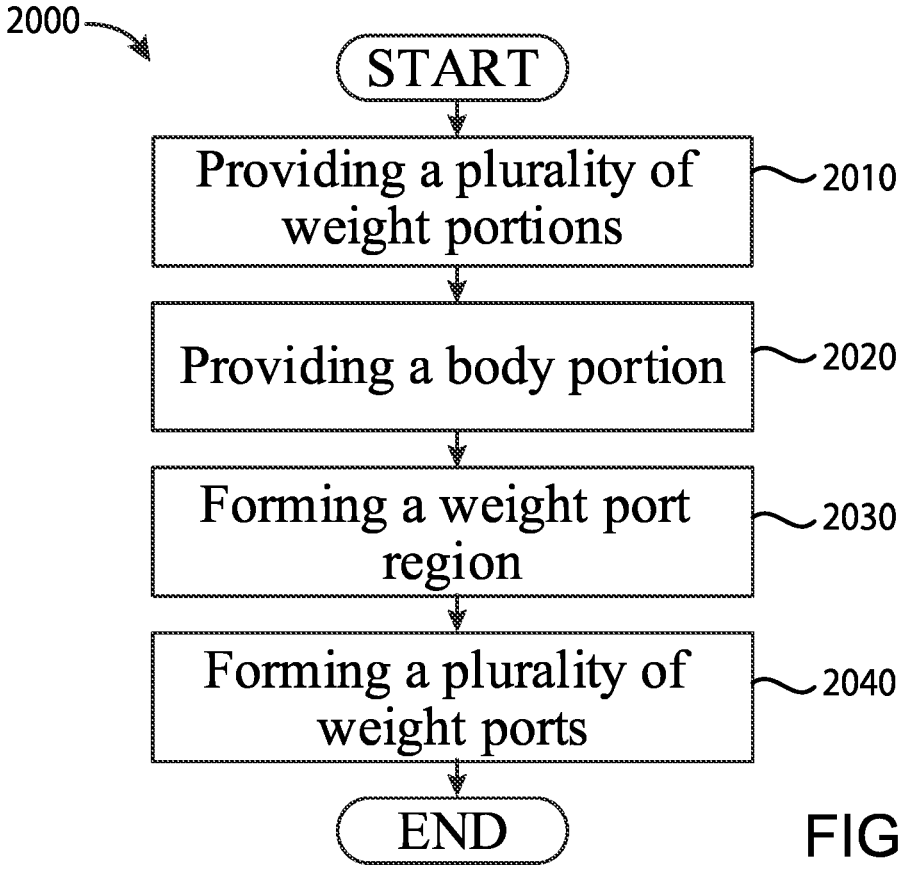
FIG. 20 depicts one manner in which the example golf club heads described herein may be manufactured.

FIG. 20 depicts one manner in which the golf club head 100 may be manufactured. In the example of FIG. 20, the process 2000 may begin with providing a plurality of weight portions (block 2010). The plurality of weight portions may include a first set of weight portions and a second set of weight portions. Each weight portion of the first set of weight portions may be associated with a first mass whereas each weight portion of the second set of weight portions may be associated with a second mass. The first mass may be greater than the second mass. In one example, each weight portion of the first set of weight portions may be made of a tungsten-based material with a mass 2.6 grams whereas each weight portion of the second set of weight portions may be made of an aluminum-based material with a mass of 0.4 grams. The first set of weight portions may have a gray color or a steel color whereas the second set of weight portions may have a black color. The process 2000 may provide a body portion of a golf club head (block 2020). The body portion may include a front portion, a rear portion, a toe portion, a heel portion, a top portion, a bottom portion having an outer surface associated with outer surface curve, and a skirt portion between the top and bottom portion. The process 2000 may form a weight port region located at or proximate to the bottom and skirts portions (block 2030). A transition region may surround the weight port region. The process 2000 may form a plurality of weight ports along a periphery of the weight port region (block 2040). Each weight port of the plurality of weight ports may be associated with a port diameter and configured to receive at least one weight portion of the plurality of weight portions. Two adjacent weight ports may be separated by less than or equal to the port diameter. Further, each weight port of the plurality of weight ports may be associated with a port axis. The port axis may be perpendicular or substantially perpendicular relative to a tangent plane of the outer surface curve of the bottom portion of the golf club head. The example process 2000 of FIG. 20 is merely provided and described in conjunction with FIGS. 1-19 as an example of one way to manufacture the golf club head 100. While a particular order of actions is illustrated in FIG. 20, these actions may be performed in other temporal sequences. For example, two or more actions depicted in FIG. 20 may be performed sequentially, concurrently, or simultaneously. Although FIG. 20 depicts a particular number of blocks, the process may not perform one or more blocks. The apparatus, methods, and articles of manufacture described herein are not limited in this regard.

Figure 4:
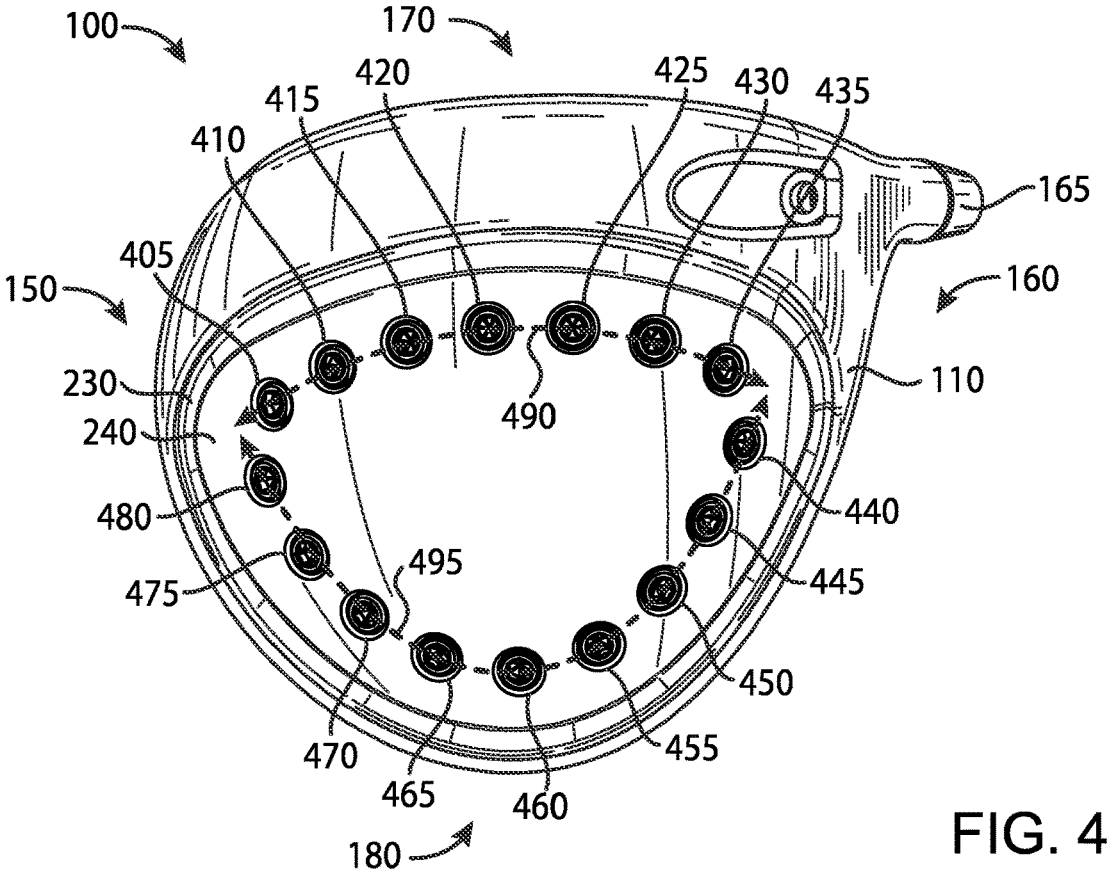
FIG. 4 depicts a bottom view of the example golf club head of FIG. 1.
Figure 5:
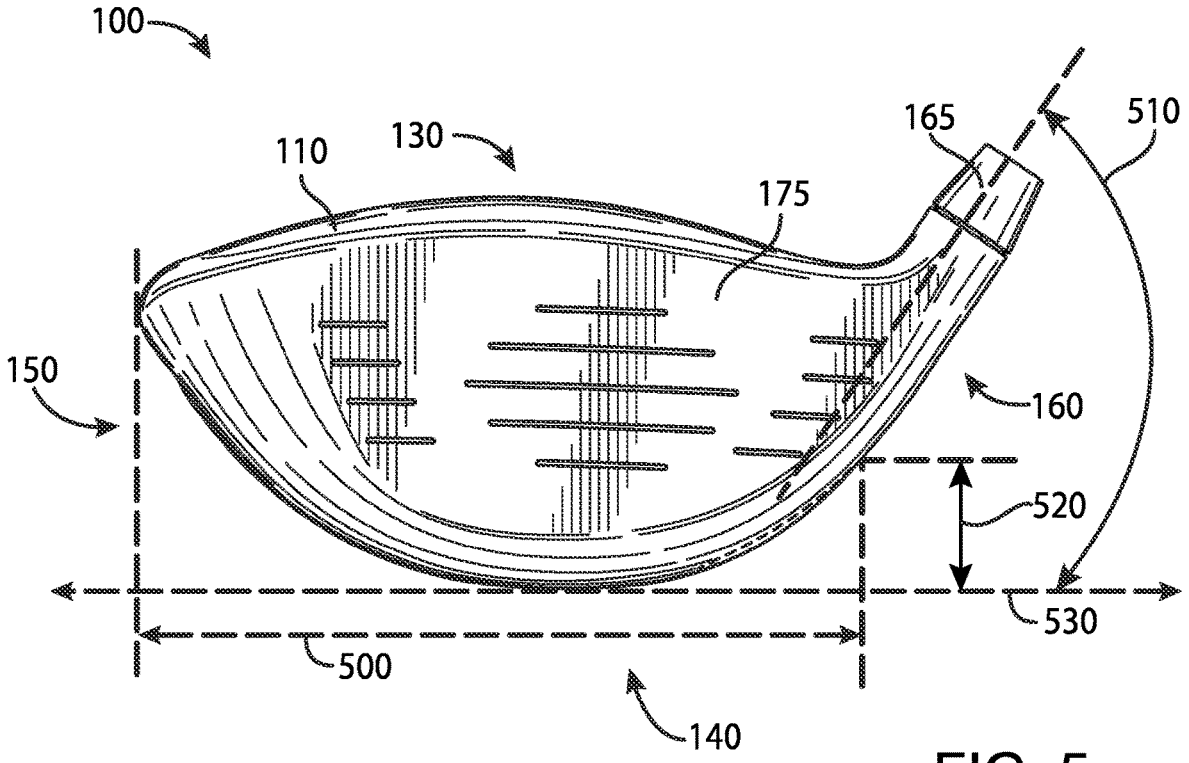
FIG. 5 depicts a front view of the example golf club head of FIG. 1.
Figure 6:
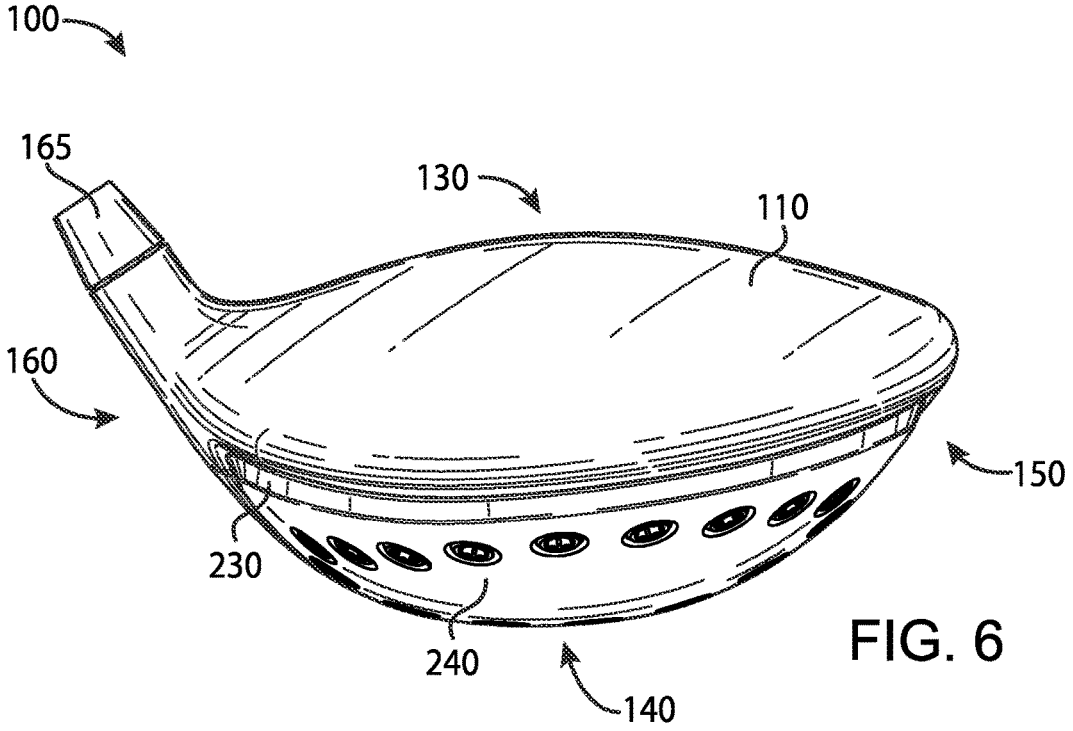
FIG. 6 depicts a rear view of the example golf club head of FIG. 1.
Figure 7:
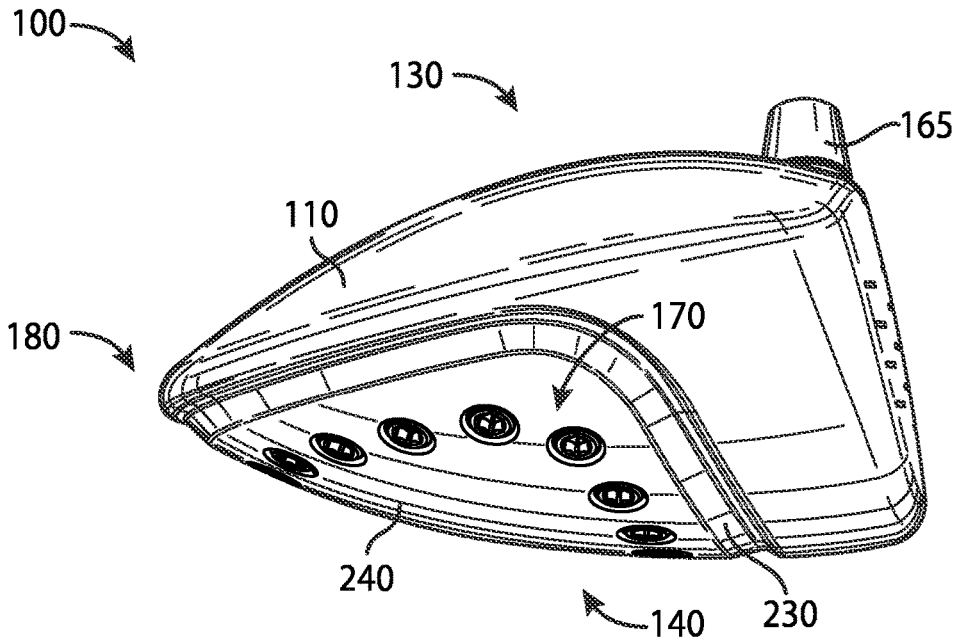
FIG. 7 depicts a toe view of the example golf club head of FIG. 1.
Figure 8:
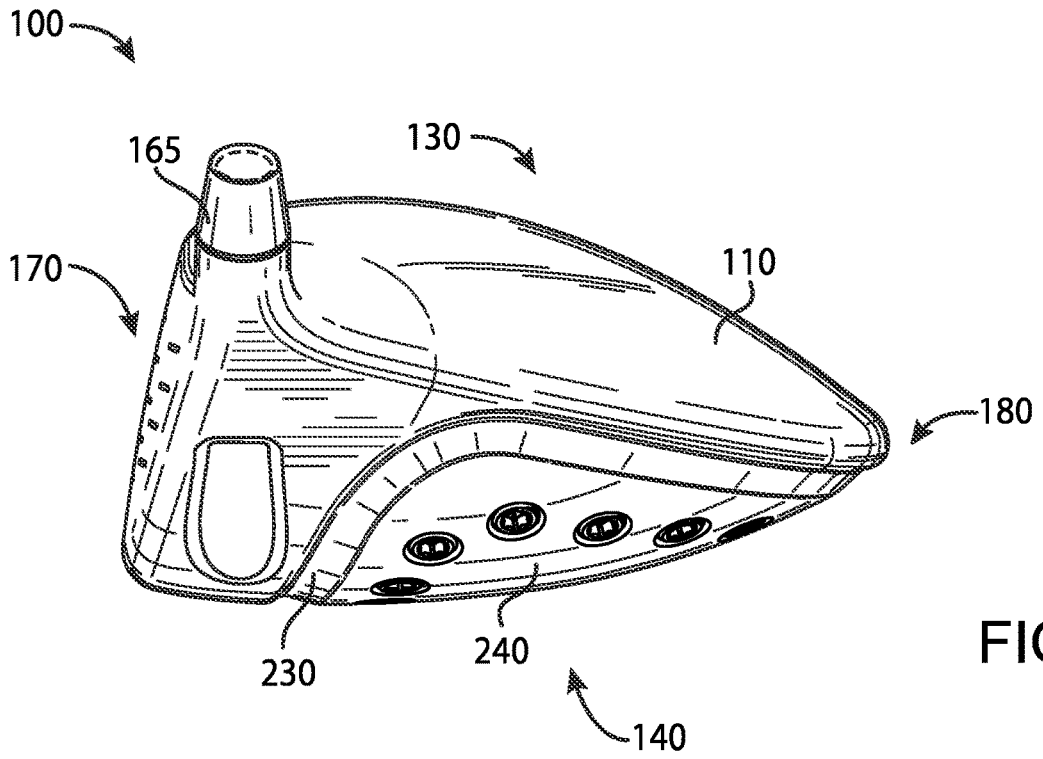
FIG. 8 depicts a heel view of the example golf club head of FIG. 1.

As shown in the above examples, the plurality of weight portions 120 and the plurality of weight ports 900 may be located on a periphery of the weight port region 240 along a path that defines a generally D-shaped loop formed with two arcs, generally shown as 490 and 495 in FIG. 4. For example, the weight portions 405, 410, 415, 420, 425, 430, and 435 (FIG. 4), and the weight ports 905, 910, 915, 920, 925, 930, and 935 (FIG. 9) may form the first arc 490. In particular, the first arc 490 may extend between the toe and heel portions 150 and 160, respectively, across the bottom portion 140. The weight portions 440, 445, 450, 455, 460, 465, 470, 475, and 480 (FIG. 4), the weight ports 940, 945, 950, 955, 960, 965, 970, 975, and 980 (FIG. 9) may form the second arc 495. The second arc 495 may generally follow the contour of the rear portion 180 of the body portion 110. Alternatively, the first and second arcs 490 and 495 may define loops with other shapes that extend across the bottom portion 140 (e.g., a generally O-shaped loop). The apparatus, methods, and articles of manufacture described herein are not limited in this regard.

Figure 21:
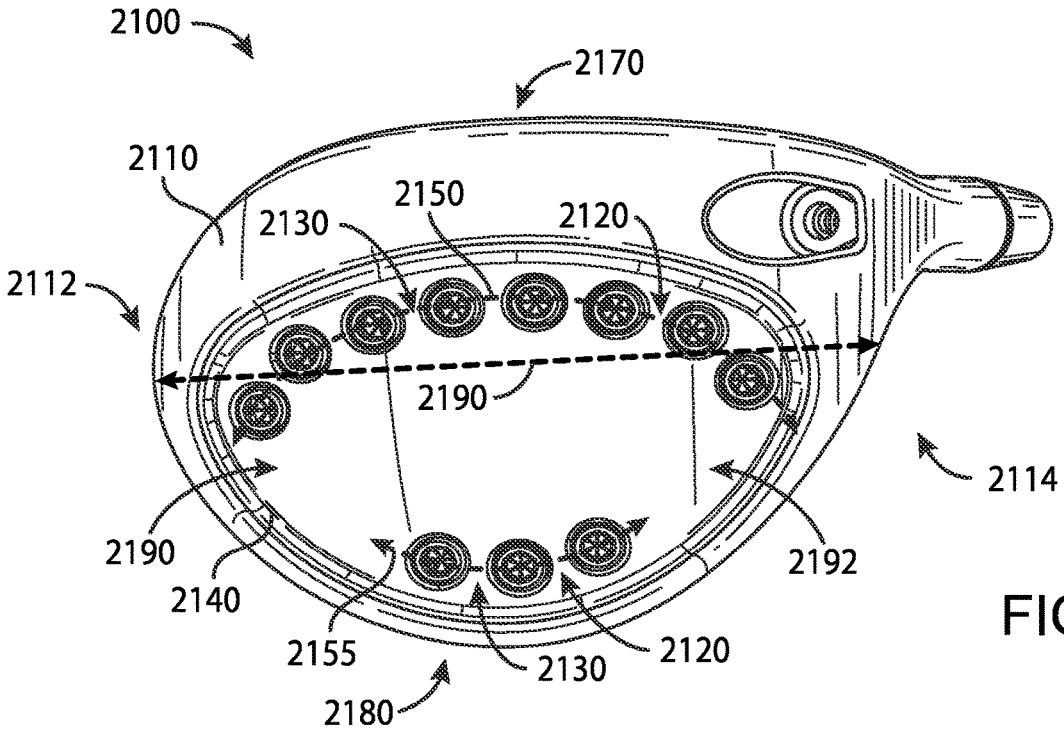
FIG. 21 depicts a bottom view of another example golf club head.

Although the above examples may depict the plurality of weight portions 120 and the plurality of weight ports 900 forming a particular geometric shape, the apparatus, methods, and articles of manufacture described herein may have weight portions and weight ports located along a periphery of a weight portion region to form other geometric shapes. Turning to FIG. 21, for example, a golf club head 2100 may include a bottom portion 2110, and a plurality of weight portions 2120 disposed in a plurality of weight ports 2130. The plurality of weight ports 2130 may be located along a periphery of a weight port region 2140 of the bottom portion 2110 (i.e., the plurality of weight ports 2130 may extend between the toe and heel portions 2112 and 2114, respectively, across the bottom portion 2110). In contrast to the plurality of weight portions 120 and the plurality of weight ports 900 (e.g., FIGS. 4 and 9), the plurality of weight ports 2130 may form two discrete arcs, generally shown as 2150 and 2155, extending across the bottom portion 2110.

The first arc 2150 may extend between the toe portion 2112 and the heel portion 2114. The first arc 2150 may curve toward the front portion 2170 of the golf club head 2100 (i.e., concave relative to the front portion 2170). According to the example of FIG. 21, the first arc 2150 may extend from a region proximate the toe portion 2112 to a region proximate to the front portion 2170 and from the region proximate to the front portion 2170 to a region proximate to the heel portion 2114 (i.e., concave relative to the front portion 2170). Accordingly, the first arc 2150 may appear as a C-shaped arc facing the rear portion 2180 of the golf club head 2100 that extends between the toe portion 2112 and the heel portion 2114. The second arc 2155 may also extend between the toe portion 2112 and the heel portion 2114. The second arc 2155 may curve toward the rear portion 2180 of the golf club head 2100 (i.e., concave relative to the rear portion 2180). Accordingly, the second arc 2155 may appear as a C-shaped arc facing the front portion 2170 of the golf club head 2100 that extends between the toe portion 2112 and the heel portion 2114. Further, the first arc 2150 may be closer to the front portion 2170 than the second arc 2155. The first arc 2150 and the second arc 2155 may be discrete so that the first and second arcs 2150 and 2155, respectively, may be spaced apart along the periphery of the bottom portion 2110. Accordingly, the bottom portion 2110 may include gaps 2190 and 2192 along the periphery of the bottom portion 2110 between the weight ports 2130 of the first arc 2150 and the weight ports 2130 of the second arc 2155. The gaps 2190 and/or 2192 may be greater than or equal to the port diameter of any of the weight ports 2130 such as the weight ports 2130 that are adjacent to the gaps 2190 and/or 2192. According to one example as shown in FIG. 21, the gaps 2190 and 2192 may be several orders or magnitude larger than the diameters of the weight ports 2130 that are adjacent to the gaps 2190 and 2192. The apparatus, methods, and articles of manufacture described herein are not limited in this regard.

Referring to FIG. 21, for example, the first arc 2150 may include a greater number of weight ports 2130 than the second arc 2155, which may be suitable for certain golf club heads (e.g., a fairway wood-type golf club head and/or a hybrid-type golf club head). Alternatively, the second arc 2155 may include the same or a greater number of weight ports 2130 than the first arc 2150. The number of weight ports 2130 in each of the first and second arcs 2150 and 2155, respectively, the weight portions 2120 associated with each weight port 2130 and the spacing between adjacent weight ports 2130 may be determined based on the type of golf club, a preferred weight distribution of the golf club head 2100, and/or a center of gravity location of the golf club head 2100.

The weight ports 2130 of the first arc 2150 and/or the second arc 2155 may be spaced from each other at the same or approximately the same distance along the first arc 2150 and/or the second arc 2155, respectively. Any variation in the spacing between the weight ports 2130 of the first arc 2150 or the second arc 2155 or any of the weight ports described herein may be due to different manufacturing considerations, such as manufacturing tolerances and/or cost effectiveness associated with manufacturing precision. For example, the variation in the spacing between the weight ports 2130 of the first arc 2150 and/or the second arc 2155 may be between 1/16 of an inch to 0.001 inch. As described herein, the distance between adjacent weight ports 2130 (i.e., port distance) may be less than or equal to the port diameter of any of the two adjacent weight ports. The plurality of weight ports 2130 may extend between the toe portion 2112 and the heel portion 2114 at a maximum toe-to heel weight port distance that is more than 50% of a maximum toe-to-heel club head distance 2195 of the golf club head 2100. The maximum toe-to-heel weight port distance may be the maximum distance between the heel-side boundary of the weight port farthest from the toe portion 2112 and the toe-side boundary of the weight port farthest from the heel portion 2114.

In particular, the golf club head 2100 may have a volume of less than 430 cc. In example, the golf club head 2100 may have a volume ranging from 100 cc to 400 cc. In another example, the golf club head 2100 may have a volume ranging from 150 cc to 350 cc. In yet another example, the golf club head 2100 may have a volume ranging from 200 cc to 300 cc. The golf club head 2100 may have a mass ranging from 100 grams to 350 grams. In another example, the golf club head 2100 may have a mass ranging from 150 grams to 300 grams. In yet another example, the golf club head 2100 may have a mass ranging from 200 grams to 250 grams. The golf club head 2100 may have a loft angle ranging from 10° to 30°. In another example, the golf club head 2100 may have a loft angle ranging from 13° to 27. For example, the golf club head 2100 may be a fairway wood-type golf club head. Alternatively, the golf club head 2100 may be a smaller driver-type golf club head (i.e., larger than a fairway wood-type golf club head but smaller than a driver-type golf club head). The apparatus, methods, and articles of manufacture described herein are not limited in this regard.

Figure 22:
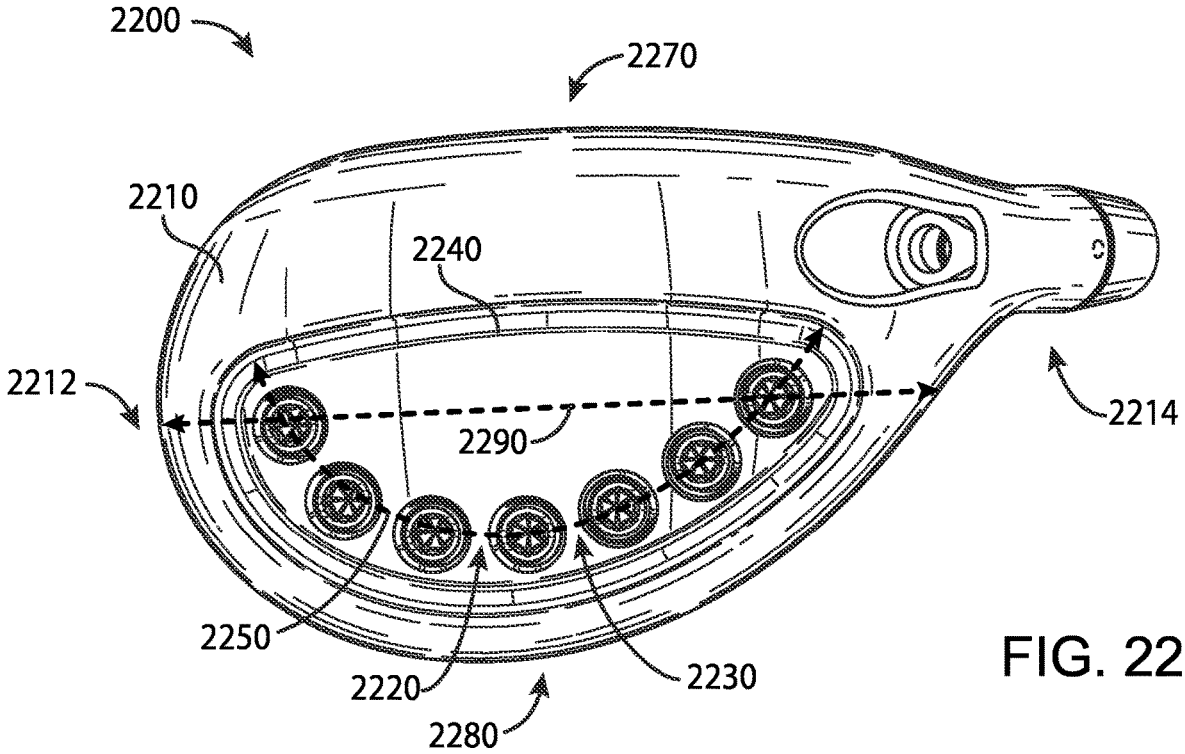
FIG. 22 depicts a bottom view of yet another example golf club head.

As illustrated in FIG. 22, for example, a golf club head 2200 may include a bottom portion 2200, and a plurality of weight portions 2220 disposed in a plurality of weight ports 2230. The plurality of weight ports 2230 located along a periphery of a weight port region 2240 may be arranged along a path that defines an arc, generally shown as 2250, extending across the bottom portion 2210 (i.e., the plurality of weight ports 2230 may extend between the toe and heel portions 2212 and 2214, respectively, across the bottom portion 2210). The arc 2250 may curve toward the rear portion 2280 of the golf club head 2200 (i.e., concave relative to the rear portion 2280). According to the example of FIG. 22, the arc 2250 may extend from a region proximate the toe portion 2212 to a region proximate to the rear portion 2280 and from the region proximate to the rear portion 2280 to a region proximate to the heel portion 2214 (i.e., concave relative to the rear portion 2280). Accordingly, the arc 2250 may appear as a C-shaped arc facing the front portion 2270 of the golf club head 2200 that extends from near the heel portion 2214 to near the toe portion 2212. Further, the curvature of the arc 2250 is substantially similar to or generally follows the contour of the rear portion 2280 of the golf club head 2200. The number of weight ports 2230 in the arc 2250, the weight portions 2220 associated with each weight port 2230 and the spacing between adjacent weight ports 2230 may be determined based on the type of golf club, a preferred weight distribution of the golf club head 2200, and/or a center of gravity location of the golf club head 2200.

The weight ports 2230 of the arc 2250 may be spaced from each other at the same or approximately the same distance along the arc 2250 (e.g., the weight ports 2230 may be substantially similarly spaced apart from each other). Any variation in the spacing between the weight ports 2230 of the arc 2250 or any of the weight ports described herein may be due to different manufacturing considerations, such as manufacturing tolerances and/or cost effectiveness associated with manufacturing precision. For example, the variation in the spacing between the weight ports 2130 of the arc 2250 may be between 1/16 of an inch to 0.001 inch. As described herein, the distance between adjacent weight ports 2230 (i.e., port distance) may be less than or equal to the port diameter of any of the two adjacent weight ports. The plurality of weight ports 2230 may extend between the toe portion 2212 and the heel portion 2214 at a maximum toe-to heel weight port distance that is more than 50% of a maximum toe-to-heel club head distance of 2290 the golf club head 2200. The maximum toe-to-heel weight port distance may be the maximum distance between the heel-side boundary of the weight port farthest from the toe portion 2212 and the toe-side boundary of the weight port farthest from the heel portion 2214.

In particular, the golf club head 2200 may have a volume of less than 200 cc. In example, the golf club head 2200 may have a volume ranging from 50 cc to 150 cc. In another example, the golf club head 2200 may have a volume ranging from 60 cc to 120 cc. In yet another example, the golf club head 2200 may have a volume ranging from 70 cc to 100 cc. The golf club head 2200 may have a mass ranging from 180 grams to 275 grams. In another example, the golf club head 2200 may have a mass ranging from 200 grams to 250 grams. The golf club head 2200 may have a loft angle ranging from 15° to 35°. In another example, the golf club head 2200 may have a loft angle ranging from 17° to 33°. For example, the golf club head 2200 may be a hybrid-type golf club head. The apparatus, methods, and articles of manufacture described herein are not limited in this regard.

Figure 24:
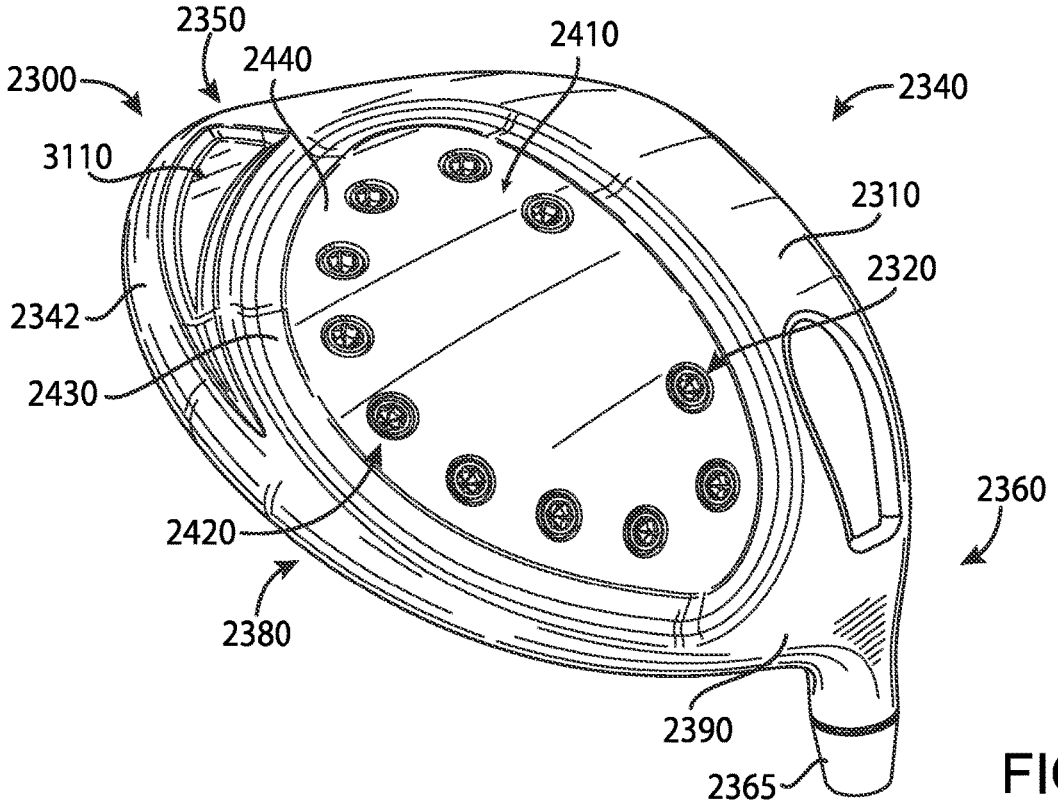
FIG. 24 depicts a bottom perspective view of the example golf club head of FIG. 23.
Figure 25:
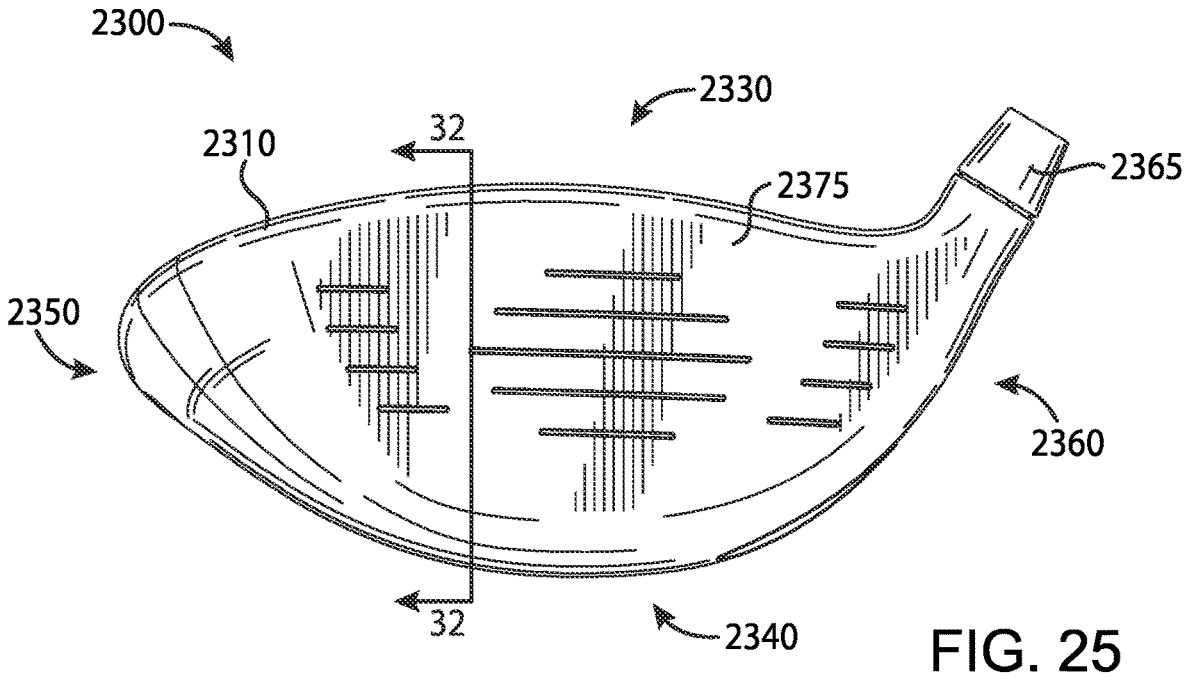
FIG. 25 depicts a front view of the example golf club head of FIG. 23.
Figure 26:
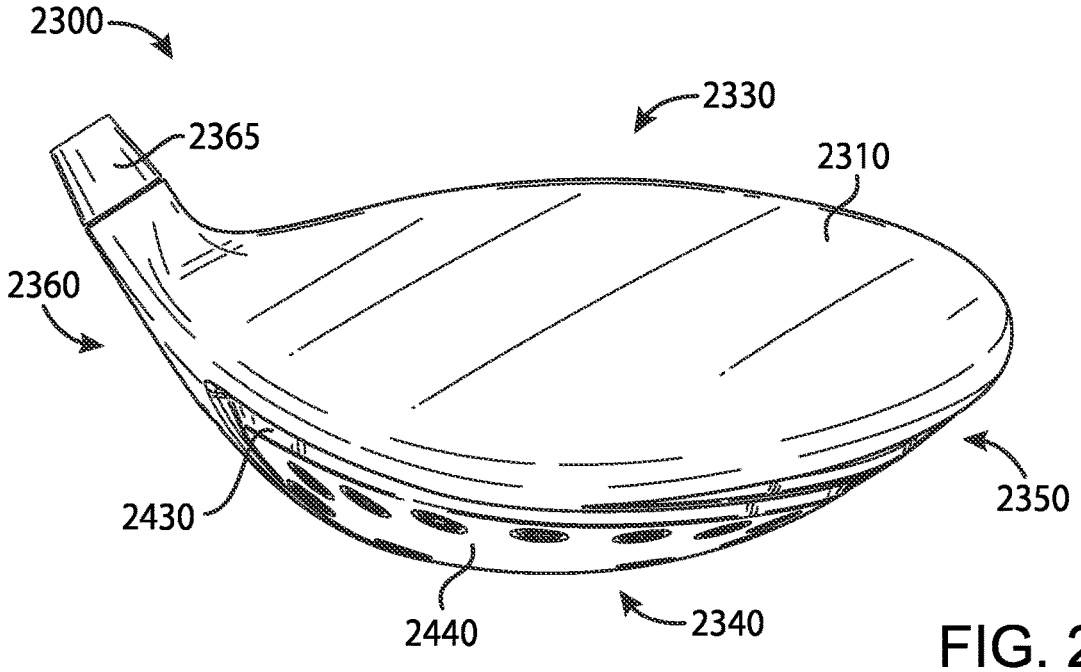
FIG. 26 depicts a rear view of the example golf club head of FIG. 23.
Figure 27:
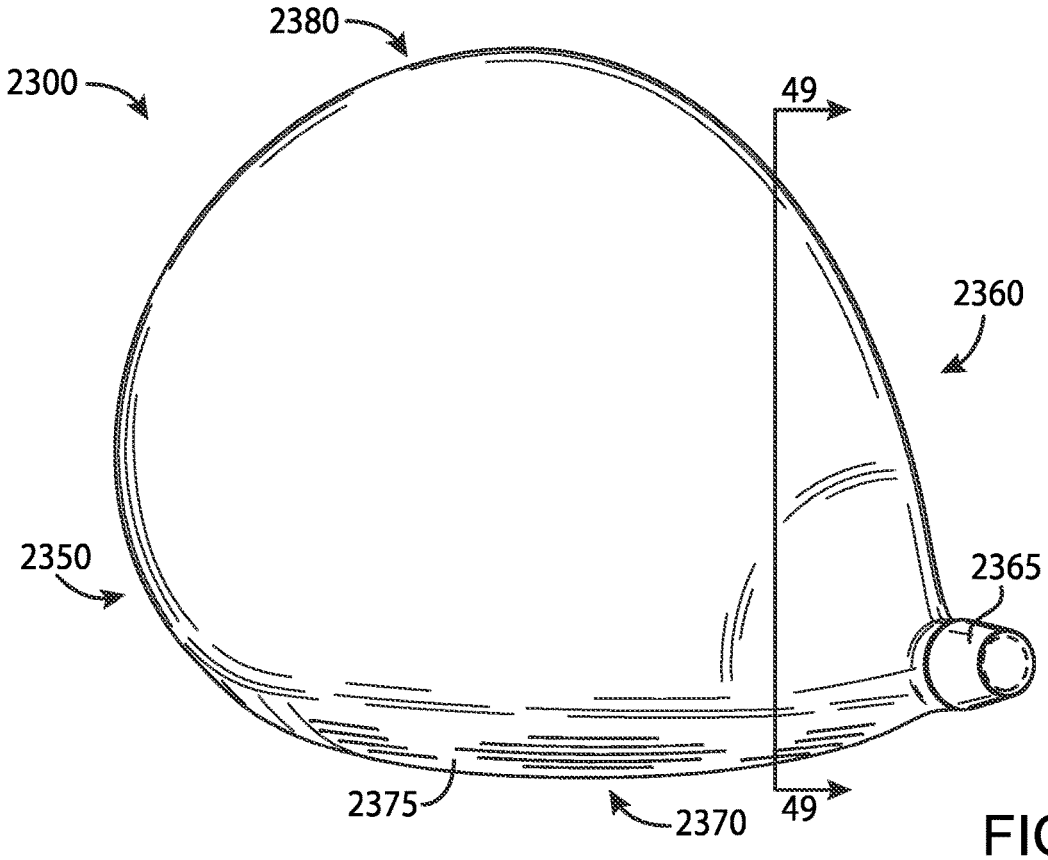
FIG. 27 depicts a top view of the example golf club head of FIG. 23.

In the example of FIGS. 23-32, a golf club head 2300 may include a body portion 2310, and a plurality of weight portions 2320, generally, shown as a first set of weight portions 2410 and a second set of weight portions 2420 (FIG. 24). The body portion 2310 may include a top portion 2330, a bottom portion 2340, a toe portion 2350, a heel portion 2360, a front portion 2370 with a face portion 2375, and a rear portion 2380. The bottom portion 2340 may include a skirt portion 2390 defined as a side portion of the golf club head 2300 between the top portion 2330 and the bottom portion 2340 excluding the front portion 2370 and extending across a periphery of the golf club head 2300 from the toe portion 2350, around the rear portion 2380, and to the heel portion 2360. The bottom portion 2340 may include a transition region 2430 and a weight port region 2440. For example, the weight port region 2440 may be a D-shape region. The weight port region 2440 may include a plurality of weight ports 2800 (FIG. 28) to receive the plurality of weight portions 2320. The body portion 2310 may also include a hosel portion 2365 to receive a shaft (not shown). The hosel portion 2365 may be an integral portion or a separate portion of the body portion 2310. For example, the hosel portion 2365 may include a hosel sleeve with one end to receive a shaft and an opposite end that may be inserted into the body portion 2310. Alternatively, the body portion 2310 may include a bore instead of the hosel portion 2365. The golf club head 2300 may be constructed from similar material, may have a similar volume and be the same type of golf club head as the golf club head 100 or any of the golf club heads described herein. The apparatus, methods, and articles of manufacture described herein are not limited in this regard.

Each of the first set of weight portions 2410, generally shown as 2605, 2610, 2615, and 2620 may be associated with a first mass. Each of the second set of weight portions 2420, generally shown as 2640, 2645, 2650, 2655, 2660, 2665, and 2670 may be associated with a second mass. The first mass may be greater than the second mass or vice versa. The first and second set of weight portions 2410 and 2420, respectively, may provide various weight configurations for the golf club head 2300 that may be similar to the various weight configurations for the golf club head 100 or any of the golf club heads described herein. Alternatively, all of the weight portions of the first and second set of weight portions 2410 and 2420, respectively, may have the same mass. That is, the first and second masses may be equal to each other. The plurality of weight portions 2320 may have similar or different physical properties (e.g., density, shape, mass, volume, size, color, etc.). The weight portions 2320 may be similar in many respects to the weight portions 120 of the golf club head 100 or any of the golf club heads described herein. The apparatus, methods, and articles of manufacture described herein are not limited in this regard.

Figure 28:
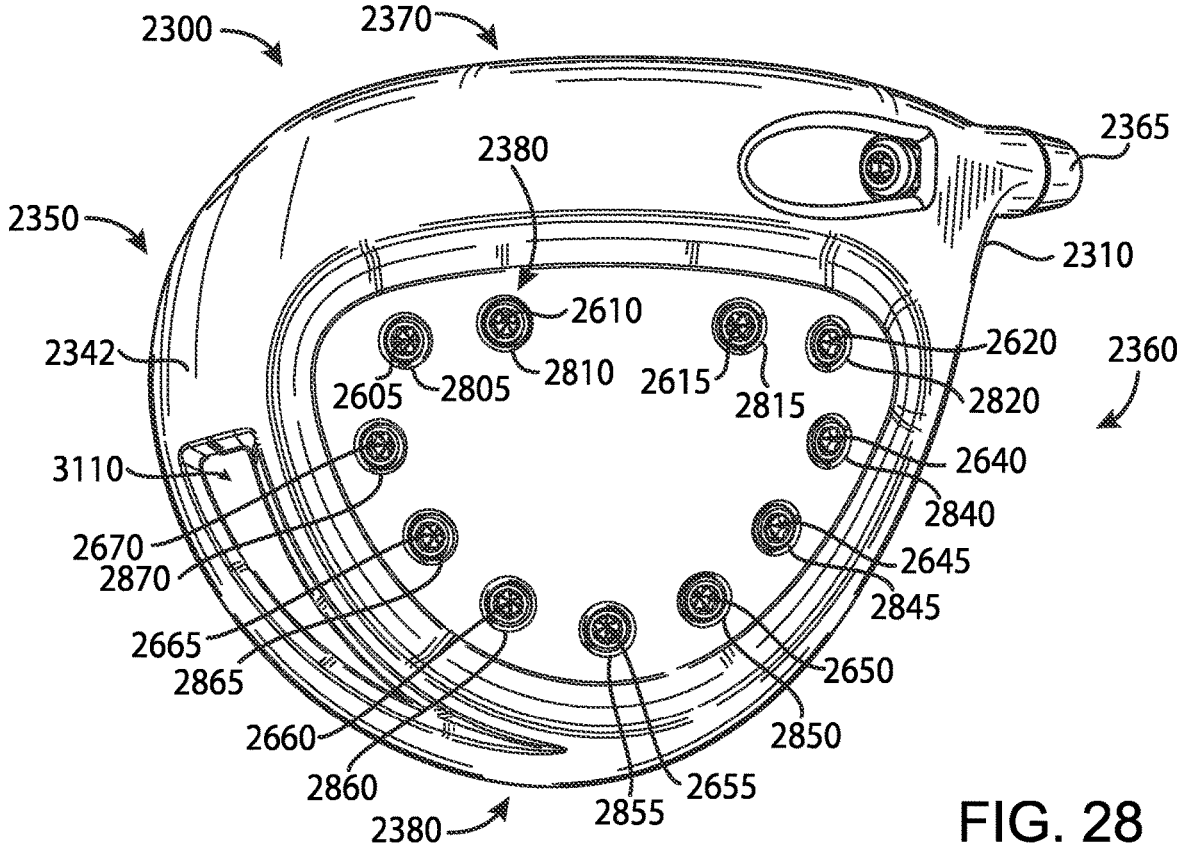
FIG. 28 depicts a bottom view of the example golf club head of FIG. 23.

Referring to FIG. 28, for example, the bottom portion 2340 of the body portion 2310 may include a plurality of weight ports 2800. The plurality of weight ports 2800, generally shown as 2805, 2810, 2815, 2820, 2840, 2845, 2850, 2855, 2860, 2865, and 2870 may be located on and/or along a periphery of the weight port region 2440 of the bottom portion 2340. Each of the plurality of weight ports 2800 may be similar in many respects (e.g., port diameter) to any of the weight ports of the golf club head 100 or any of the golf club heads described herein. Further, each of the plurality of weight ports 2800 may be formed on the bottom portion 2340 similar to the formation of the weight ports 900 of the golf club head 100 or any of the golf club heads described herein. Further yet, the plurality of weight ports 2800 may extend across the bottom portion 2340 similar to the configuration of the weight ports 900 of the golf club head 100 or any of the golf club heads described herein. However, the configuration of the weight ports 2800 on the bottom portion 2340 may be different than the configuration of the weight ports 900 of the golf club head 100 or any of the golf club heads described herein. The apparatus, methods, and articles of manufacture described herein are not limited in this regard.

In one example shown in FIGS. 23-32, the bottom portion 2340 may include an outer surface 2342 and an inner surface 2344. Each of the outer surface 2342 and the inner surface 2344 may include one or a plurality of support portions, generally shown as 3110, 3120, and 3140. The outer surface 2342 may include at least one outer support portion 3110 and the inner surface 2344 may include a first set of inner support portions 3120 (generally shown as inner support portions 3121, 3122, 3123, 3124, 3125, 3126, 3127, 3128, 3129, 3130, 3131, 3132 and 3133), and a second set of inner support portions 3140 (generally shown as inner support portions 3141, 3142, 3143, 3144, 3145, and 3146). The apparatus, methods, and articles of manufacture described herein are not limited in this regard.

Figure 31:
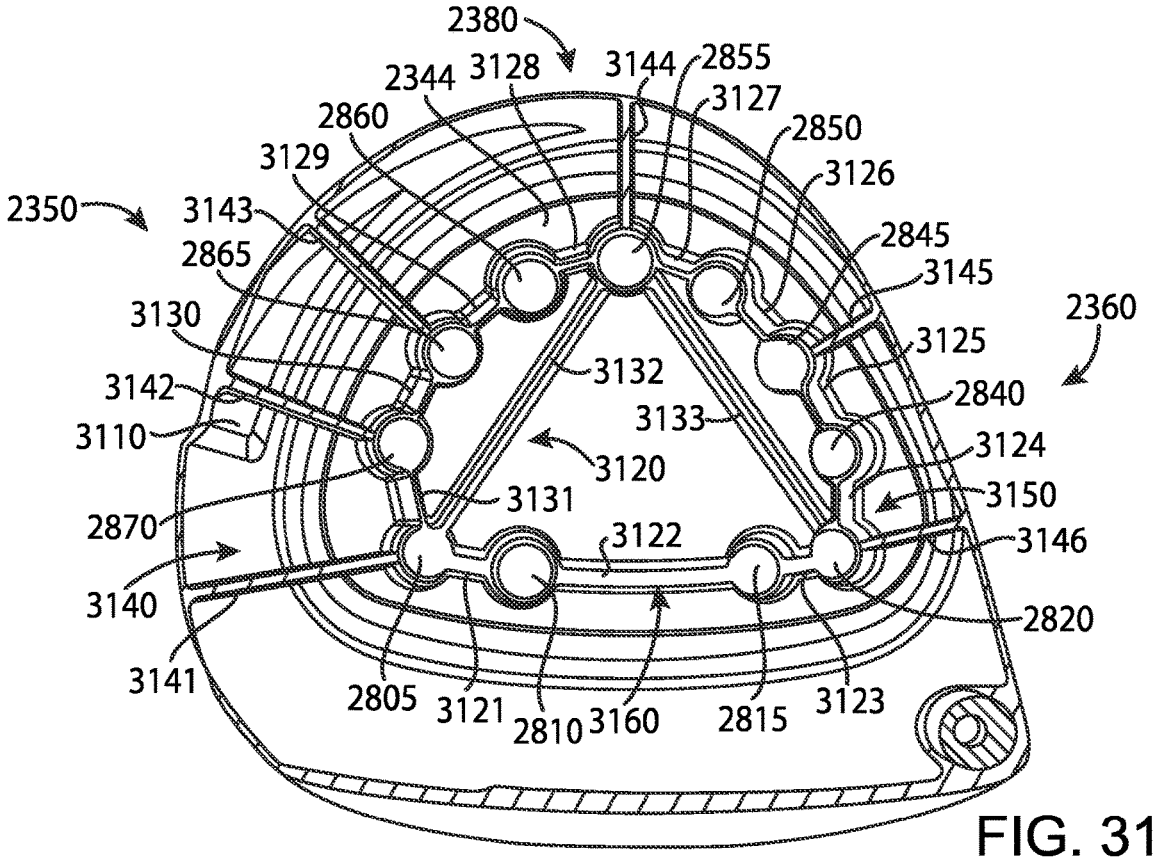
FIG. 31 depicts a cross-sectional view of the example golf club head of FIG. 23 taken at section line 31-31 of FIG. 29
Figure 32:
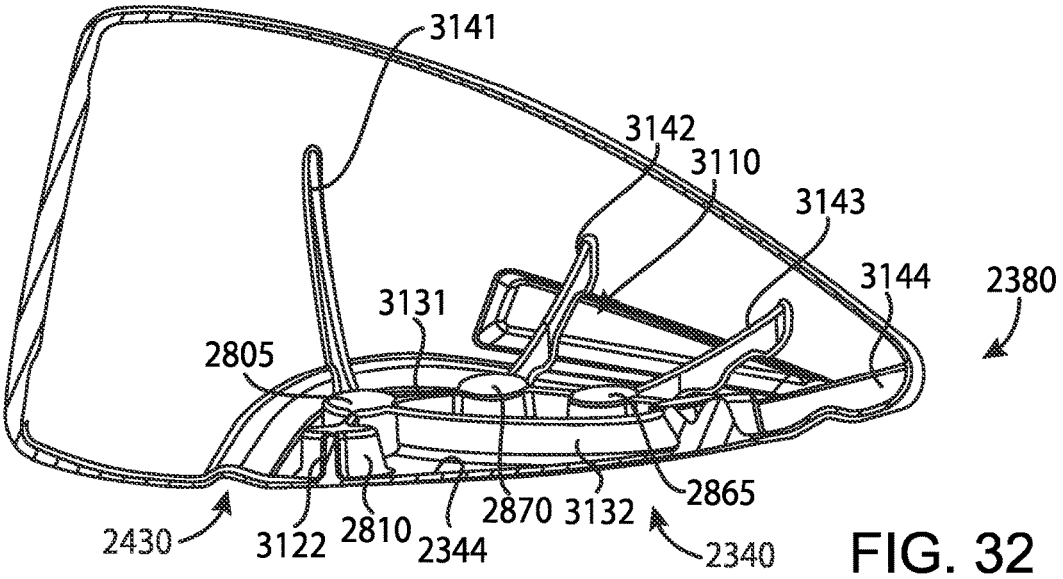
FIG. 32 depicts a cross-sectional view of the example golf club head of FIG. 23 taken at section line 32-32 of FIG. 25.

The outer support portion 3110 may be positioned on the bottom portion 2340 and/or the skirt portion 2390 between any of the weight ports 2800 and/or a periphery of the body portion 2310 as defined by the toe portion 2350, the heel portion 2360, the front portion 2370, and the rear portion 2380. However, the outer support portion 3110 may be positioned at any location on the golf club head 2300 for structural support of the golf club head 2300. As an example shown in FIGS. 23-32, the outer support portion 3110 may be defined by a groove or indentation that extends on the bottom portion 2340 and/or the skirt portion 2390 from the rear portion 2380 toward and/or to the toe portion 2350 proximate to a periphery of the body portion 2310. The outer support portion 3110 may have any configuration. As illustrated in FIG. 31, a width of the outer support portion 3110 may increase from the rear portion 2380 toward the toe portion 2350 while the outer support portion 3110 may follow a contour of the periphery of the body portion 2310 between the rear portion 2380 and the toe portion 2350. Accordingly, the outer support portion 3110 may resemble a curved triangular groove on the bottom portion 2340. The depth of the outer support portion 3110 may also vary. Alternatively, the depth of the outer support portion 3110 may be constant. Further, the depth of the outer support portion 3110 may be determined based on the thickness of the bottom portion 2340 and the material from which the bottom portion 2340 is formed. The apparatus, methods, and articles of manufacture described herein are not limited in this regard.

Each inner support portion of the first set of inner support portions 3120 may include walls, ribs and/or any projection from the inner surface 2344 of the bottom portion 2340. Each inner support portion of the first set of inner support portions 3120 may extend from and connect each weight port 2800 to an adjacent weight port or to one or more other non-adjacent weight ports 2800. As shown in FIG. 31, for example, the inner support portion 3121 may include a wall projecting from the inner surface 2344 of the bottom portion 2340 and connecting the weight ports 2805 and 2810. Similarly, as shown in FIG. 31, each pair of adjacent weight ports 2810 and 2815, 2815 and 2820, 2820 and 2840, 2840 and 2845, 2845 and 2850, 2850 and 2855, 2855 and 2860, 2860 and 2865, 2865 and 2870, 2870 and 2805 may be connected by inner support portions 3122, 3123, 3124, 3125, 3126, 3127, 3128, 3129, 3130, 3131, respectively. Accordingly, the inner support portions 3121 through 3131 of the first set of inner support portions 3120 may define a loop-shaped support region 3150 on the inner surface 2344 of the bottom portion 2340. The apparatus, methods, and articles of manufacture described herein are not limited in this regard.

Further, the inner support portion 3132 may include a wall projecting from the inner surface 2344 of the bottom portion 2340 and connecting two non-adjacent weight ports such as the weight ports 2805 and 2855. The inner support portion 3133 may include a wall projecting from the inner surface 2344 of the bottom portion 2340 and connecting two non-adjacent weight ports such as the weight ports 2820 and 2855. Accordingly, the inner support portions 3121, 3122, 3123, 3132 and 3133 may define a triangular support region 3160 on the inner surface 2344 of the bottom portion 2340 partially within the loop-shaped support region 3150 and partially overlapping the loop-shaped support region 3150. The weight ports 2805, 2820 and 2855 may define the vertices of the triangular support region 3160. The first set of inner support portions 3120 may have any configuration, connect any two or more of the weight ports, and/or define any shape. The apparatus, methods, and articles of manufacture described herein are not limited in this regard.

Each inner support portion of the second set of inner support portions 3140 may include walls, ribs and/or any projections on the inner surface 2344 of the bottom portion 2340. Each inner support portion of the second set of inner support portions 3140 (generally shown as inner support portions 3141, 3142, 3143, 3144, 3145, and 3146) may extend from one or more of the weight ports 2800 toward the periphery and/or the skirt portion 2390 of the body portion 2310. In one example shown in FIG. 31, each inner support portion of the second set of inner support portions 3140 is shown to extend from a corresponding weight port of the weight ports 2800 to the toe portion, the toe and rear portion, the rear portion, the heel and rear portion and the heel portion, respectively. The length, height, thickness, orientation angle, and/or cross-sectional configuration of each of the inner support portions 3141, 3142, 3143, 3144, 3145 and/or 3146 may be configured such that the inner support portions 3141, 3142, 3143, 3144, 3145 and/or 3146 may provide or substantially provide structural support to the bottom portion 2340, the skirt portion 2390, the toe portion 2350, the heel portion 2360, the front portion 2370 and/or the rear portion 2380. The apparatus, methods, and articles of manufacture described herein are not limited in this regard. The apparatus, methods, and articles of manufacture described herein are not limited in this regard.

The first set of inner support portions 3120 may structurally support the bottom portion 2340 by distributing the impact loads exerted on the bottom portion 2340 throughout the bottom portion 2340 when the golf club head 2300 strikes a golf ball (not shown). The second set of inner support portions 3140 may further distribute the impact loads throughout the bottom portion 2340, the skirt portion 2390, toe portion 2350, the heel portion 2360, the front portion 2370, and/or the rear portion 2380. In one example, the second set of inner support portions 3140 may include additional walls, ribs and/or projections (not shown) that connect to any of the weight ports such as weight ports 2840, 2850 and 2860 to further distribute impact loads throughout the body portion 2310. While the above examples may depict a particular number of inner support portions, the bottom portion 2340 may include additional inner support portions (not shown). For example, the bottom portion 2340 may include a plurality of inner support portions (not shown) that connect non-adjacent weight ports 2800 (e.g., weight ports 2815 and 2860) and/or the second set of inner support portions 3140. The apparatus, methods, and articles of manufacture described herein are not limited in this regard.

The width (i.e., thickness), length, height, orientation angle, and/or cross-sectional shape of the inner support portions of the first set of inner support portions 3120 and/or the second set of inner support portions 3140 may be similar or vary and be configured to provide structural support to the golf club head 2300. For example, the materials from which the bottom portion 2340 and/or the body portion 2310 may be constructed may determine the width, length, height, orientation angle, and/or cross-sectional shape of the inner support portions of the first set of inner support portions 3120 and/or the second set of inner support portions 3140. For example, the inner support portions of the first set of inner support portions 3120 and/or the second set of inner support portions 3140 may be defined by walls with rectangular cross sections having heights that are similar to the depths of the weight portions 2800. The length of each inner support portion of the second set of inner support portions 3140 may be configured such that one or more inner support portions of the second set of inner support portions 3140 extend from the bottom portion 2340 to the skirt portion 2390. The apparatus, methods, and articles of manufacture described herein are not limited in this regard.

Any of the golf club heads described herein may have different configurations of outer support portions and/or inner support portions to provide structural support for the golf club head during impact with a golf ball depending on the size, thickness, materials of construction and/or other characteristics of any portions and/or parts of the golf club head. The different configurations of the outer support portions and/or inner support portions may affect vibration, dampening, and/or noise characteristics of the golf club head when striking a golf ball. Further, the different configurations of the outer support portions and/or the inner support portions may provide structural support to portions of the golf club head that may require additional structural support. For example, a golf club head as described herein may include more inner support portions in addition to the first set of inner support portions and the second set of inner support portions as described herein. For example, a golf club head as described herein may include fewer inner support portions than the first set of inner support portions and the second set of inner support portions as described herein.

Figure 33:
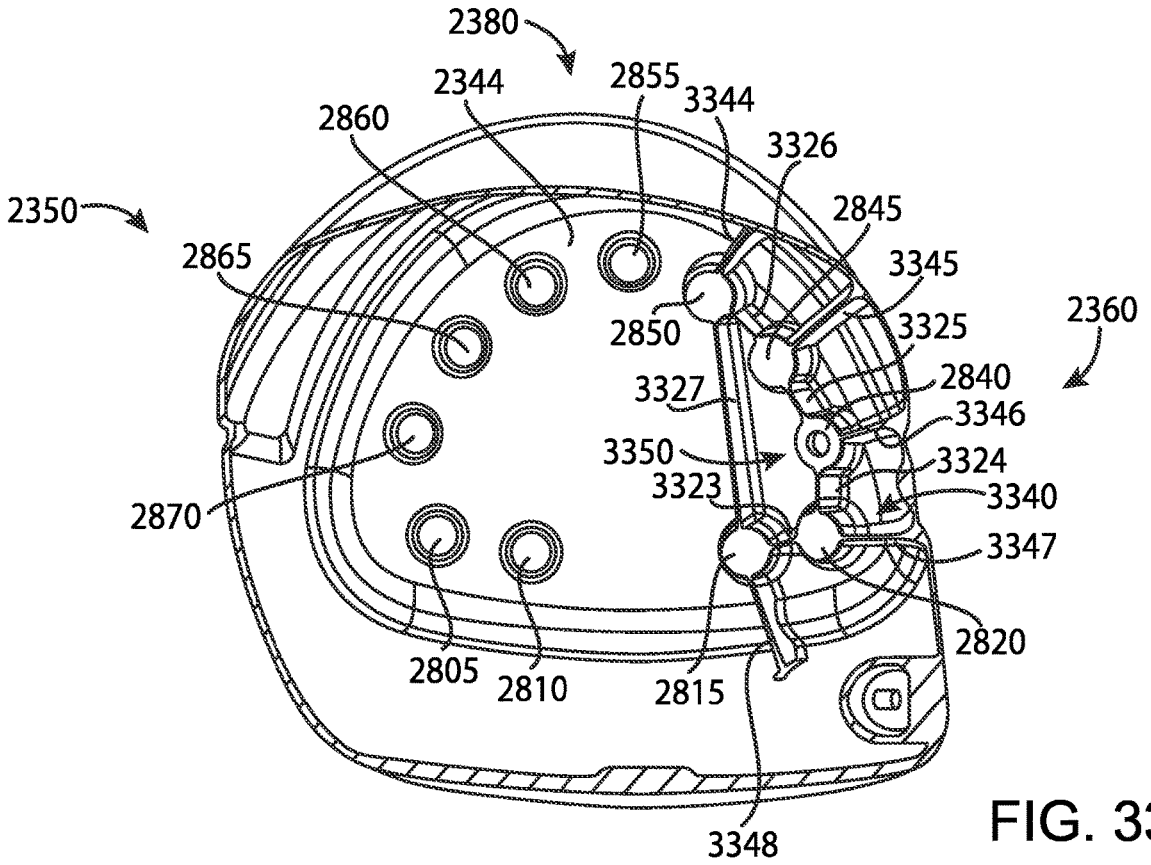
FIG. 33 depicts a cross-sectional view of an example golf club head of FIG. 23 taken at section line 31-31 of FIG. 29 according to an embodiment of the apparatus, methods, and articles of manufacture described herein.
Figure 34:
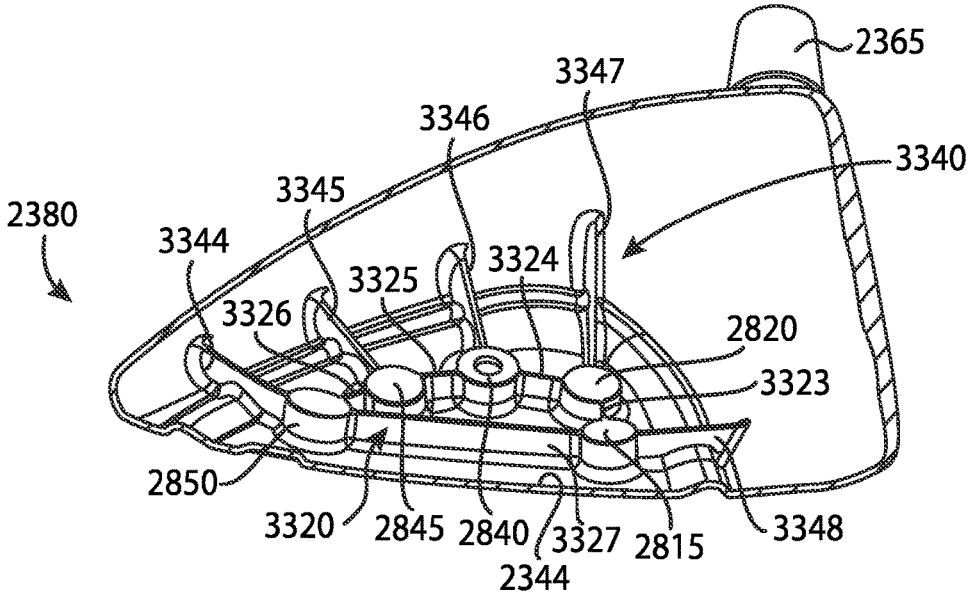
FIG. 34 depicts a cross-sectional view of the golf club head of FIG. 33 taken at section line 32-32 of FIG. 25.

FIGS. 33 and 34 show another example of the golf club head 2300 with a different configuration of inner support portions. The inner surface 2344 of the bottom portion 2340 may include a first set of inner support portions 3320 (generally shown as inner support portions 3323, 3324, 3325, 3326, and 3327), and a second set of inner support portions 3340 (generally shown as inner support portions 3344, 3345, 3346, 3347 and 3348). The first set of inner support portions 3320 and the second set of inner support portions 3340 are closer to the heel portion 2360 than to the toe portion 2350. For example, the first set of inner support portions 3320 and the second set of inner support portions 3340 may be located on the bottom portion 2340 between a midpoint (not shown) of the body portion 2310 and the heel portion 2360. The apparatus, methods, and articles of manufacture described herein are not limited in this regard.

The first set of inner support portions 3320 may be similar in many respects to any of the inner support portions described herein such as the inner support portions of the first set of inner support portions 3120 shown in FIG. 31. The inner support portions 3323 through 3327 of the first set of inner support portions 3320 may define a loop-shaped support region 3350 on the inner surface 2344 of the bottom portion 2340. The loop-shaped support region 3350 may be closer to the heel portion 2360 than to the toe portion 2350. The loop-shaped support region 3350 may be located between a midpoint (not shown) of the body portion 2310 and the heel portion 2360. The apparatus, methods, and articles of manufacture described herein are not limited in this regard.

The second set of inner support portions 3340 may be similar in many respects to any of the inner support portions described herein such as the second set of inner support portions 3140 shown in FIG. 31. As shown in FIGS. 33 and 34, for example, each of the inner support portion 3344, 3345, 3346, 3347, and 3348 may include a wall connected to the weight port 2850, 2845, 2840, 2820 and 2815, respectively, and extend outward from the corresponding weight port toward and/or to the periphery of the bottom portion 2340. The length, height, thickness, orientation angle, and/or cross-sectional configuration of each of the inner support portions 3344, 3345, 3346, 3347 and 3348 may be configured such that the inner support portions 3344, 3345, 3346, 3347 and 3348 may provide or substantially provide structural support to the bottom portion 2340, the skirt portion 2390, the heel portion 2360, the front portion 2370 and/or the rear portion 2380. The apparatus, methods, and articles of manufacture described herein are not limited in this regard.

Figure 35:
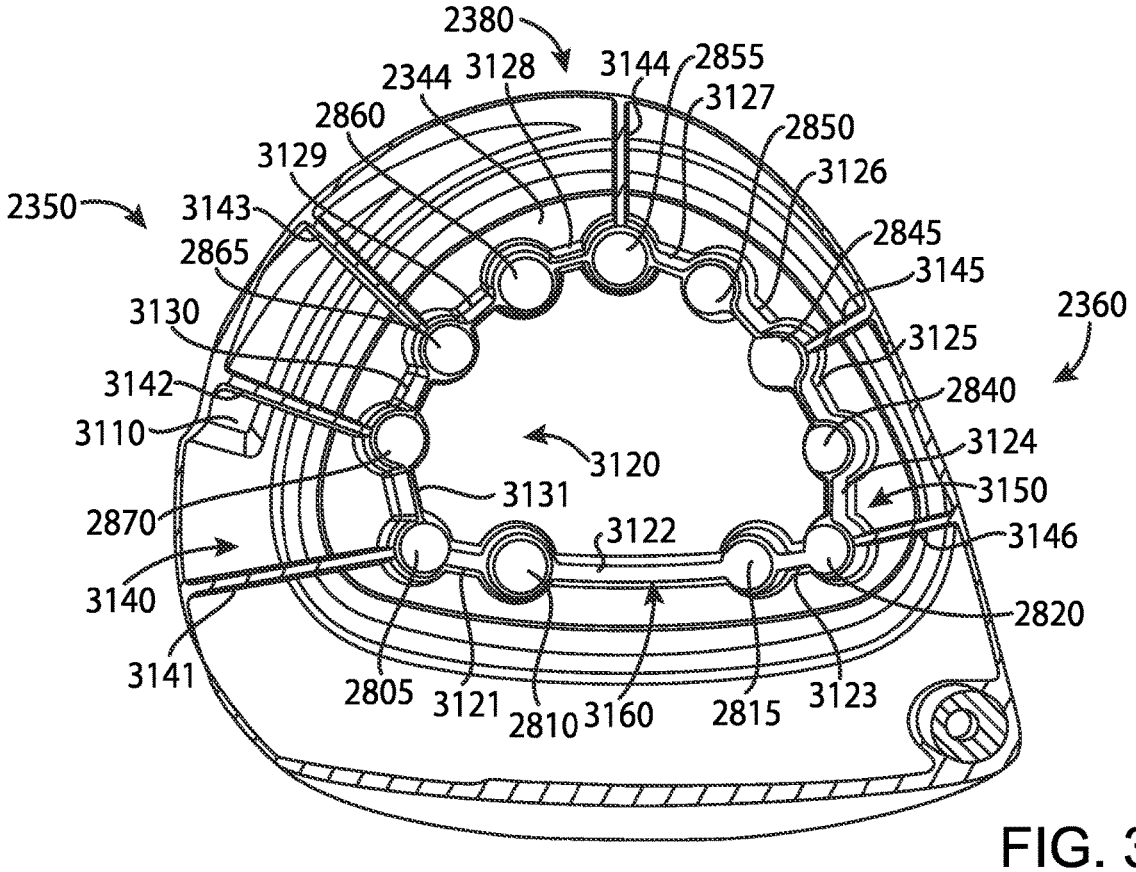
FIG. 35 depicts a cross-sectional view of an example golf club head of FIG. 23 taken at section line 31-31 of FIG. 29 according to an embodiment of the apparatus, methods, and articles of manufacture described herein.

FIG. 35 shows another example of the golf club head 2300 with a different configuration of the inner support portions. The inner surface 2344 may include a first set of inner support portions 3120 (generally shown as inner support portions 3121, 3122, 3123, 3124, 3125, 3126, 3127, 3128, 3129, 3130 and 3131), and a second set of inner support portions 3140 (generally shown as inner support portions 3141, 3142, 3143, 3144, 3145, and 3146). Accordingly, the golf club head 2300 of FIG. 43 may be similar to the golf club head 2300 of FIG. 31, except that the golf club head 2300 of FIG. 43 does not include the inner support portions 3132 and 3133. The apparatus, methods, and articles of manufacture described herein are not limited in this regard.

In addition to any of the golf club heads described herein having different configurations of outer support portions and/or inner support portions, any of the golf club heads described herein may have different configurations of weight ports in combination with different configurations of the outer support portions and/or the inner support portions. The different configurations of the weight ports may affect the weight distribution of the golf club head. The different configurations of the outer support portions and/or inner support portions may affect stiffness, vibration, dampening, and/or noise characteristics of the golf club head when striking a golf ball. Further, the different configurations of the outer support portions and/or the inner support portions may provide structural support to portions of the golf club head that may require additional structural support. For example, a golf club head as described herein may include more or less weight ports than some of the example golf club heads described herein. For example, a golf club head as described herein may include more inner support portions in addition to the first set of inner support portions and the second set of inner support portions as described herein. For example, a golf club head as described herein may include fewer inner support portions than the first set of inner support portions and the second set of inner support portions as described herein. The apparatus, methods, and articles of manufacture described herein are not limited in this regard.

FIG. 36 shows another example of the golf club head 2300 with a different configuration of the weight ports and different configuration of inner support portions. The bottom portion 2340 may include a plurality of weight ports 2800, which are generally shown as 2805, 2810, 2815, 2820, 2845, 2850, 2855, 2860, and 2865. Accordingly, the golf club head 2300 of FIG. 36 is similar to the golf club head 2300 of FIG. 31, except that the golf club head 2300 of FIG. 36 does not include weight ports 2840 and 2870. Also, in the example of FIG. 36, the inner surface 2344 of the bottom portion 2340 may include a first set of inner support portions 3120 (generally shown as inner support portions 3121, 3122, 3123, 3126, 3127, 3128, and 3129), and a second set of inner support portions 3140 (generally shown as inner support portions 3141, 3143, 3144, 3145, and 3146). Accordingly, the golf club head 2300 of FIG. 36 may be similar to the golf club head 2300 of FIG. 31, except that the golf club head 2300 of FIG. 36 does not include the inner support portions 3124, 3125, 3130, 3131, 3132, 3133 and 3142. The apparatus, methods, and articles of manufacture described herein are not limited in this regard.

In one example shown in FIG. 37, certain regions of the interior of the body portion 2310 of the golf club head 2300 may include an elastic polymer material or an elastomer material, which may be referred to herein as the filler material. The filler material may dampen vibration, dampen noise, lower the center of gravity and/or provide a better feel and sound for the golf club head 2300 when striking a golf ball (not shown). According to one example, the triangular support region 3160 may be filled with the filler material. According to another example, a support region 3161 defined by the inner support portions 3128, 3129, 3130, 3131 and 3132; and a support region 3162 defined by the inner support portions 3124, 3125, 3136, 3137 and 3133 may be filled with the filler material. The filler material may extend from the inner surface 2344 of the bottom portion 2340 up to a height of any of the inner support portions that may define the support regions 3160, 3161 and/or 3162. However, the filler material may extend below or above the height of any of the inner support portions. Further, the thickness of the filler material, which may be defined as the distance the filler material extends from the inner surface 2344 of the bottom portion 2340, may be constant or vary for the support regions 3160, 3161 and/or 3162. The apparatus, methods, and articles of manufacture described herein are not limited in this regard.

In one example shown in FIG. 38, which is similar to many respects to the golf club head 2300 shown in FIG. 33, the support region 3350 may be filled with the filler material. The filler material, which may be an elastic polymer material or an elastomer material as described herein, may extend from the inner surface 2344 of the bottom portion 2340 up to a height of any of the inner support portions 3323, 3324, 3325, 3326 and/or 3327. The filler material may dampen vibration, dampen noise, lower the center of gravity and/or provide a better feel and sound for the golf club head 2300 when striking a golf ball (not shown). The apparatus, methods, and articles of manufacture described herein are not limited in this regard.

Any of the golf club heads described herein may have one or more interior regions that may include a filler material as described. In one example, the filler material may be injected into a region of the golf club head from one or more ports on the golf club head to cover or fill the region. The one or more ports that may be used to inject the filler material may be one or more of the weight ports described herein. Accordingly, the filler material may be molded to the shape of the region in which the filler material is injected to cover or fill the region. Alternatively, one or more inserts may be formed from elastic polymer material or an elastomer material (i.e., filler material) and placed in one or more regions of the interior of golf club head. FIG. 39 shows an example of the golf club head 2300 of FIG. 36 with an insert 3950, which may be constructed from an elastic polymer material or an elastomer material. The insert 3950 may be manufactured to have a similar shape as the shape of a region 3954 on the inner surface 2344 of the bottom portion 2340. Accordingly, the insert 3950 may have a curvature similar to the curvature of the bottom portion 2340 at the region 3954 to lay generally flat and in contact with the inner surface 2344 of the bottom portion 2340, have a shape that may be similar to the shape of the region 3954 to be inserted in the region 3954 and generally fit within the region 3954, and/or have a plurality of cutout portions 3956 to generally match the shape and/or contour of sidewall portions of each of the weight ports 2800. The apparatus, methods, and articles of manufacture described herein are not limited in this regard.

The insert 3950 may have a thickness that may be similar to the height of any of the weight ports 2800. Accordingly, when the insert 3950 is in the region 3954, the top portion of the insert 3950 at or proximate to the weight ports 2800 may be at the same height or substantially the same height as the weight ports 2800. However, the thickness of the insert 3950 may be constant or vary such that the thickness of the insert 3950 at any location of the insert 3950 may be more or less than the height of any of the weight ports 2800. The insert 3950 may dampen vibration, dampen noise, lower the center of gravity and/or provide a better feel and sound for the golf club head 2300 of FIG. 39 when striking a golf ball (not shown). The apparatus, methods, and articles of manufacture described herein are not limited in this regard.

The insert 3950 may be manufactured for use with any of the golf club heads described herein. As shown in FIG. 39, the insert 3950 may include a plurality of cutout portions 3956 that may generally match the shape of the outer wall portions of the weight ports 2800. The insert 3950 shown in FIG. 39 further includes cutout portions 3958 and 3959. Referring back to FIG. 35, when the insert 3950 is used with the golf club head 2300 of FIG. 35, the cut out portions 3958 and 3959 may generally match the shape of the outer wall portions of the weigh ports 2870 and 2840, respectively. Accordingly, the insert 3950 can be used in both the golf club head 2300 of FIG. 35 and the golf club head 2300 of FIG. 36. The apparatus, methods, and articles of manufacture described herein are not limited in this regard.

Referring back to FIG. 31, the insert 3950 may include channels, grooves or slots (not shown) that may be sized and shaped to receive the inner support portions 3132 and 3133 therein. Accordingly, an insert 3950 may be manufactured with the described channels, grooves or slot for use with the golf club heads 2300 of FIGS. 31, 33, 35 and 36. Alternatively, one or more inserts may be manufactured that may only fit one of the golf club heads described herein. For example, each of the golf club heads described herein may include one or more inserts that may have a certain shape for fitting only within one or more regions in the golf club head. Referring back to FIG. 31, for example, the golf club head 2300 may include a first insert (not shown) for fitting in the support region 3161, a second insert (not shown) for fitting in the triangular support region 3160, and a third insert (not shown) for fitting in the support region 3162. Referring back to FIG. 33, for example, the golf club head 3300 may include an insert (not shown) for fitting in the support region 3350. The apparatus, methods, and articles of manufacture described herein are not limited in this regard.

Any of the inserts described herein may be manufactured from an elastic polymer material as a one-piece continuous part. In the example of FIG. 39, the insert 3950 may be a one-piece continuous part without any recesses and/or holes. FIG. 40 illustrates an insert 4050 that is similar in many respects to the insert 3950. Accordingly, in one example, the insert 4050 may be manufactured to have a similar shape as the shape of the region 3954 on the inner surface 2344 of the bottom portion 2340 of the golf club head 23 of FIG. 39 and further include a plurality of cutout portions 4056 similar to the cutout portions 3956, 3958 and 3959 as described herein. The insert 4050 further includes a plurality of holes 4062 that may reduce the weight of the insert 4050 and/or the amount of material used for the construction of the insert 4050. The insert 4050 may include any number of holes 4062 arranged in any configuration on the insert 4050. In the example of FIG. 40, the insert 4050 includes a plurality of hexagonal holes 4062 that extend through the thickness of the insert 4050 and are arranged on the insert 4050 to define a pattern similar to a honeycomb pattern. The holes 4062 may have any shape or spacing. Although the above example may describe holes having a particular shape, the apparatus, methods, and articles of manufacture described herein may include holes of other suitable shapes (e.g., circular, triangular, octagonal, or other suitable geometric shape). Further, the holes 4062 may be similar or different in shape, size and/or arrangement on the insert 4050. In one example, the insert 4050 may include a plurality of round holes (not shown). In another example, the insert 4050 may include a plurality of slots, grooves and/or slits (not shown). In yet another example, the insert 4050 may include recesses (not shown) that do not extend through the insert 4050. The apparatus, methods, and articles of manufacture described herein are not limited in this regard.

Any of the filler materials and or inserts described herein may be a polymer material, an elastic polymer or elastomer material (e.g., a viscoelastic urethane polymer material such as Sorbothane® material manufactured by Sorbothane, Inc., Kent, Ohio), a thermoplastic elastomer material (TPE), a thermoplastic polyurethane material (TPU), and/or other suitable types of materials to absorb shock, isolate vibration, and/or dampen noise. In another example, the filler material may be a high density ethylene copolymer ionomer, a fatty acid modified ethylene copolymer ionomer, a highly amorphous ethylene copolymer ionomer, an ionomer of ethylene acid acrylate terpolymer, an ethylene copolymer comprising a magnesium ionomer, an injection moldable ethylene copolymer that may be used in conventional injection molding equipment to create various shapes, an ethylene copolymer that can be used in conventional extrusion equipment to create various shapes, and/or an ethylene copolymer having high compression and low resilience similar to thermoset polybutadiene rubbers. For example, the ethylene copolymer may include any of the ethylene copolymers associated with DuPont™ High-Performance Resin (HPF) family of materials (e.g., DuPont™ HPF AD1172, DuPont™ HPF AD1035, DuPont® HPF 1000 and DuPont™ HPF 2000), which are manufactured by E.I. du Pont de Nemours and Company of Wilmington, Delaware. The DuPont™ HPF family of ethylene copolymers may be injection moldable and may be used with conventional injection molding equipment and molds, provide low compression, and provide high resilience. The apparatus, methods, and articles of manufacture described herein are not limited in this regard.

The filler material including any of the inserts that may be manufactured from the filler material as described herein may be bonded, attached and/or connected to any of the golf club heads described herein by a bonding portion (not shown) to improve adhesion and/or mitigate delamination between the body portion of any of the golf club heads described herein and the filler material. The bonding portion may be a bonding agent, an epoxy, a combination of bonding agents, a bonding structure or attachment device, a combination of bonding structures and/or attachment devices, and/or a combination of one or more bonding agents, one or more bonding structures and/or one or more attachment devices. In one example, the bonding portion may be low-viscosity, organic, solvent-based solutions and/or dispersions of polymers and other reactive chemicals such as MEGUM™, ROBOND™, and/or THIXON™ materials manufactured by the Dow Chemical Company, Auburn Hills, Michigan. In another example, the bonding portion may be LOCTITE® materials manufactured by Henkel Corporation, Rocky Hill, Connecticut. The apparatus, methods, and articles of manufacture are not limited in this regard.

In the example of FIGS. 41-47, a golf club head 4100 may include a body portion 4110 with a top portion 4130, a bottom portion 4140, a toe portion 4150, a heel portion 4160, a front portion 4170, and a rear portion 4180. The bottom portion 4140 may include a skirt portion (not shown) defined as a side portion of the golf club head 4100 between the top portion 4130 and the bottom portion 4140 excluding the front portion 4170 and extending across a periphery of the golf club head 4100 from the toe portion 4150, around the rear portion 4180, and to the heel portion 4160. The bottom portion 4140 may include a transition region 4230 and a weight port region 4240. The transition region 4230 may be defined by a groove or a channel on the bottom portion 4140. Further, the transition region 4230 may define the boundary of the weight port region 4240. The front portion 4170 may include a face portion 4175 to engage a golf ball (not shown). The body portion 4110 may also include a hosel portion 4165 that may be similar in many respects to any of the hosel portions described herein. Alternatively, the body portion 4110 may include a bore (not shown) instead of the hosel portion 4165. The body portion 4110 may be made partially or entirely from any of the materials described herein. Further, the golf club head 4100 may be any type of golf club head having a club head volume similar to the club head volume of any of the golf club heads described herein. The apparatus, methods, and articles of manufacture described herein are not limited in this regard.

The body portion 4110 may include a plurality of weight portions 4120 (FIG. 42), generally, shown as a first set of weight portions 4210 (generally shown as weight portions 4405, 4410, 4415, 4420 and 4425) and a second set of weight portions 4220 (generally shown as weight portions 4445, 4450, 4455, 4460 and 4465). The weight port region 4240 may have a shape similar to the weight port regions of any of the golf club heads described herein. The weight port region 4240 may include a plurality of weight ports 4600 (generally shown as weight ports 4605, 4610, 4615, 4620, 4625, 4645, 4650, 4655, 4660 and 4665) to receive the plurality of weight portions 4120. The characteristics (e.g., density, shape, volume, size, color, dimensions, depth, diameter, materials of construction, mass, method of formation, etc.), location on the golf club head (e.g., location relative to the periphery of the golf club head and/or location relative to other weight portions and/or weight ports), and/or any other properties of each weight portion of the plurality of weight portions 4120 and each weight port of the plurality of weight ports 4600 may be similar in many respects to each weight portion and weight port, respectively, of any of the golf club heads described herein. The apparatus, methods, and articles of manufacture described herein are not limited in this regard.

The outer surface 4142 and/or the inner surface 4144 of the bottom portion 4140 may include one or a plurality of support portions similar to any of the inner or outer support portions described herein. The outer surface 4142 may include at least one outer support portion 4310. The outer support portion 4310 may be similar in many respects including the function thereof to the outer support portion 3110 of the golf club head 2300. The apparatus, methods, and articles of manufacture described herein are not limited in this regard.

The inner surface 4144 may include an inner support portion 4320, which may be also referred to herein as the inner wall portion 4320. The inner support portion 4320 may include a wall, a rib and/or any projection extending from the inner surface 4144 of the bottom portion 4140. The inner support portion 4320 may extend around some or all of the weight ports 4600 to partially or fully surround the weight ports 4600. In the example of FIGS. 41-46, the inner support portion 4320 fully surrounds the weight ports 4600. Accordingly, the inner support portion 4320 may define an inner port region 4325 on the inner surface 4144 of the bottom portion 4140. The inner support portion 4320 may structurally support the bottom portion 4140 by distributing the impact loads exerted on the bottom portion 4140 throughout the bottom portion 4140 when the golf club head 100 strikes a golf ball (not shown). While the above examples may depict a particular inner support portion, the bottom portion 4140 may include additional inner support portions and/or any type of support portions (not shown). The apparatus, methods, and articles of manufacture described herein are not limited in this regard.

The width (i.e., thickness), length, height, orientation angle, and/or cross-sectional shape of the inner support portion 4320 may be similar or vary along the length of the inner support portion 4320 and be configured to provide structural support to the golf club head 4100. For example, characteristics of the body portion 4110 and/or the bottom portion 4140 including the materials from which the bottom portion 4140 and/or the body portion 4110 is constructed may determine the width, length, height, orientation angle, and/or cross-sectional shape of the inner support portion 4320 along the length of the inner support portion 4320. In one example, the inner support portion 4320 may be defined by a wall having a height that may be similar to the depths of the weight portions 4600. In another example, the inner support portion 4320 may be defined by a wall having a height that may be greater than the depths of the weight portions 4600. In yet another example, the inner support portion 4320 may be defined by a wall having a height that may be smaller than the depths of the weight portions 4600.

The apparatus, methods, and articles of manufacture described herein are not limited in this regard.

In one example shown in FIG. 45, certain regions of the interior of the body portion 4110 of the golf club head 4100 may include a polymer material, an elastic polymer material or an elastomer material, which may be referred to herein as the filler material 4510. The filler material 4510 may dampen vibration, dampen noise, lower the center of gravity and/or provide a better feel and sound for the golf club head 4100 when striking a golf ball (not shown). According to one example, the inner port region 4325, which may be defined by the inner surface 4144 of the bottom portion 4140 and the inner support portion 4320, may partially or fully include the filler material 4510. The filler material 4510 may extend from the inner surface 4144 of the bottom portion 4140 up to the height of the inner support portion 4320 at any location on the inner support portion 4320. However, the filler material 4510 may extend below or above the inner support portion 4320 at any location on the inner support portion 4320. Accordingly, if the height of the inner support portion 4320 is greater than or equal to the depth of the weight ports 4600, the weight ports 4600 may be surrounded and/or covered by the filler material 4510, respectively, which may provide vibration dampening, noise dampening, and/or a better feel and sound for the golf club head 4100 when striking a golf ball (not shown). The height or thickness of the filler material 4510 in the inner port region 4325 may be constant or may vary. The apparatus, methods, and articles of manufacture described herein are not limited in this regard.

Any of the golf club heads described herein, including the golf club head 4100, may have one or more interior regions that may include a filler material as described herein. In one example, the filler material 4510 may be injected into the inner port region 4325 of the body portion 4110 from one or more of the weight ports 4600. In the example of FIGS. 41-46, each of the weight ports 4615 and 4655 may include an opening 4616 and 4656, respectively, into the inner port region 4325 or the interior of the body portion 4110. Accordingly, the openings 4616 and 4656 may be used to inject the filler material 4510 into the inner port region 4325. In one example, one of the openings 4616 or 4656 may be used to inject filler material into inner port region 4325, while the other opening 4656 or 4616, respectively, may be used for the air that is displaced by the filler material injected into the body portion 4110 to escape. The inner support portion 4320 may provide a boundary or a holding perimeter for the filler material 4510 when the filler material 4510 is injected into the body portion 4110. The filler material 4510 may be injected into the inner port region 4325 until the height of the filler material 4510 is similar, substantially similar, or greater than to the height of the inner support portion 4320. Accordingly, the filler material may be molded to the shape of the inner port region 4325. Alternatively, the inner port region 4325 may be partially filled with the filler material 4510. The apparatus, methods, and articles of manufacture described herein are not limited in this regard.

Alternatively, one or more inserts may be formed from an elastic polymer material or an elastomer material (e.g., filler material) and placed in one or more regions of the interior of golf club head. FIG. 46 shows an example of the golf club head 4100 of FIG. 41 with an insert 4750, which may be constructed from an elastic polymer material or an elastomer material. The insert 4750 may be manufactured to have a similar shape as the shape of the inner port region 4325. Accordingly, the insert 4750 may have a curvature similar to the curvature of the bottom portion 4140 at the inner port region 4325 to lie generally flat and in contact with the inner surface 4144 of the bottom portion 4140. The insert 4750 may have a shape that may be similar to the shape of the inner port region 4325 to be inserted in the inner port region 4325 and generally fit within the inner port region 4325. Further, the insert 4750 may be surrounded and/or in contact with the inner support portion 4320. The inner support portion 4320 may engage all or portions of the perimeter of the insert 4750 to assist in maintaining the insert in the inner port region 4325 or maintain the insert in the inner port region 4325. The insert 4750 may have a plurality of cutout portions 4756 to generally match the shape and/or contour of the sidewall portions of each of the weight ports 4600. Accordingly, when the insert 4750 is placed in the inner port region 4325, each port of the plurality of weight ports 4600 is received in a corresponding cutout portion 4756. The apparatus, methods, and articles of manufacture described herein are not limited in this regard.

The insert 4750 may have a thickness that may be similar or substantially similar to the height of any of the weight ports 4600. Accordingly, when the insert 4750 is in the inner port region 4325, the top portion of the insert 4750 at or proximate to the weight ports 4600 may be at the same or substantially the same height as the weight ports 4600. However, the thickness of the insert 4750 may vary such that the thickness of the insert 4750 at any location of the insert 4750 may be more or less than the height of any of the weight ports 4600. The insert 4750 may dampen vibration, dampen noise, lower the center of gravity and/or provide a better feel and sound for the golf club head 4100 when striking a golf ball (not shown). The apparatus, methods, and articles of manufacture described herein are not limited in this regard.

Any of the inserts described herein may be manufactured from an elastic polymer material as a one-piece continuous part. The insert 4750 may be a one-piece continuous part without any recesses and/or holes. According to the example shown in FIG. 47, the insert 4750 may include a plurality of holes 4762 that may reduce the weight of the insert 4750. The insert 4750 may include any number of holes arranged in any configuration on the insert 4750. In the example of FIG. 47, the insert 4750 includes a plurality of hexagonal holes 4762 that extend through the thickness of the insert 4750 and are arranged on the insert 4750 to define a pattern that is similar to a honeycomb pattern. The holes 4762 may have any shape or spacing. In the example of FIG. 48, the insert 4750 also includes a plurality of holes, which may be the hexagonal holes 4762 similar to the example of FIG. 47, and a center hole 4862 that may larger than the hexagonal holes 4762 or the cut-out portions 4756. The center hole 4862 may have any size, shape or configuration. In the example of FIG. 48, the center hole 4862 has a shape that may generally resemble the perimeter shape of the insert 4750. The insert 4750 may include any number of larger or smaller holes than the center hole 4862, the hexagonal holes 4762 and/or the cut-out portions 4756. Although the above example may describe holes having a particular shape, the apparatus, methods, and articles of manufacture described herein may include holes of other suitable shapes (e.g., circular, triangular, octagonal, or other suitable geometric shape). Further, the openings may be similar or different in shape, size and or arrangement on the insert 4750. In one example, the insert 4750 may include a plurality of round holes (not shown). In another example, the insert 4750 may include a plurality of slots, grooves and/or slits (not shown). In yet another example, the insert 4750 may include recesses (not shown) instead of holes that do not extend through the insert 4750. The apparatus, methods, and articles of manufacture described herein are not limited in this regard.

The filler material 4510 and or the insert 4750 may be manufactured from any of the materials described herein. The filler material 4510 or the insert 4750 may be bonded, attached and/or connected to the body portion 4110 of the golf club head 4100 by a bonding portion (not shown) to improve adhesion and/or mitigate delamination between the body portion 4110 and the filler material 4510 or the insert 4750. Further, as described herein, the inner support portion 4320 may engage the insert 4750 to partially or fully maintain the insert 4750 in the inner port region 4325. In one example, the insert 4750 may be maintained in the inner port region 4325 by frictionally engaging the inner support portion 4320 and/or a bonding portion bonding the insert 4750 to the inner support portion 4320 and/or the inner surface 4144 of the bottom portion 4140. The bonding portion may be any of the bonding portions described herein such as a bonding agent, an epoxy, a combination of bonding agents, a bonding structure or attachment device, a combination of bonding structures and/or attachment devices, and/or a combination of one or more bonding agents, one or more bonding structures and/or one or more attachment devices. The apparatus, methods, and articles of manufacture described herein are not limited in this regard.

In the example of FIGS. 50-54, a golf club head 4900 may include a body portion 4910 with a top portion 4930, a bottom portion 4940, a toe portion 4950, a heel portion 4960, a front portion 4970, and a rear portion 4980. The bottom portion 4940 may include a skirt portion (not shown) defined as a side portion of the golf club head 4900 between the top portion 4930 and the bottom portion 4940 excluding the front portion 4970 and extending across a periphery of the golf club head 4900 from the toe portion 4950, around the rear portion 4980, and to the heel portion 4960. The bottom portion 4940 may include one or more weight port regions. For example, the bottom portion 4940 may include a first weight port region 5040 and a second weight port region 5050. The front portion 4970 may include a face portion 4975 to engage a golf ball (not shown). The body portion 4910 may also include a hosel portion 4965 that may be similar in many respects to any of the hosel portions described herein. Alternatively, the body portion 4910 may include a bore (not shown) instead of the hosel portion 4965. The body portion 4910 may be made partially or entirely from any of the materials described herein. Further, the golf club head 4900 may be any type of golf club head having a club head volume similar to the club head volume of any of the golf club heads described herein. The apparatus, methods, and articles of manufacture described herein are not limited in this regard.

The body portion 4910 may include a plurality of weight portions, generally shown as a first set of weight portions 5010 (generally shown as weight portions 5205, 5210, and 5215) and a second set of weight portions 5020 (generally shown as weight portions 5245, 5250, and 5255). The first weight port region 5040 may include a plurality of weight ports (generally shown 5405, 5410 and 5415) and the second weight port region 5050 may include a plurality of weight ports (generally shown as 5445, 5450 and 5455). Each weight port of the first weight port region 5040 and the second weight port region 5050 may receive a weight portion of the first of weight portions 5010 or the second set of weight portions 5020. The characteristics (e.g., density, shape, volume, size, color, dimensions, depth, diameter, materials of construction, mass, method of formation, etc.), and/or any other properties of each weight portion of the plurality of weight portions may be similar in many respects to each weight portion of any of the golf club heads described herein. The apparatus, methods, and articles of manufacture described herein are not limited in this regard.

The first weight port region 5040 may be located on the bottom portion 4940 at or near the rear portion 4980. All or portions of the first weight port region 5040 may have a greater thickness than the thickness of the bottom portion 4940 to project into the body portion 4910 as shown in FIG. 54 and/or project from the outer surface 4942 of the bottom portion 4940 as shown in FIG. 52. Accordingly, a portion of the first weight port region 5040 extending into the body portion 4910 may define a first inner support portion 5120 on the inner surface 4944 of the bottom portion 4940. The first inner support portion 5120 may include an inner wall 5121 projecting into the body portion 4910 from the inner surface of 4944 of the bottom portion 4940. Accordingly, the inner wall 5121 may define a boundary of the first inner support portion 5120 inside the body portion 4910. The first inner support portion 5120 may have a shape corresponding to the shape of the portion of the first weight port region 5040 extending into the body portion 4910. In one example, as shown in FIG. 54, portions of the first inner support portion 5120 such as the inner wall 5121 may define the boundaries of the weight ports 5405, 5410 and 5415. Accordingly, portions of the first inner support portion 5120 may partially define walls of the weight ports 5405, 5410 and 5415. In one example, only the weight ports 5405, 5410 and 5415 of the first weight port region 5040 may project into the body portion 4910 similar to the weight ports of any of the golf club heads described herein. The apparatus, methods, and articles of manufacture described herein are not limited in this regard.

The second weight port region 5050 may be located on the bottom portion 4940 at or near the heel portion 4960. All or portions of the second weight port region 5050 may have a greater thickness than the thickness of the bottom portion 4940 to project into the body portion 4910 as shown in FIG. 54 and/or project from the outer surface 4942 of the bottom portion 4940 (not shown). Accordingly, a portion of the second weight port region 5050 extending into the body portion 4910 may define a second inner support portion 5122 on the inner surface 4944 of the bottom portion. The second inner support portion 5122 may include an inner wall 5123 projecting into the body portion 4910 from the inner surface of 4944 of the bottom portion 4940. Accordingly, the inner wall 5123 may define a boundary of the second inner support portion 5122 inside the body portion 4910. The second inner support portion 5122 may have a shape corresponding to the shape of the portion of the second weight port region 5050 extending into the body portion 4910. In one example, as shown in FIG. 54, portions of the second inner support portion 5122 may define the boundaries of the weight ports 5445, 5450 and 5455. Accordingly, portions of the second inner support portion 5122 may partially define walls of the weight ports 5445, 5450 and 5455. In one example, only the weight ports 5445, 5450 and 5455 of the second weight port region 5050 may project into the body portion 4910 similar to the weight ports of any of the golf club heads described herein. The apparatus, methods, and articles of manufacture described herein are not limited in this regard.

The body portion 4910 includes a third inner support portion 5124 that extends from the heel portion 4960 to a region of the bottom portion 4940 or the skirt portion (not shown) between the rear portion 4980 and the toe portion 4950. The third inner support portion 5124 may be defined by a wall projecting into the body portion 4910 from the inner surface 4944 of the bottom portion 4940. The third inner support portion 5124 may have any shape and have any path on the inner surface 4944 of the bottom portion 4940. In one example, as shown in FIG. 54, the third inner support portion 5124 extends from a location at or near the heel portion 4960 between the second weight port region 5050 and the face portion 4975 generally toward the toe portion 4950 past the second weight port region 5050. The third inner support portion 5124 then extends toward the rear portion 4980 to a location between the first weight port region 5040 and the second weight port region 5050 while maintaining a certain distance with the second weight port region 5050. The third inner support portion 5124 then extends generally toward the toe portion 4950 and past the first weight port region 5040 while maintaining a certain distance with the first weight port region 5040. The third inner support portion 5124 may then terminate at or proximate to a location on the body portion 4910 between the rear portion 4980 and the toe portion 4950. The distance between the third inner support portion 5124, the inner wall 5123 of the second inner support portion 5122, the inner wall 5121 of the first inner support portion 5120 and the rear portion 4980 may define a support region 5160. As shown in FIG. 54, the support region 5160 partially surrounds the first weight port region 5040 and the second weight port region 5050. The inner walls 5121, 5123 and 5124 may have any shape and/or configuration such as the configurations of any of the inner support portions described herein. The apparatus, methods, and articles of manufacture described herein are not limited in this regard.

The bottom portion 4940 may include one or more outer support portions. In one example, as shown in FIG. 53, the bottom portion 4940 may include a first outer support portion 5170 and a second outer support portion 5180. Each of the first outer support portion 5170 and the second outer support portion 5180 may be defined by a channel or a groove on the outer surface 4942 of the bottom portion 4940. The first outer support portion 5170 may be closer to the face portion 4975 than the rear portion 4980. The second outer support portion 5180 may be closer to the rear portion 4980 than the face portion 4975. The first outer support portion 5170 may include a center portion 5172 that may extend in generally a similar direction as the face portion 4975. The first outer support portion 5170 may also include a first wing portion 5174 that may extend from the center portion 5172 toward the toe portion 4950 and/or the rear portion 4980, and a second wing portion 5176 that may extend from the center portion 5172 toward the heel portion 4960 and/or the rear portion 4980. The second outer support portion 5180 may include a center portion 5182 that may extend in generally a similar direction as the face portion 4975. The second outer support portion 5180 may also include a first wing portion 5184 that may extend from the center portion 5182 toward the toe portion 4950 and/or the rear portion 4980, and a second wing portion 5186 that may extend from the center portion 5182 toward the heel portion 4960 and/or the rear portion 4980. The outer support portions of the body portion 4910 may have any shape and/or configuration such as the configurations of any of the outer support portions described herein. The outer support portions 5170 and 5180 may have any configuration, such as the configurations described herein to provide structural support to the bottom portion 4940 when the face portion 4975 strikes a golf ball. Further, the outer support portions 5170 and 5180 may provide vibration and noise dampening and better feel and sound for the golf club head 4900. The apparatus, methods, and articles of manufacture described herein are not limited in this regard.

The width (i.e., thickness), length, height, orientation angle, and/or cross-sectional shape of the inner support portions 5120, 5122 and/or 5124 including the inner walls 5121 and 5123 may be similar or vary along any dimension thereof and/or be configured to provide structural support to the golf club head 4900. For example, characteristics of the body portion 4910 and/or the bottom portion 4940 including the materials from which the bottom portion 4940 and/or the body portion 4910 may be constructed may determine the width, length, height, orientation angle, and/or cross-sectional shape of the inner support portions 5120, 5122 and/or 5124 including the inner walls 5121 and 5123 along the any dimension thereof. In one example, any one or more of the inner support portions 5120, 5122 and 5124 may be defined by a wall having a height that may be similar to, greater than or less than the depths of the weight portions 5405, 5410, 5415, 5445, 5450 and/or 5455. The apparatus, methods, and articles of manufacture described herein are not limited in this regard.

Certain regions of the interior of the body portion 4910 of the golf club head 4900 may include a polymer material, an elastic polymer material or an elastomer material, which may be referred to herein as the filler material. The filler material may dampen vibration, dampen noise, lower the center of gravity and/or provide a better feel and sound for the golf club head 4900 when striking a golf ball (not shown). According to one example, the support region 5160 may partially or fully include the filler material. The filler material may extend from the inner surface 4944 of the bottom portion 4940 up to the height of any one or more of the inner support portions 5120, 5122 and 5124. However, the filler material may extend below or above any one or more of the inner support portions 5120, 5122 and 5124. The height or thickness of the filler material in the support region 5160 may be constant or may vary similar to the filler material for any of the golf club heads described herein. The apparatus, methods, and articles of manufacture described herein are not limited in this regard.

Any of the golf club heads described herein, including the golf club head 4900, may have one or more interior regions that may include a filler material as described herein. In one example, the filler material may be injected into the support region 5160 of the body portion 4910 from one or more of the weight ports. In the example of FIGS. 49-54, each of the weight ports 5410 and 5450 may include an opening 5411 and 5451, respectively, into the interior of the body portion 4910. Accordingly, the openings 5411 and 5451 may be used to inject the filler material into the support region 5160. In one example, one of the openings 5411 or 5451 may be used to inject filler material into the support region 5160, while the other opening 5451 or 5411, respectively, may be used for the air that is displaced by the filler material injected into the body portion 4910 to escape. The first inner support portion 5120, the second inner support portion 5122 and the third inner support portion 5124 may provide a boundary or a holding perimeter of the support region 5160 for the filler material when the filler material is injected into the body portion 4910. The filler material may be injected into the support region 5160 until the height of all or portions of the filler material is similar, less than, or greater than to the height of any one or more of the inner support portions 5120, 5122 and 5124. The support region 5160 may be partially filled with the filler material. The apparatus, methods, and articles of manufacture described herein are not limited in this regard.

Alternatively, one or more inserts may be formed from an elastic polymer material or an elastomer material (e.g., filler material) and placed in one or more regions of the interior of golf club head. FIG. 54 shows an example of the golf club head 4900 with an insert 5350, which may be constructed from an elastic polymer material or an elastomer material. The insert 5350 may be manufactured to have a similar shape as the shape of the support region 5160. Accordingly, the insert 5350 may have a curvature similar to the curvature of the bottom portion 4940 at the support region 5160 to lie generally flat and in contact with the inner surface 4944 of the bottom portion 4940. The insert 5350 may have a shape that may be similar to the shape of the support region 5160 to be inserted in the support region 5160 and generally fit within the support region 5160. Further, the insert 5350 may be surrounded and/or in contact with the inner support portions 5120, 5122 and/or 5124. The inner support portions 5120, 5122 and/or 5124 may engage all or portions of the perimeter of the insert 5350 to assist in maintaining the insert in the support region 5160 or maintain the insert in the support region 5160. The insert 5350 may have a plurality of cutout portions 5356 to generally match the shape and/or contour of the inner walls 5121 and 5123 and/or sidewall portions of each of the weight ports 5405, 5410, 5415, 5445, 5450 and 5455. Accordingly, when the insert 5350 is placed in the support region 5160, a portion of each port of the plurality of weight ports is received in a corresponding cutout portion 5356. The apparatus, methods, and articles of manufacture described herein are not limited in this regard.

The insert 5350 may have a thickness that may be similar to the thickness of any of the inserts described herein. Further, the insert 5350 may be manufactured from an elastic polymer material as a one-piece continuous part similar to any of the inserts described herein. Additionally, the insert 5350 may have any type of holes or apertures such as the holes or apertures of any of the inserts described herein. For example, as shown in FIG. 54, the insert may include hexagonal holes in honeycomb pattern. The insert 5350 may dampen vibration, dampen noise, lower the center of gravity and/or provide a better feel and sound for the golf club head 4900 when striking a golf ball (not shown). The apparatus, methods, and articles of manufacture described herein are not limited in this regard.

The filler material and or the insert 5350 may be manufactured from any of the materials described herein. The filler material or the insert 5350 may be bonded, attached and/or connected to the body portion 4910 of the golf club head 4900 by any of the methods described herein such as by a bonding portion (not shown) to improve adhesion and/or mitigate delamination between the body portion 4910 and the filler material or the insert 5350. Additionally, the filler material and the insert may be maintained in the support region 5160 by the inner support portions 5120, 5122 and 5124 as described herein. The apparatus, methods, and articles of manufacture described herein are not limited in this regard.

In the example of FIGS. 55-59, a golf club head 5500 may include a body portion 5510 with a top portion 5530, a bottom portion 5540, a toe portion 5550, a heel portion 5560, a front portion 5570 with a face portion 5575, a rear portion 5580, and a hosel portion 5565. Alternatively, the body portion 5510 may include a bore instead of the hosel portion 5565. The golf club head 5500 may be any type of golf club head described herein. The body portion 5510 may be made from any of the materials described herein. The golf club head 5500 may or may not include a plurality weight portions, weight ports configured to receive the weight portions, outer support portions and/or inner support portions, elastic polymer filler materials, and/or elastic polymer inserts similar to any of the golf club heads described herein. The apparatus, methods, and articles of manufacture described herein are not limited in this regard.

The top portion 5530 may include a crown portion 5630 with one or more openings extending into the body portion 5510. In the examples of FIGS. 55-58 the crown portion 5630 includes a first opening 5632 and a second opening 5634. In the example of FIG. 59, the crown portion 5630 includes one opening 5832. However, the crown portion may include any number of openings. In the examples of FIGS. 57 and 58, a portion of the crown portion 5630 defines a reinforcement portion 5636 that may separate the first opening 5632 and the second opening 5634. The reinforcement portion 5636 may be proximate to a center portion of the body portion 5510 and extend from a location at or proximate to the front portion 5570 to a location at or proximate to the rear portion 5580. The width of the reinforcement portion 5636 may be between approximately 3% and 15% of the distance between toe portion 5550 and heel portion 5560. The thickness of reinforcement portion may be between approximately 2% and 30% of the width of the reinforcement portion 5636. The reinforcement portion 5636 may be integral with the body portion 5510 and constructed from the same materials as the body portion 5510. The reinforcement portion 5636 may be a separate piece form the body portion 5510 and/or constructed form a different material than the body portion 5520. The reinforcement portion 5636 may provide a reinforcing or bracing effect on the crown portion 5630. Accordingly, the reinforcement portion 5636 may reduce flexure of the face portion 5575 and/or the crown portion 5630 when the golf club head 5500 strikes a golf ball via the face portion 5575. The crown portion 5630 may include a plurality of reinforcement portions when the crown portion 5630 includes more than two openings. The apparatus, methods, and articles of manufacture described herein are not limited in this regard.

The first opening 5632 may extend from a location proximate to the front portion 5570 to a location proximate to the rear portion 5580. The first opening 5632 may also extend from the reinforcement portion 5636 to a location proximate to the toe portion 5550 and follow the contour of the body portion 5510 proximate to the toe portion 5550. The second opening 5634 may extend from a location proximate to the front portion 5570 to a location proximate to the rear portion 5580. The second opening 5634 may also extend from the reinforcement portion 5636 to a location proximate to the heel portion 5560 and follow the contour of the body portion 5510 proximate to the heel portion 5560. In one example as shown in FIGS. 55-57, the first opening 5632, the second opening 5634 and the reinforcement portion 5636 may collectively define a shape resembling the general shape of the crown portion 5630 and located within the boundaries crown portion 5630. Accordingly, the crown portion 5630 may include a crown perimeter portion 5638 that surrounds the first opening 5632, the second opening 5634 and the reinforcement portion 5636. The width 5640 of the crown perimeter portion 5638 at any location around the crown perimeter portion 5638 may be configured based on at least one of the thickness, size, shape and materials of construction of the crown portion 5630 and the impact forces experienced by the body portion 5510 when striking a golf ball (not shown). The apparatus, methods, and articles of manufacture described herein are not limited in this regard.

The golf club head 5500 may include one or more cover portions to cover any one or more openings on the crown portion 5630. In the example of FIG. 57, the golf club head 5500 includes a first cover portion 5650 that is configured to be attached to the crown portion 5630 and cover the first opening 5632 and a second cover portion 5750 that is configured to be attached to the crown portion 5630 to cover the second opening 5634. The first cover portion 5650 and the second cover portion 5750 may also provide structural support for the crown portion 5630. Accordingly, the thickness and materials of construction of the first cover portion 5650 and the second cover portion 5750 may be configured to provide structural support for the crown portion 5630 and to absorb shock, isolate vibration, and/or dampen noise when the golf club head 5500 strikes a golf ball via the face portion 5575. The first opening 5632 may include one or more ridges, shoulders or protrusions (not shown) below the outer surface of the crown portion 5630 configured to support the first cover portion 5650 so that the first cover portion 5650 may be flush with the outer surface of the crown portion 5630 when the first cover portion 5650 is attached to the crown portion 5630 to cover the first opening 5632. The second opening 5634 may include one or more ridges, shoulders or protrusions (not shown) below the outer surface of the crown portion 5630 configured to support the second cover portion 5750 so that the second cover portion 5750 may be flush with the outer surface of the crown portion 5630 when the second cover portion 5750 is attached to the crown portion 5630 to cover the second opening 5634. The apparatus, methods, and articles of manufacture described herein are not limited in this regard.

The first cover portion 5650 and/or the second cover portion 5750 may be made partially or entirely of an aluminum-based material, a magnesium-type material, a steel-based material, a titanium-based material, a non-metal material such as a polymer material, a ceramic material, a composite material, any combination thereof, or any other suitable material. In the example of FIGS. 55-57, the first cover portion 5650 includes a top layer 5652, a bottom layer 5654, and a middle layer 5656. The second cover portion 5750 includes a top layer 5752, a bottom layer 5754, and a middle layer 5756. The top layer 5652, the top layer 5752, the bottom layer 5654 and/or the bottom layer 5754 may be constructed from a composite material. In one example, the top layer 5652, the top layer 5752, the bottom layer 5654 and/or the bottom layer 5754 may be constructed from graphite-epoxy composite or other suitable fiber composite materials. The thickness of the top layer 5652, the top layer 5752, the bottom layer 5654 and/or the bottom layer 5754 may depend on the characteristics and a certain weight distribution of the golf club head 5500. The top layer 5652, the top layer 5752, the bottom layer 5654 and/or the bottom layer 5754 may provide structural support for the crown portion 5630 when the golf club head 5500 strikes a golf ball via the face portion 5575. The middle layer 5656 and/or the middle layer 5756 may be constructed from any polymer material and/or elastomer material with a thickness to absorb shock, isolate vibration, and/or dampen noise when the golf club head 5500 strikes a golf ball via the face portion 5575. Accordingly, the middle layer 5656 and/or the middle later 5756 may be constructed from a material that has less rigidity or more elasticity than the material of the top layers 5652 and 5752 and/or the bottom layers 5654 and 5754. For example, the middle layer 5656 and/or the middle layer 5756 may be constructed form a material that is similar to any of the polymer, elastomer and/or elastic polymer materials described herein. The top layer 5652, the bottom layer 5654 and the middle layer 5656 may be attached or bonded together by adhesives such as epoxy. The top layer 5752, the bottom layer 5754 and the middle layer 5756 may be attached or bonded together by adhesives such as epoxy. The first cover portion 5650 may be attached to the crown portion 5630 to cover the first opening 5632 by any methods or materials. For example, the first cover portion 5650 may be attached to the crown portion 5630 with one or more adhesives described herein such as epoxy. The second cover portion 5750 may be attached to the crown portion 5630 to cover the second opening 5634 by any methods or materials. For example, the second cover portion 5750 may be attached to the crown portion 5630 with one or more adhesives described herein such as epoxy. Any of the cover portions described herein may be co-manufactured with the body portion 5510 such that the one or more cover portions as described herein define continuous one-piece portions of the crown portion 5630. The apparatus, methods, and articles of manufacture described herein are not limited in this regard.

The first cover portion 5660 and the second cover portion 5750 may be a single cover portion that may be configured to cover both the first opening 5632 and the second opening 5634. For example, as shown in FIG. 58, the golf club head 5500 may include a single cover portion 5850 that is configured to be attached to the crown portion 5630 to cover both the first opening 5632 and the second opening 5634. Accordingly, the reinforcement portion 5636 may be recessed so that the cover portion 5850 can remain flush with the outer surfaces of the crown portion 5630 when the cover portion 5850 is attached to the crown portion 5630. The golf club head 5500 may not include a reinforcement portion. For example, as shown in FIG. 59, the golf club head 5500 may include a single opening 5832 on the crown portion 5630. Accordingly, the cover portion 5850 may be configured to be attached to the crown portion 5630 to cover the opening 5832. The opening 5832 may include one or more ridges, shoulders or protrusions (not shown) below the outer surface of the crown portion 5630 configured to support the cover portion 5850 so that the cover portion 5850 may be flush with the outer surface of the crown portion 5630 when the cover portion 5850 is attached to the crown portion 5630 to cover the opening 5832. The apparatus, methods, and articles of manufacture described herein are not limited in this regard.

In the example of FIG. 58, the cover portion 5850 may include a top layer 5852, a bottom layer 5854, and a middle layer 5856. The cover portion 5850 including the top layer 5852, the bottom layer 5854, and the middle layer 5856 may be similar in many respects including methods and materials of construction to the cover portion 5650 (including the layers 5652, 5654 and 5656) and/or the cover portion 5750 (including the layers 5752, 5754 and 5756) as described herein. The cover portion 5850 may be attached to the crown portion 5630 to cover the first opening 5632 and the second opening 5634 as in the example of FIG. 58, or to cover the opening 5832 as in the example of FIG. 59 by any methods or materials described herein. The apparatus, methods, and articles of manufacture described herein are not limited in this regard.

The first cover portion 5660 and the second cover portion 5750 of the examples of FIG. 57, and the cover portion 5850 of the examples of FIGS. 58 and 59 may contribute to a reduction in weight of the crown portion 5630 while maintaining or increasing the structural strength of the crown portion 4430. Accordingly, the golf club head 5500 may have a lower center of gravity than a golf club head having a crown portion that is constructed from the same material as the body portion 5510 and may be in one piece with the body portion 5510. The lower center of gravity may promote a higher ball trajectory. Additionally, the middle layers 5656, 5756, and 5856 of the cover portions 5650, 5750 and 5850, respectively, may absorb and distribute shock, isolate vibration, and/or dampen noise when the golf club head 5500 strikes a golf ball via the face portion 5575. The apparatus, methods, and articles of manufacture described herein are not limited in this regard.

The crown portion 5630 may include one or more recesses (not shown) instead of one or more openings that may be configured to receive one or more cover portions as described herein. Accordingly, the one or more recesses may not be open to the interior of the body portion 5510. The depth of the one or more recesses (not shown) may be similar or substantially similar to the thickness of the one or more cover portions, respectively, that are configured to cover the one or more recesses so that the one or more cover portions remain flush with the top surface of the crown portion 5630. The apparatus, methods, and articles of manufacture described herein are not limited in this regard.

Turning to FIGS. 60 and 61, for example, the golf club head 5500 may include a hosel assembly 6000 with a hosel 6002, a hosel sleeve 6004, and a fastener 6008. In one example, the hosel 6002 may extend outward from the top portion 5530 and does not extend into the body portion 5510. The hosel 6002 may be configured to receive the hosel sleeve 6004 such that a portion of the hosel sleeve 6004 may be located inside the body portion 5510 as shown in FIG. 60. The hosel sleeve 6004 may include an outer wall 6005 and a ferrule portion 6006. The outer wall 6005 of the portion of the hosel sleeve 6004 inside the body portion 5510 may be exposed to the interior space or the hollow space of the body portion 5510. In other words, as shown in FIG. 61, the hosel 6002 does not extend into the body portion 5510 and the body portion 5510 does not include any structure to surround or cover the hosel sleeve 6004. The apparatus, methods, and articles of manufacture described herein are not limited in this regard.

The hosel sleeve 6004 may be attached to the hosel 6002 and/or the body portion 5510 by one or more fasteners, one or more adhesives, welding, one or more mechanical locking mechanisms, and/or a combination thereof. In one example shown in FIG. 60, the hosel sleeve 6004 may be fixed to the body portion by the fastener 6008, which may be a threaded fastener such as a bolt. The hosel sleeve 6004 may include a first end configured to receive a shaft (not shown) and a second end 6012 having a threaded bore 6014. The bottom portion 5540 may include an opening 6016 configured to receive the fastener 6008. The opening 6016 may be generally axially aligned with the threaded bore 6014 at the second end 6012 of the hosel sleeve 6004 when the hosel sleeve 6004 is inserted into the hollow body portion 5510 through the hosel 6002 as shown in FIG. 60. The fastener 6008 may be inserted into the opening 6016 and threaded into the threaded bore 6014 of the hosel sleeve 6004 to fasten the hosel sleeve 6004 to the hosel 6002 and/or to the body portion 5510. A shaft (not shown) may then be inserted and affixed in the hosel sleeve 6004. The apparatus, methods, and articles of manufacture described herein are not limited in this regard.

The terms "and" and "or" may have both conjunctive and disjunctive meanings. The terms "a" and "an" are defined as one or more unless this disclosure indicates otherwise. The term "coupled" and any variation thereof refer to directly or indirectly connecting two or more elements chemically, mechanically, and/or otherwise. The phrase "removably connected" is defined such that two elements that are "removably connected" may be separated from each other without breaking or destroying the utility of either element.

The term "substantially" when used to describe a characteristic, parameter, property, or value of an element may represent deviations or variations that do not diminish the characteristic, parameter, property, or value that the element may be intended to provide. Deviations or variations in a characteristic, parameter, property, or value of an element may be based on, for example, tolerances, measurement errors, measurement accuracy limitations and other factors. The term "proximate" is synonymous with terms such as "adjacent," "close," "immediate," "nearby", "neighboring", etc., and such terms may be used interchangeably as appearing in this disclosure.

The apparatus, methods, and articles of manufacture described herein may be implemented in a variety of embodiments, and the foregoing description of some of these embodiments does not necessarily represent a complete description of all possible embodiments. Instead, the description of the drawings, and the drawings themselves, disclose at least one embodiment, and may disclosure alternative embodiments.

As the rules of golf may change from time to time (e.g., new regulations may be adopted or old rules may be eliminated or modified by golf standard organizations and/or governing bodies such as the USGA, the R&A, etc.), golf equipment related to the apparatus, methods, and articles of manufacture described herein may be conforming or non-conforming to the rules of golf at any particular time. Accordingly, golf equipment related to the apparatus, methods, and articles of manufacture described herein may be advertised, offered for sale, and/or sold as conforming or non-conforming golf equipment. Further, while the above examples may be described with respect to golf clubs, the apparatus, methods and articles of manufacture described herein may be applicable to other suitable types of sports equipment such as a fishing pole, a hockey stick, a ski pole, a tennis racket, etc. The apparatus, methods, and articles of manufacture described herein are not limited in this regard.

The scope of coverage of this disclosure is not limited to the example apparatus, methods, and articles of manufacture described herein. On the contrary, this disclosure covers all apparatus, methods, and articles of articles of manufacture fairly falling within the scope of the appended claims either literally or under the doctrine of equivalents.

What is claimed is:

1. A golf club head comprising:

a hollow body portion having a volume of greater than or equal to 300 cubic centimeters, the hollow body portion comprising a bottom portion, a top portion, a toe portion, a heel portion, a front portion, and a rear portion;

a crown portion on the top portion, the crown portion comprising a composite material;

a first groove on the bottom portion extending in a heel-to-toe direction, a distance between the first groove and the front portion being less than a distance between the first groove and the rear portion;

a second groove on the bottom portion extending in a heel-to-toe direction, a distance between the second groove and the front portion being greater than a distance between the second groove and the rear portion;

a first set of ports on the bottom portion between the first groove and the second groove, a distance between the first set of ports and the heel portion being less than a distance between the first set of ports and the toe portion;

a second set of ports on the bottom portion between the second groove and the rear portion; and a filler material in the hollow body portion between the first groove and the rear portion, wherein the filler material at least partially surrounds the first set of ports and the second set of ports, and wherein the filler material comprises a polymer mesh.

2. A golf club head according to claim 1, wherein the first set of ports comprises at least two ports with each port having a port diameter, and wherein the at least two ports are separated by a distance of less than or equal to the port diameter.

3. A golf club head according to claim 1, wherein the second set of ports comprises at least two ports with each port having a port diameter, and wherein the at least two ports are separated by a distance of less than or equal to the port diameter.

4. A golf club head according to claim 1, wherein the first groove comprises a center portion and opposing end portions, wherein the opposing end portions extend rearward relative to the center portion.

5. A golf club head according to claim 1, wherein the second groove comprises a center portion and opposing end portions, wherein the opposing end portions extend rearward relative to the center portion.

6. A golf club head according to claim 1, wherein a length of the first groove is greater than a length of the second groove.

7. A golf club head comprising:

a body portion having a volume of greater than or equal to 300 cubic centimeters, the body portion comprising an interior cavity, a bottom portion, a top portion, a toe portion, a heel portion, a front portion, and a rear portion;

a crown portion on the top portion, the crown portion comprising a composite material;

a first groove on the bottom portion, the first groove comprising a first groove center portion extending in a heel-to-toe direction and two opposing first groove end portions extending toward the top portion from the first groove center portion, a distance between the first groove and the front portion being less than a distance between the first groove and the rear portion;

a second groove on the bottom portion, the second groove comprising a second groove center portion extending in a heel-to-toe direction and two opposing second groove end portions extending toward the top portion from the second groove center portion, a distance between the second groove and the front portion being greater than a distance between the second groove and the rear portion;

a first set of ports on the bottom portion between the first groove and the second groove and extending into the interior cavity from the bottom portion, a distance between the first set of ports and the heel portion being less than a distance between the first set of ports and the toe portion;

a second set of ports on the bottom portion between the second groove and the rear portion and extending into the interior cavity from the bottom portion; and a filler material coupled to an inner surface of the bottom portion inside the interior cavity between the first groove and the rear portion, wherein the filler material comprises a plurality of cutout portions with each cutout portion configured to at least partially surrounds a port of the first set of ports or a port of the second set of ports.

8. A golf club head according to claim 7, wherein ports of the first set of ports and the second set of ports are configured to interchangeably receive weight portions, and wherein each weight portion comprises a material having a greater density than a material of the body portion.

9. A golf club head according to claim 7, wherein the first set of ports comprises at least two ports and the second set of ports comprises at least two ports with each port of the first set of ports and the second set of ports having a port diameter, and wherein the at least two ports of the first set of ports are separated by a distance of less than or equal to the port diameter, and wherein at least two ports of the second set of ports are separated by a distance of less than or equal to the port diameter.

10. A golf club head according to claim 7, wherein the two opposing first groove end portions extend rearward relative to the first groove center portion.

11. A golf club head according to claim 7, wherein the two opposing second groove end portions extend rearward relative to the second groove center portion.

12. A golf club head according to claim 7, wherein a length of the first groove is greater than a length of the second groove.

13. A golf club head according to claim 7, wherein the filler material comprises a plurality of holes.

14. A golf club head comprising:

a body portion having a volume of greater than or equal to 300 cubic centimeters, the body portion comprising an interior cavity, a bottom portion, a top portion, a toe portion, a heel portion, a front portion, and a rear portion;

a first groove on the bottom portion, the first groove comprising a first groove center portion extending in a heel-to-toe direction and two opposing first groove end portions extending toward the top portion and toward the rear portion from the first groove center portion, a distance between the first groove and the front portion being less than a distance between the first groove and the rear portion;

a second groove on the bottom portion, the second groove comprising a second groove center portion extending in a heel-to-toe direction and two opposing second groove end portions extending toward the top portion and toward the rear portion from the second groove center portion, a distance between the second groove and the front portion being greater than a distance between the second groove and the rear portion;

a plurality of weight portions comprising a material having a greater density than a material of the body portion;

at least two ports on the bottom portion extending into the interior cavity from the bottom portion, each port of the at least two ports configured to receive a weight portion of the plurality of weight portions; and a filler material coupled to an inner surface of the bottom portion inside the interior cavity between the first groove and the rear portion, wherein the filler material is coupled to each port of the at least two ports, and wherein the filler material comprises a plurality of holes and a plurality of cutout portions with each cutout port configured to at least partially surround a port of the at least two ports.

15. A golf club head according to claim 14, wherein a length of the first groove center portion is greater than a length of each first groove end portion.

16. A golf club head according to claim 14, wherein a length of the second groove center portion is greater than a length of each second groove end portion.

17. A golf club head according to claim 14, wherein a length of the first groove center portion is greater than a length of the second groove center portion.

18. A golf club head according to claim 14, wherein each port of the at least two ports includes a port diameter, and wherein the at least two ports are separated by a distance of less than or equal to the port diameter.

* * * * *